US007123851B2

(12) United States Patent
Tomita et al.

(10) Patent No.: US 7,123,851 B2
(45) Date of Patent: Oct. 17, 2006

(54) ADJUSTMENT METHOD OF IMAGE FORMING DEVICE, IMAGE FORMING DEVICE, ADJUSTMENT METHOD OF IMAGE FORMING SYSTEM, IMAGE FORMING SYSTEM, AND ADJUSTMENT METHOD OF IMAGE SCANNING DEVICE

(75) Inventors: Norio Tomita, Yamatokoriyama (JP); Mitsuharu Yoshimoto, Kitakatsuragi-gun (JP); Kyosuke Taka, Nara (JP); Nobuo Manabe, Yamatokoriyama (JP); Manabu Matsumoto, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 330 days.

(21) Appl. No.: 10/852,268

(22) Filed: May 25, 2004

(65) Prior Publication Data

US 2004/0240894 A1 Dec. 2, 2004

(30) Foreign Application Priority Data

May 28, 2003 (JP) ..... 2003-151327
Dec. 2, 2003 (JP) ..... 2003-403503

(51) Int. Cl.
*G03G 15/00* (2006.01)

(52) U.S. Cl. ..... 399/49; 399/17; 399/301; 399/51

(58) Field of Classification Search ..... 399/301, 399/49, 38, 51, 72; 347/132, 116
See application file for complete search history.

(56) References Cited

U.S. PATENT DOCUMENTS 5,857,130 A * 1/1999 Ueda et al. ..... 399/17
2005/0036799 A1* 2/2005 Tomita et al. ..... 399/49

FOREIGN PATENT DOCUMENTS

| | | |
|---|---|---|
| JP | 07-125314 | 5/1995 |
| JP | 08-265560 | 10/1996 |
| JP | 10-004493 | 1/1998 |
| JP | 10-186994 | 7/1998 |
| JP | 2003-069789 | 3/2003 |

* cited by examiner

*Primary Examiner*—David M. Gray
*Assistant Examiner*—Ryan D. Walsh
(74) *Attorney, Agent, or Firm*—Nixon & Vanderhye, P.C.

(57) ABSTRACT

An adjustment method for an image forming device, for adjusting image forming condition with respect to a sheet by using image forming means. The adjustment operation is performed in such a manner that: a first image, that is used for detecting scanning error of an image scanning device, is formed on an image carrying body and then transferred from the image carrying body to the sheet, the first image being formed over at least three corners of the sheet while extending outside the sheet. The sheet with the first image is scanned by the image scanning device to figure out a scanning error amount of the image scanning device, and a correction value of image forming condition of the image forming means is found in consideration of the scanning error amount. The image forming condition with respect to the sheet is modified based on the correction value.

69 Claims, 27 Drawing Sheets

ADJUSTMENT METHOD OF IMAGE FORMING DEVICE, IMAGE FORMING DEVICE, ADJUSTMENT METHOD OF IMAGE FORMING SYSTEM, IMAGE FORMING SYSTEM, AND ADJUSTMENT METHOD OF IMAGE SCANNING DEVICE

This Nonprovisional application claims priority under 35 U.S.C. § 119(a) on Patent Application No. 2003/151327 filed in Japan on May 28, 2003, and Patent Application No. 2003/403503 filed in Japan on Dec. 2, 2003, the entire contents of which are hereby incorporated by reference.

Field of the Invention

The present invention relates to a device, and in particular to an adjustment method of an image forming device, an image forming device, an adjustment method of image forming system, an image forming system, and an adjustment method of an image scanning device.

BACKGROUND OF THE INVENTION

An example of an image forming device using an electrophotography system may be a copying machine, a printer, a facsimile. Each of these image forming devices forms an image on a sheet on the basis of image data inputted from peripheral devices for example.

In such a device, it may occur that an image is printed on a different position on the sheet from the original position of the image, i.e., the position of inputted image data. Such positional deviation of the image formed on the sheet results from a difference between (i) a position in which sheet carrying means carries the sheet and (ii) a position of an image written on an image holder (photoconductive drum) on the basis of the image data.

In order to correct the positional deviation, for example, the position in which the sheet is carried is adjusted, and a position in which the image is formed is adjusted to a predetermined position. In this manner, it is possible to perform adjustment so that the image is formed in a proper position of the sheet. Further, it is possible to adjust a position of the image formed on the image holder and a position of the sheet carried by sheet carrying means so that the one of the positions corresponds to the other.

For example, in an arrangement recited in Patent Document 1 (Japanese Unexamined Patent Publication No. 125314/1995 (Tokukaihei 7-125314) (Publication date: May 16, 1995)), reference image data stored in the image forming device in advance is outputted to the sheet, and the sheet is scanned by an image scanning device, so as to adjust the position of the image formed on the sheet.

Further, for example, in an arrangement recited in Patent Document 2 (Japanese Unexamined Patent Publication No. 186994/1998 (Tokukaihei 10-186994) (Publication date: Jul. 14, 1998)), first, an image that has not been subjected to adjustment is formed, and the image is confirmed by scanning means, so as to adjust the position of the image formed on the sheet.

Moreover, each of Patent Document 3 (Japanese Unexamined Patent Publication No. 265560/1996 (Tokukaihei 8-265560) (Publication date: Oct. 11, 1996)) and Patent Document 4 (Japanese Unexamined Patent Publication No. 69789/2003 (Tokukai 2003-69789) (Publication date: Mar. 7, 2003)) discloses an arrangement in which a test chart is used to perform the adjustment.

Recently, with diversification of image formation, multi-stage sheet containing means is often installed on the image forming device so as to efficiently use plural types of sheets. For example, Patent Document 5 (Japanese Unexamined Patent Publication No. 4493/1998 (Tokukaihei 10-4493) (Publication date: Jan. 16, 1998)) discloses an arrangement of a facsimile device provided with a plurality of feeding cassettes wherein a scanning position is adjusted for each cassette.

However, in the aforementioned conventional arrangements, a test chart or the like of a reference image is scanned by using the image scanning device which is a peripheral device, but it is necessary to provide an image scanning device which is properly adjusted and is free from any scanning deviation in order to exactly scan the positional deviation. Further, it is necessary to perform operations so many times in adjusting the image forming device. Such arrangement results in troublesome adjustment.

That is, in the conventional arrangements, the image formed on the sheet is confirmed through one's eyes for example, and a condition and an amount of the positional deviation are determined by the image scanning device, in order to properly figure out the positional deviation. Thus, when an image scanning device causing the scanning deviation is used, it is impossible to exactly figure out the positional deviation, so that it is impossible to perform the adjustment. Note that, such adjustment is performed by an assembling/adjusting caretaker or a service person at a time of production, or at a time when the service person places the image forming device, or at a time when parts or units concerning image formation are replaced with new ones.

For example, as to a multi-functional device (copying device) in which the image forming device and the image scanning device are combined, it is necessary to adjust the image scanning device with adjustment of the image formation in the multi-functional device. That is, in the image scanning device for inputting image data to the image forming device, when image data with the positional deviation is generated in scanning a document, the image data is inputted to the image forming device as it is. Thus, even the image forming device whose adjustment has been completed forms an image whose position is deviated. Note that, also the image forming device requires adjustment of the scanning position in this manner, so that the adjustment is performed by an assembling/adjusting caretaker or a service person.

Thus, in the multi-functional device for example, it is general that: a printed material (image-formed material: test chart) on which an image has been formed is scanned by the image scanning device on the basis of reference data, and a position and a scale factor of an image to be formed on a sheet in the image forming device are adjusted in accordance with thus scanned image. Therefore, in case where neither the image scanning device nor the image forming device have been adjusted, the image scanning device is previously adjusted, and the image forming device is adjusted thereafter, so as to adjust the multi-functional device.

In this case, the adjustment of the image scanning device requires a reference document (reference chart), so that a service person or the like has to always carry the reference chart. If he or she carries no reference chart, it is impossible to perform the adjustment.

In the conventional arrangements, the adjustment is performed in accordance with the following procedure. The test chart is scanned so as to adjust the image scanning device. After adjusting the image scanning device, the test chart is scanned again, and data of the scanned test chart is printed on a sheet by the image forming device. The sheet is scanned again so as to adjust the image forming device. In this manner, the adjustment operations are performed so many times, so that it takes great trouble to perform the adjustment.

Further, in case where a plurality of containing means for containing sheets are provided on the image forming device, a position and a scale factor of an image formed on the sheet are adjusted for each sheet containing means. However, it takes great trouble to perform the adjustment operations for each containing means.

SUMMARY OF THE INVENTION

An object of the present invention is to provide an adjustment method for an image forming device, and an image forming device carrying out adjustment with the method. With the method and the device, the present invention allows proper adjustment of image forming condition of the image forming device, such as image position, scaling etc. with respect to the sheet, even when a scanning section, such as a scanning device, for scanning the formed image is not accurately adjusted.

In order to solve the foregoing problems, the present invention provides an adjustment method for an image forming device, for adjusting image forming condition with respect to a sheet, an image forming device comprising: an image forming section for forming an image on an image carrying body and transferring the image from the image carrying body to a sheet, the adjustment method comprising the steps of: (a) creating an adjustment sheet with the image forming section, by forming a first image, that is used for detecting scanning error of an image scanning device, on the image carrying body and transferring the first image from the image carrying body to the sheet, the first image being formed over at least three corners of the sheet while extending outside the sheet; (b) scanning the adjustment sheet created in the step (a) by the image scanning device and calculating a scanning error amount of the image scanning device based on image data of the first image, so as to find a correction value of image forming condition of the image forming section in consideration of the scanning error amount; and (c) modifying image forming condition of the image forming section based on the correction value found in the step (b).

Further, the present invention provides an image forming device, comprising: an image forming section for forming an image on an image carrying body and transferring the image from the image carrying body to a sheet; an adjustment sheet creating section for creating an adjustment sheet with the image forming section, by forming a first image, that is used for detecting scanning error of an image scanning device, on the image carrying body and transferring the first image from the image carrying body to the sheet, the first image being formed over at least three corners of the sheet while extending outside the sheet; a correction value obtaining section for calculating a scanning error amount of the image scanning device based on image data of the first image that is obtained by the image scanning section by scanning the adjustment sheet created by the adjustment sheet creating section, so as to find a correction value of image forming condition of the image forming section in consideration of the scanning error amount; and an image forming condition correcting section for modifying image forming condition of the image forming section based on the correction value found by the correction value obtaining section.

With the foregoing image forming adjustment method for image forming device, and the image forming device using the method, it is possible to create an adjustment sheet (printed matter) for correcting scanning error of the image scanning device (in the adjustment sheet creating step). Therefore, a special sheet (reference document) for adjusting an image forming device is not required. Also, it is not necessary to bring the sheet for adjustment.

After the first image for detecting a scanning error of the image forming device is formed over at least three corners of the sheet while extending outside the sheet, and the adjustment sheet with the first image is scanned by the image scanning device, the step (b) or the correction value obtaining section compares the scanned data of the first image with a known value of the sheet used for the adjustment sheet so as to find a scanning error amount of the image scanning condition of the image scanning device.

In this manner, it is possible to find a correction value of image forming condition of the image forming section in consideration of the scanning error amount, and to modify image forming condition based on the correction value in the step (c) or by the image forming condition correcting section, thereby allowing proper adjustment of image forming condition of the image forming device, such as image position, scaling etc. with respect to the sheet, even when a scanning section, such as a scanning device, for scanning the formed image is not accurately adjusted.

Further, since this method figures out a scanning error amount of image scanning condition of the image forming device, it is possible to carry out separate modification of image scanning condition of the image scanning device using the scanning error amount.

Further, in an image forming system in which the image scanning device and the image forming device are combined, both the image forming condition and the image scanning condition can be modified with the use of the adjustment sheet, as the sheet can be used for finding the respective correction values of image forming condition of the image forming device and image scanning condition of the image scanning device.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 13 is placed on the original platen of the image forming system.

DESCRIPTION OF THE EMBODIMENTS

FIRST EMBODIMENT

Figure 1:
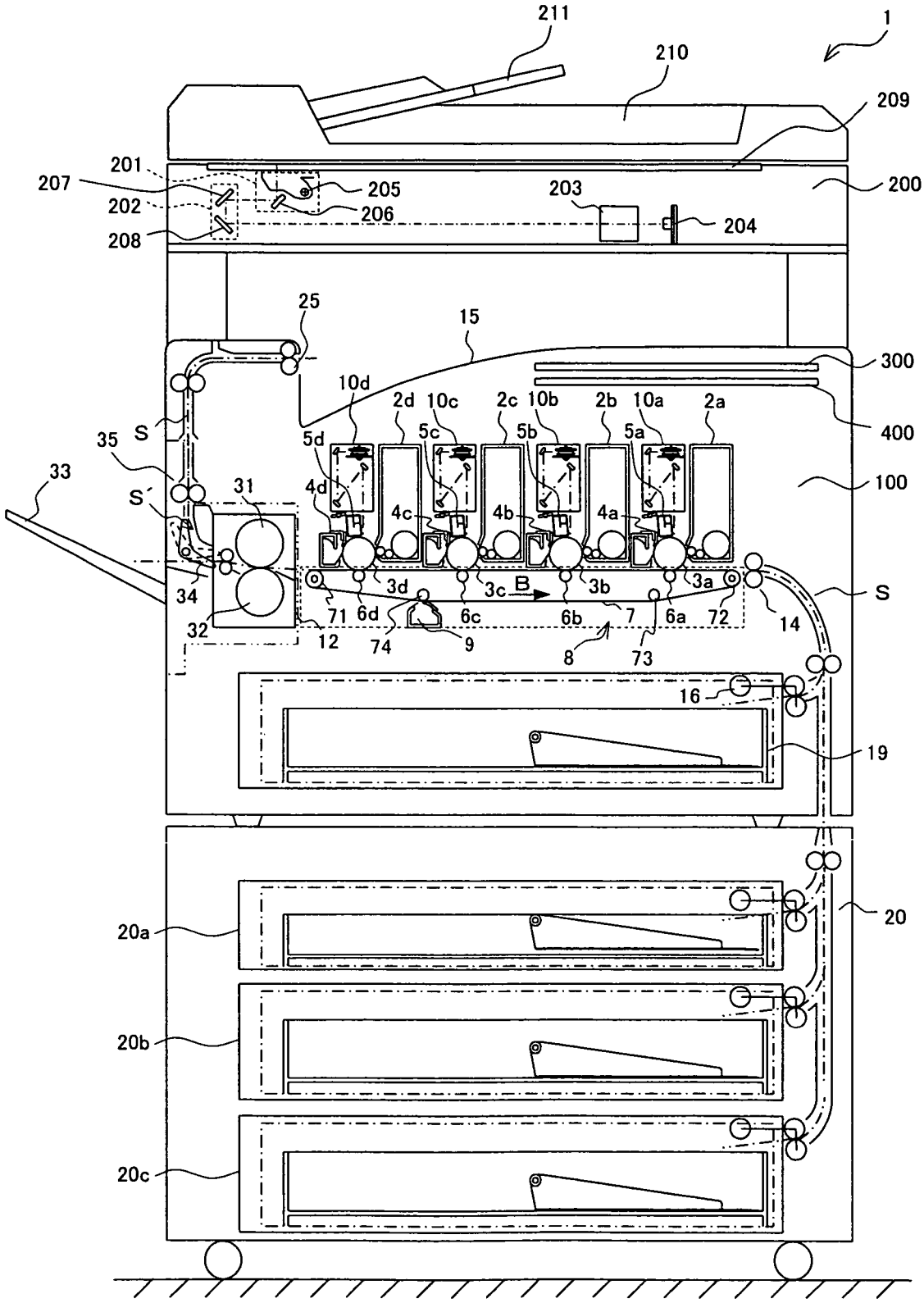
FIG. 1 shows an internal arrangement of an image forming device according to one embodiment of the present invention.

One embodiment of the present invention will be described below with reference to FIGS. 1 through 9.

An image forming system of the present embodiment is a multi functional device that includes an image scanning device and an image forming device in a single housing. As shown in the internal structure diagram of FIG. 1, the multi-functional device 1 schematically includes an automatic document carrying device 210, scanning means (image scanning device) 200, an image forming section (image forming device) 100 and a paper feeding desk unit 20.

The multi-functional device 1 according to the present embodiment includes the scanning means 200 on an upper portion. An original platen 209 of a transparent glass is provided on the upper surface of the scanning section 200. The automatic document carrying device 210 is provided above the original platen 209. Further, the image forming section 100 is provided under the scanning section 200, and the paper feeding desk unit 20 is placed under the image forming section 100.

The automatic document carrying device 210 operates to automatically carry a plurality of sheets (documents) placed on the document setting tray 211 one by one to the original platen 209.

The scanning means 200 scans images of the sheet placed on the original platen 209. In the present embodiment, the scanning means 200 is color scanning means. The scanning means 200 includes a first scanning unit 201, a second scanning unit 202, an optical lens 203, and a CCD line sensor 204 as a photoelectric conversion element. The CCD line sensor 204 includes a plurality of scanning sensors that are linearly aligned. These members are provided below the original platen 209.

The first scanning unit 201 is made up of an exposure lamp 205 for exposing the document surface, and a first mirror 206 for reflecting an optical image obtained from the sheet toward a predetermined direction. The second scanning unit 202 includes a second mirror and a third mirror that lead the light having been reflected on the first mirror 206 of the first scanning unit 201 to the CCD line sensor 204 serving as a photoelectric conversion element.

The optical lens 203 forms an image from the reflection light of the document on the CCD line sensor 204. The CCD line sensor 204 includes an image sensor with three lines of R (Red), G (Green) and B (Blue), thus carrying out scanning by dividing the image into three colors.

The following describes an arrangement of the image forming section 100, and arrangements of relative sections to the image forming section 100.

The image forming section 100 forms color or monochrome images onto a predetermined sheet (recording paper) according to the image data externally transmitted.

The image forming section 100 includes four image forming stations to handle a color image. The image forming section 100 deals with image data corresponding to a color image using Black (K), Cyan (C), Magenta (M) and Yellow (Y).

Therefore, as shown in FIG. 1, the image forming section 100 includes exposure units 10 (10*a*, 10*b*, 10*c*, 10*d*), developing device 2 (2*a*, 2*b*, 2*c*, 2*d*), photoconductive drums (image holder) 3 (3*a*, 3*b*, 3*c*, 3*d*), cleaner units 4 (4*a*, 4*b*, 4*c*, 4*d*), and charging devices 5 (5*a*, 5*b*, 5*c*, 5*d*). Each one of those sections is provided in the respective four image forming stations. The reference symbols of a, b, c and d of the four image forming sections correspond to Black (K), Cyan (C), Magenta (M) and Yellow (Y), respectively. However, for ease of explanation, the present specification describes the exposure units 10, the developing device 2, the photoconductive drums 3, the cleaner units 4 or the charging devices 5 as plural units, unless explanation needs distinction of the four image forming stations.

Further, as shown in FIG. 1, the image forming section 100 further includes a transfer carriage belt unit 8, a fixing unit 12, a paper carrying path S, a paper feeding tray 19, discharge trays 15 and 33, an image processing substrate 300 and a control circuit substrate 400 etc.

The following explains respective sections of the image forming section 100.

The photoconductive drums 3 are disposed (mounted) in substantially the central area of the image forming section 100. The charging devices 5 serve as charging means for evenly charging the photoconductive drums 3 with a predetermined potential. Though the charging devices 5 are shown as charger-type devices in FIG. 1, they may also be contact-type charging rollers or brushes.

Each exposure unit 10 may be an EL including an array of light emitters, or a LED writing head, or otherwise a laser scanning unit (LSU) made up of a laser irradiation section and a reflection mirror. The exposure units 10 carry out exposure of the charged photoconductive drums 3 according to the input images so as to form electrostatic latent images corresponding to the image data on the surfaces of the drums.

The developing device 2 visualizes the electrostatic latent images formed on the photoconductive drums 3 using toners of K, C, M and Y. The cleaner units 4 remove/collect residue of toner on the surfaces of the photoconductive drums 3 after development/image transfer.

The transfer carriage belt unit 8 is provided under the photoconductive drums 3. The transfer carriage belt unit 8 is made up of a transfer belt 7, a transfer belt driving roller 71, a transfer belt tension roller 72, a transfer belt driven roller 73, a transfer belt supporting roller 74, transfer rollers 6 (6*a*, 6*b*, 6*c*, 6*d*) and a transfer belt cleaning unit 9.

The transfer belt 7 is hung on the transfer belt driving roller 71, the transfer belt tension roller 72, the transfer belt driven roller 73, and the transfer belt supporting roller 74 etc., and is rotated by these rollers in the direction denoted by the arrow B in FIG. 1.

The transfer rollers 6 are rotatably supported by a frame (not shown) inside the transfer belt unit. The transfer rollers 6 serve to transfer the toner images formed on the photoconductive drums 3 onto sheets on the transfer belt 7. These sheets are adhered to the transfer belt 7 to be carried.

The transfer belt 7 are in contact with the respective photoconductive drums 3, and serves to sequentially transfer the toner images of plural colors formed on the respective photoconductive drums 3 onto a sheet so that the images of plural colors are overlaid with each other on the sheet. As a result, a color toner image (toner image of multiple colors) is formed. The transfer belt 7 formed as an endless belt is made of a film with a thickness of approximately 100 μm.

The toner images formed on the photoconductive drums 3 are transferred to the sheets by the transfer rollers 6 that are in contact with the rear surface of the transfer belt 7. To enable this transfer, the transfer rollers 6 are each supplied with a high voltage (a high voltage opposite in polarity (+) to the voltage (−) for charging the toners). Each transfer roller 6 is made of a metal (such as a stainless) axis with a diameter of 8 mm–10 mm, covered by an elastic conductive material (for example, FPDM, foam urethane etc.), that allows even application of a high voltage to the sheet. Note that, though the present embodiment uses the transfer rollers 6 as transfer electrodes, the present invention is not limited to this arrangement, and the transfer electrodes may be brushes etc. instead.

As described, the respective members of the transfer carriage belt unit 8 function as means for transferring the toner images from the photoconductive drums 3 to the sheets. However, the transferring means does not necessarily have to be in the form of the transfer carriage belt unit 8. In cases where the transfer means has a structure other than a belt, the region of the transfer belt 7 shown in FIG. 3 may be considered an extent elevation of the photoconductive drums 3.

The toner adhered to the transfer belt 7 via the photoconductive drums 3 may stain the rear surface of the sheets. To prevent this defect, a transfer belt cleaning unit 9 is provided to remove/collect toner adhered to the transfer belt 7. The transfer belt cleaning unit 9 includes a cleaning blade or the like that is placed in contact with the transfer belt 7. The transfer belt 7 is supported by a transfer belt supporting roller 74 from the rear surface.

The paper feeding tray 19 is provided below the image forming section 100. The paper feeding tray 19 is provided for storing the sheets used for image forming. Further, the discharge tray 15 is provided above the image forming section 100. The discharge tray 15 places printed sheets facing down. Further, the discharge tray 33 is provided on a lateral portion of the image forming section 100. The discharge tray 33 places printed sheets facing up.

Further, the image forming section further includes a paper carrying path S formed in a S-shape. The paper carrying path S carries the sheets from the paper feeding tray 19 to the discharge tray 15 via the sheet transfer carriage unit 8 or the fixing unit 12. Further, in the vicinity of the paper carrying path S that extends from the paper feeding tray 19 to the discharge tray 15 and the discharge tray 33, there are provided such as a pickup roller 16, the resist roller 14, the fixing unit 12, a carriage direction switching gate 34, and carriage rollers 25 for carrying the sheets.

The carriage rollers 25 are small rollers for prompting/supporting the carriage of sheets. A plurality of carriage rollers 25 are provided along the paper carrying path S. The pickup roller 16 is provided on an end portion of the paper feeding tray 19. The pickup roller 16 is a leading roller for supplying the sheets one by one from the paper feeding tray 19 into the paper carrying path S.

The carriage direction switching gate 34 is rotatably provided on a side cover 35. The carriage direction switching gate 34 moves from the position denoted by the solid line in FIG. 1 to the position denoted by the broken line, so as to separate the sheet from the carriage path S on the halfway to discharge the sheet to the discharge tray 33. When carriage direction switching gate 34 is in the position denoted by the solid line, the sheet is sent to a carriage section S' (a part of the paper carrying path S) provided between the fixing unit 12 and the side cover 35 so as to be discharged to the discharge tray 15 above the image forming section.

Further, the resist roller 14 temporarily holds the sheet carried by the paper carrying path S and releases the sheet at a timing corresponding to the rotation of the photoconductive drums 3 so that the plural toner images of multiple colors on the photoconductive drums 3 are successfully overlaid on the sheet.

More specifically, the resist roller 14 controls a resist clutch (see FIG. 2) at a predetermined timing according to a detection signal outputted from a resist sensor (not shown), so as to carry the sheet at a right timing for meeting the front end of the printing range of the sheet and the front end of the toner images on the respective photoconductive drums 3.

The fixing unit 12 includes a heat roller 31, a pressure roller 32 etc., which are rotated with the sheet held inbetween.

Further, the heat roller 31 is specified in temperature by controlling means based on a temperature detected by a temperature detector (not shown) so as to carry out fixing with a constant temperature. The heat roller 31 performs thermal-pressing of the sheet, together with the pressure roller 32, so as to fuse, mix, press the toner images of plural colors transferred on the sheet so that the toner images are thermally fixed to the sheet.

Note that, when the discharge destination of the sheet is set to the discharge tray 15, the sheet with the fixed multiple-color image is carried to an inversion discharge path of the paper carrying path S by the carriage rollers 25, and is discharged to the discharge tray 15 in an inversion state (with the multiple-color toner image facing down).

The image processing substrate 300 is a circuit substrate for carrying out predetermined processings with respect to image data. The control circuit substrate 400, contained in the controlling means (described later), is a circuit substrate for controlling image forming processings.

Next, the following will explain the paper feeding desk unit 20. The paper feeding desk unit 20 is provided below the paper feeding tray 19. The paper feeding desk unit 20 includes a three-stage paper feeding trays 20*a* through 20*c*, and supplies the papers from these trays to the image forming section 100 via the paper carrying path S. Note that, the multi-functional device 1 of the present embodiment is not limited to this arrangement with the paper feeding desk unit 20 but may be provided with a single-stage paper feeding tray, one having a tandem tray with two parallel trays, or one with a simple desk function, according to user's request.

The present embodiment describes the image forming section 100 as a multiple-color image forming device that enables image forming with plural colors. However, the present invention may be adopted for an image forming device performing monochrome image forming with omission of some of the functions. Further, the multi-functional device 1 of the present embodiment includes an automatic document carrying device 210; however, the present invention allows omission of the automatic document carrying device 210.

Further, the multi-functional device 1 includes means for controlling its operation. The controlling means adjusts control conditions of the image forming section 100, for example.

Figure 2:
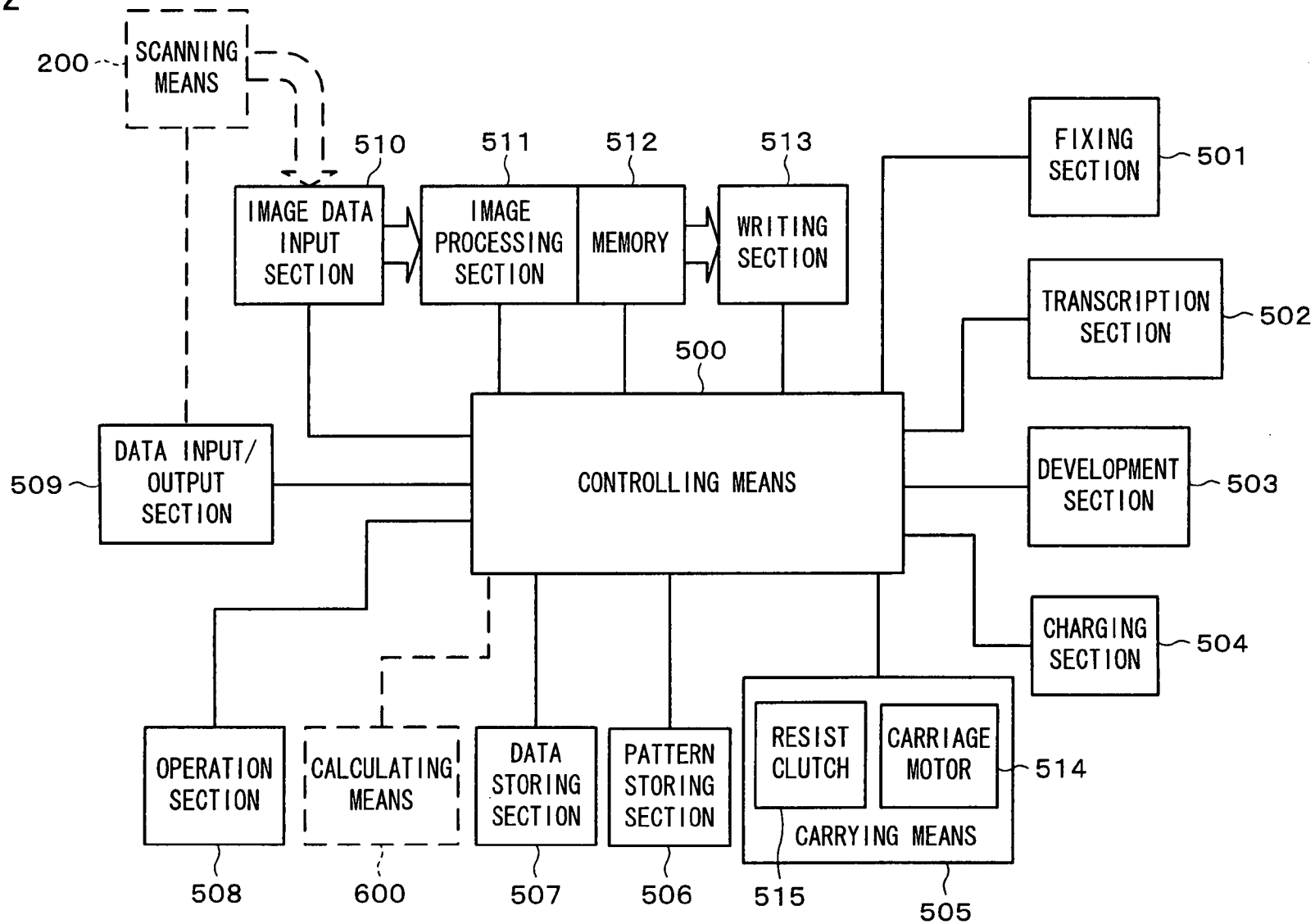
FIG. 2 is a block diagram showing an arrangement for adjusting a control condition of the image forming device according to the embodiment of the present invention.

As shown in FIG. 2, the controlling means 500 is connected to a fixing section 501, transcription section 502, a development section 503, a charging section 504, carrying means 505, a pattern storing section 506, a data storing section 507, an operation section (operating means) 508, a data input/output section 509, an image data input section (data inputting means) 510, an image processing section 511, a memory 512, and a writing section (writing means) 513, so as to control these sections. The carrying means 505 includes a carriage motor 514 and a resist clutch 515.

The following describes how to control the image forming in the multi-functional device 1. The fixing section 501, the transcription section 502, the development section 503, the charging section 504, the writing section (writing means) 513 are respectively made up of the fixing unit 12, the transfer rollers 6*a* through 6*d*, developing devices 2*a* through 2*d*, charging devices 5*a* through 5*d*, exposure units 10*a* through 10*d*, as well as the peripheral units of these sections. Through these sections, an image is formed on a sheet.

The controlling means 500 controls the charging section 504 by adjusting a grid bias voltage of the charger (charging devices 5*a* through 5*d*), so as to control the surface potential of the photoconductive drums 3*a* through 3*d*.

The controlling means 500 also controls writing operation of the writing section 513 by adjusting such as optical beam power and/or the writing timing. Further, in cases where the writing section 513 (exposure unit 10) is an EL or a LED writing head, the controlling means adjust the optical power and/or the writing timing thereof.

The controlling means 500 controls the development section 503 by adjusting a bias voltage of the developing rollers of the developing devices 2*a* through 2*d*, so as to carry out proper development. The controlling means 500 controls the transcription section 502 by adjusting a voltage applied to the transfer rollers 6*a* through 6*d* from a high voltage transfer power source (not shown).

The controlling means 500 further controls the heat roller 31 of the fixing section 501 (fixing unit 12) based on a temperature detected by the temperature detector (not shown) so as to carry out fixing operation with a predetermined temperature. The controlling means 500 controls the carrying means 505 by controlling the carriage monitor 514 and the resist clutch 515.

Further, in the multifunctional device 1, the controlling means carries out the following operation so as to adjust image forming. The controlling means 500 causes the pattern storing section 506 to store predetermined image data pattern. The controlling means 500 causes the data storing section 507 to store a reference value.

The multi-functional device 1 is further provided with the data input/output section 509 for inputting data written by a device outside the multi-functional device 1, such as an external scanning means, or for outputting data scanned by the built-in scanning means 200 to an external device. The controlling means 500 operates as adjustment sheet creating means, correction value obtaining means, and image forming condition correcting means.

Scanning operation of the multi-functional device 1 is controlled as follows. The scanning means 200 operates together with the automatic document carrying device 210 as explained above with reference to FIG. 1, so as to scan the image of the document automatically carried by the automatic document carrying device 210. Then, the scanning means 200 transfers the scanned data to the image data input section 510 shown in FIG. 2.

The controlling means 500 causes the image data input section 510 to input the image data scanned by the scanning means 200 into the image processing section 511 of the image forming section 100. The controlling means 500 causes the image processing section 511 to carry out predetermined image processing with respect to the image data inputted by the image data input section 510. In this manner, the image data transferred to the image data input section 510 is subjected to predetermined image processing by the image processing section 511.

The controlling means 500 causes the memory 512 to temporarily store the image data processed by the image processing section 511. The controlling means 500 also controls the writing section 513 by adjusting optical beam power of either of an EL, a LED writing head, or a laser irradiation section of the exposure units 10*a* through 10*d*. Through this operation, the processed image data is temporarily stored in the memory 512, and is read out in response to output instruction. The read out image data is transferred to the writing section 513.

Further, the controlling means 500 of the present embodiment is connected to the calculating means 600. The calculating means 600 figures out a correction value, that is used for correcting image forming condition with respect to the sheet according to the data scanned by the scanning means 200. The operation of this calculating means will be described later.

Further, the multi-functional device 1 includes a control panel as a user interface on a portion of the same height as the scanning means 200.

Figure 8:
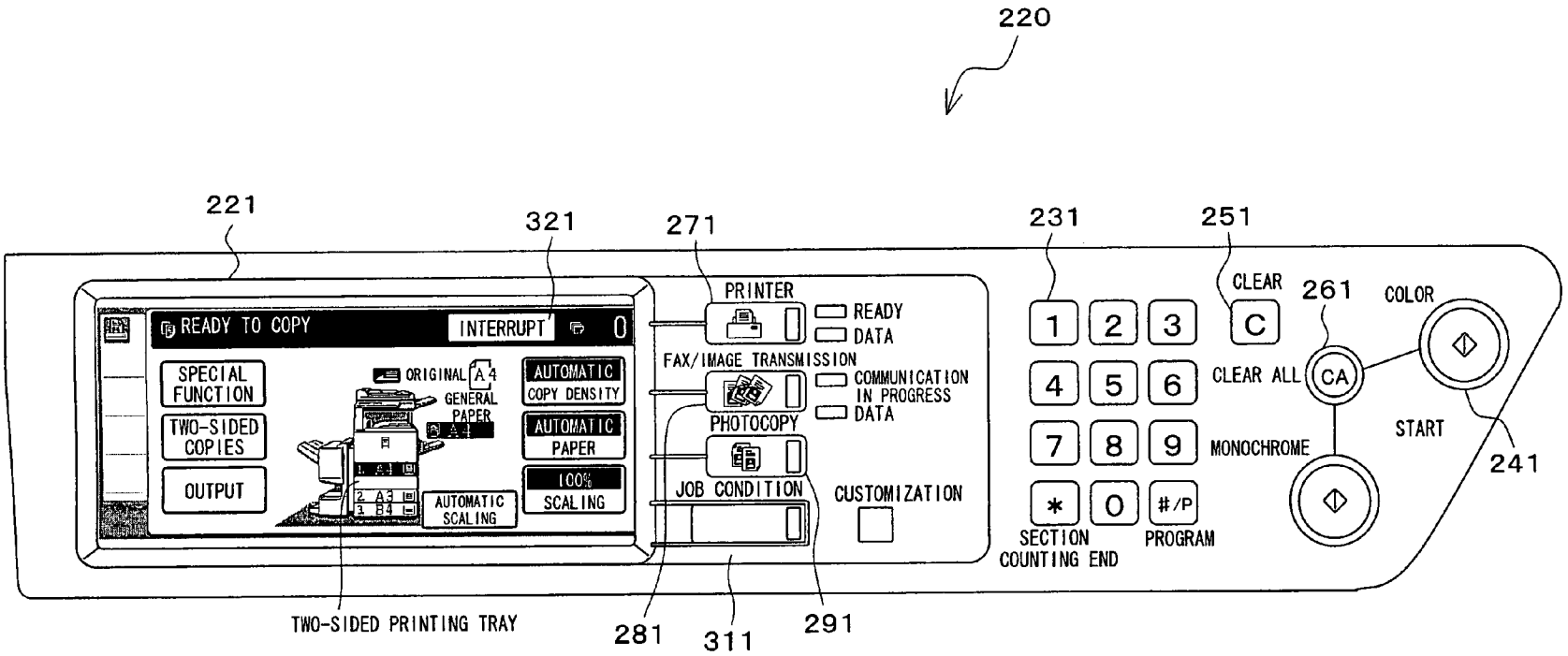
FIG. 8 shows an operation panel according to one embodiment of the present invention.

As shown in FIG. 8, the control panel 220 includes a touch panel liquid crystal display device (hereinafter referred to as a LCD) 221 on the left half, and also includes numeric keys 231, a start key 241, a clear key 251, and a clear all key 261 on the right half.

The panel of the LCD 221 displays various screens that are changed by switching operation. Each of these screens includes a touch key that allows users to set various conditions (for example, selection of monochrome mode/color mode, selection of types of document, selection of automatic operation/manual operation, or selection of other special functions etc.) by directly pressing the touch key with fingers. Further, the LCD 221 also displays operation guidance and warnings. In the case of providing a selection key for adding extra images (such as an advertisement) etc. in the image forming device, it may be provided as a touch key in the LCD 221, or may be provided as a hard key as with the numeric keys on the control panel 220. In this example, it is more preferable that the selection key is provided as a touch key on the LCD 221. With this arrangement, the function for adding extra images may be provided to the image forming section 100 in the form of software, thus allowing common use of the image forming section 100.

Further, between the LCD 221 and the numeric keys 231, there are provided a printer key 271, a facsimile/image transmission key 281, a copy key 291, and a job key 311. These keys are used for switching the respective functions of the multi-functional device 1 that includes the image forming section 100. The job key 311 is used for confirming the job condition of the respective functions.

Among the group of keys provided on the right half of the LCD 221, the numeric keys 231 are used for inputting values (such as number of copies) to the screen of the LCD 221. Further, the start key 241 is used for instructing start of image forming operation or scanning operation in the respective processing modes. The clear key 251 is used for canceling values inputted to the LCD 221, or for cutting off the current operation of image forming etc. The clear all key 261 is used for canceling the current settings of scanning or image forming, and returning all the settings to the default values. The interruption key 321 is used for temporally cutting off the current operation of image forming etc. so as to allow enforcement of other image forming operation.

Note that, FIG. 8 shows the case where a color image forming mode is selected. Here, the density of image forming or scanning, such as the color density of photocopying, is automatically controlled according to the document.

When the multi-functional device 1 detects instruction for starting image forming operation or scanning operation inputted to the control panel 220, the controlling means 500 causes the writing section 513 and the carrying means 505 of the image forming section 100 to be in operation.

The following minutely describes modification of the image forming condition in the multi-functional device 1.

The maximum sheet size accepted in the multi-functional device 1 is a A3 sheet (297 mm×420 mm). Accordingly, the correction value for adjusting the image forming condition can be found with the use of a A4 sheet (210 mm×297 mm), a B5 sheet (182 mm×257 mm) or a B4 sheet (257 mm×364 mm). However, it is preferable that the adjustment of the image forming condition is performed by using a sheet smaller than the maximum size accepted in the image forming section 100. If the adjustment is performed with a sheet larger than the maximum size, the image formed on the sheet automatically becomes larger, thereby increasing developer (toner) consumption and time taken to adjust the image forming section 100.

When the adjustment of image forming condition is started, firstly, an image is formed on at least three corners of the sheet based on predetermined image data stored in the pattern storing section 506.

In the present embodiment, an image is formed on at least three corners of the sheet so that the image extends outside the sheet. The process will be described later in detail. Note that, the "corners" of the sheet above correspond to peaks of the sheet, more specifically, they refer to areas containing intersections of respective sides of the sheet. The sizes and the shapes of those areas are not particularly restricted as long as they contain the intersections.

Figure 3:
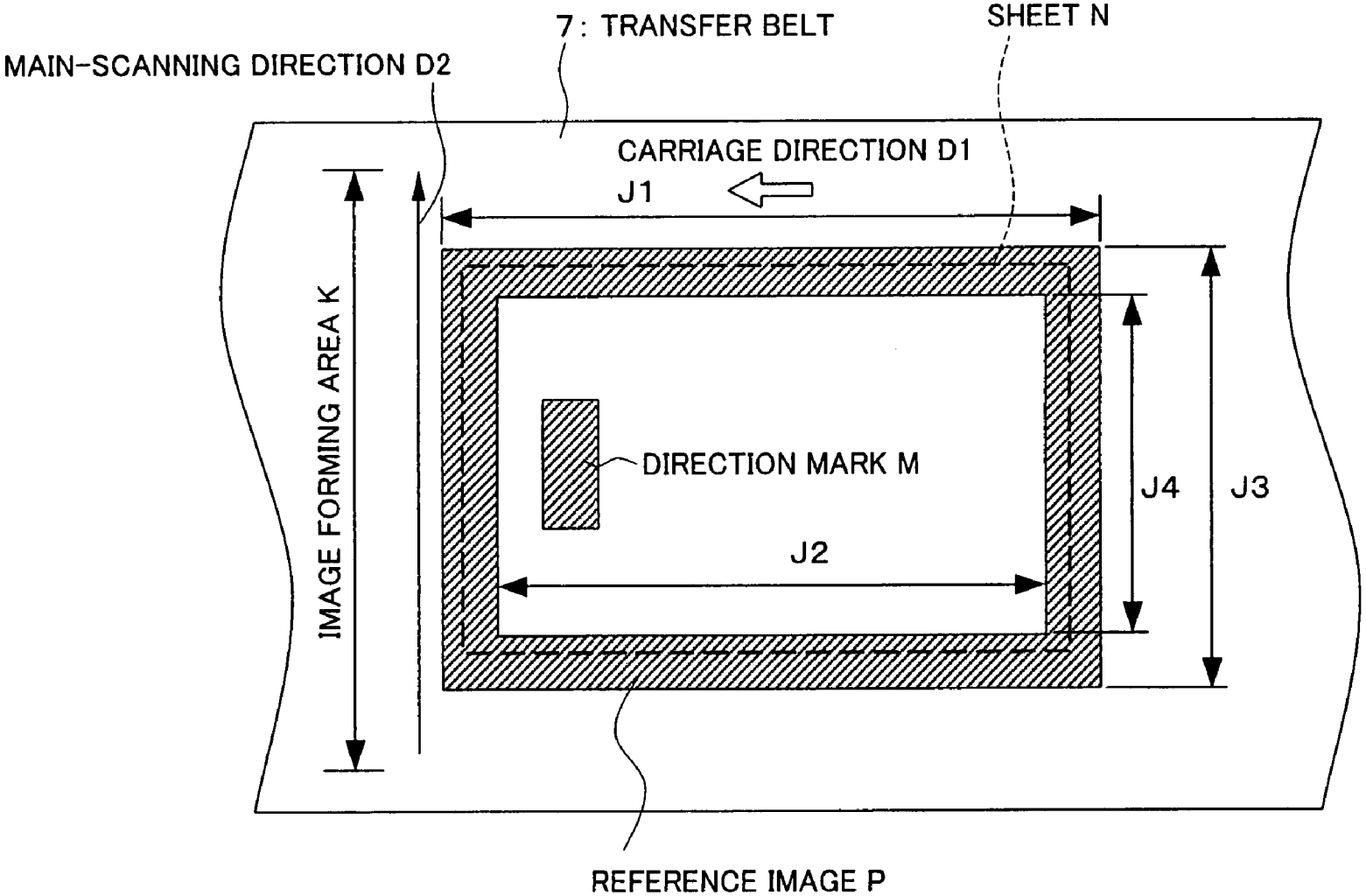
FIG. 3 shows a frame image according to one embodiment of the present invention.

Here, assuming that the writing area (image forming area K) of the image forming section 100 shown in FIG. 3 is identical to the longer length side of a A4 sheet. In this case, the image extending outside the sheet can be formed by using a B5 sheet.

However, in the case of the present embodiment in which the adjustment of the image forming section 100 is performed by using a A4 sheet, the longer length side of the sheet and the image forming area K become substantially equal when the sheet is horizontally supplied, more specifically, when the longer length side of the sheet is placed perpendicularly to the sub-scanning direction (sheet carriage direction) of the image forming section 100. Under this condition, the image extending outside the corners of the sheet cannot be formed.

In this view, in the present embodiment, the sheet is vertically supplied, more specifically, the longer length side of the sheet is placed along the sub-scanning direction of the image forming section 100. On this account, the image extending outside the corners of the sheet can be formed.

In the present embodiment, it is assumed that the pattern storing section 506 stores a frame pattern (having a unified function of the first image and the second image; hereinafter referred to as a frame image). FIG. 3 shows a reference image P as an example of this frame image. Further, in the present embodiment, in the case of using a A4 sheet as shown in FIG. 3, the pattern storing section 506 stores a frame image formed in a structure such that an outline width (the distance between two outline ends in the main-scanning direction D2) J3 is set to 230 mm, an outline width J1 (the distance between two outline ends of the frame image in the sub-scanning direction) is set to 317 mm, an internal interval J4 (the distance between two internal ends of the frame image in the main-scanning direction D2) is set to 180 mm, and the internal interval J2 (the distance between two internal ends of the frame image in the sub-scanning direction) of the frame image in the sub-scanning direction is set to 267 mm.

Further, in the frame image, the internal frame is included in the sheet N, and the outline frame extends outside the corners of the sheet (in FIG. 3, the sheet N is denoted by a broken line, and the frame image is denoted by diagonal lines). With such a structure, an image is formed over the whole circumference of the sheet N. Note that, as shown in FIG. 3, the frame image has a size to be included within the image forming area K of the transfer belt 7.

Note that, the pattern storing section 506 may store one frame image, or may store a plurality of frame images corresponding to a plurality of sheet sizes.

Further, in the present embodiment, the pattern storing section stores a rectangle direction mark M that denotes the direction of the image. The direction mark M is formed inside the frame image. With this arrangement, it is possible to properly set a sheet with the frame image on the scanning means 200 since the direction of the image can be clearly sheen.

Note that, the direction mark may be formed as an arrow shape in terms of visuality, which however requires a larger data memory in the pattern storing section 506. Further, when the scanning means 200 scans the image on the sheet, the mark of an arrow shape makes the judgment of scanning result more complex. For this reason, it is more preferable to use a simple rectangle pattern, as with the one of the present embodiment.

Further, instead of providing the direction mark M, the device may have a function for automatically detecting the direction of the sheet set on the scanning means 200. Further, in an assumable case, the sheet may for some reason greatly inclined on the original platen 209. In view of this problem, the device may be arranged so that an allowable inclination range is decided in advance, so as to display error message in a control panel 220 of the operation section 508 when the inclination found through scanning operation falls outside the predetermined allowable range, so that the scanning operation is carried out again.

The data storing section 507 stores reference values. The data storing section 507 of the present embodiment stores vertical and horizontal lengths of a A4 sheet. Therefore, the correction value is found according to the reference values for a A4 sheet.

Figure 7:
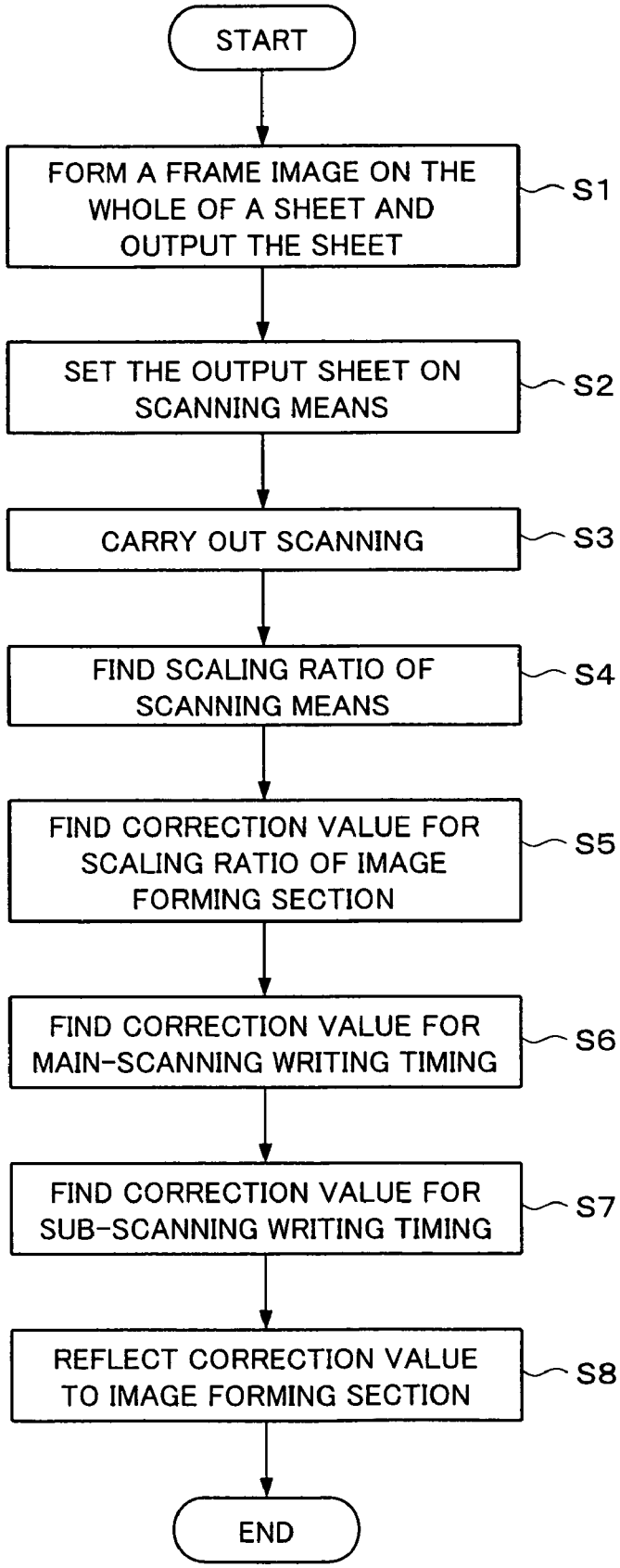
FIG. 7 is a flowchart showing a specific procedure for adjusting an image forming condition of an image forming device according to one embodiment of the present invention.

Next, with reference to FIG. 7, the following specifically describes an operation flow for adjusting image forming condition of the image forming device 100 of the multi-functional device 1.

Firstly, the image forming section 100 forms a frame image, and transfers the image onto a sheet, and then outputs the sheet (S1: adjustment sheet creating step).

Here, FIG. 3 shows the reference image P as an example of the frame image formed on the photoconductive drum 3 of the image forming section 100, that is then transferred to the sheet N and the transfer belt 7. Further, when discharged to the discharge tray 33 via the fixing unit 12 etc., the sheet has an image formed over the whole circumference, as with the sheet Q0 shown in FIG. 4. The length L3 of the sheet Q0 in FIG. 4 corresponds to the internal interval J2 of the frame image shown in FIG. 3. Further, the length W3 of the sheet Q0 in FIG. 4 corresponds to the internal interval J4 of the frame image shown in FIG. 3.

Next, the setting of the outputted sheet to the scanning means 200 is detected with an instruction by the user or by a document detecting means (not shown) of the scanning means 200 (S2). With this detection, the scanning means becomes ready for scanning operation. Then, in response to a start signal that is generated when the user presses the start key 241, the scanning means 200 scans the frame image formed on the sheet (S3).

Figure 5:
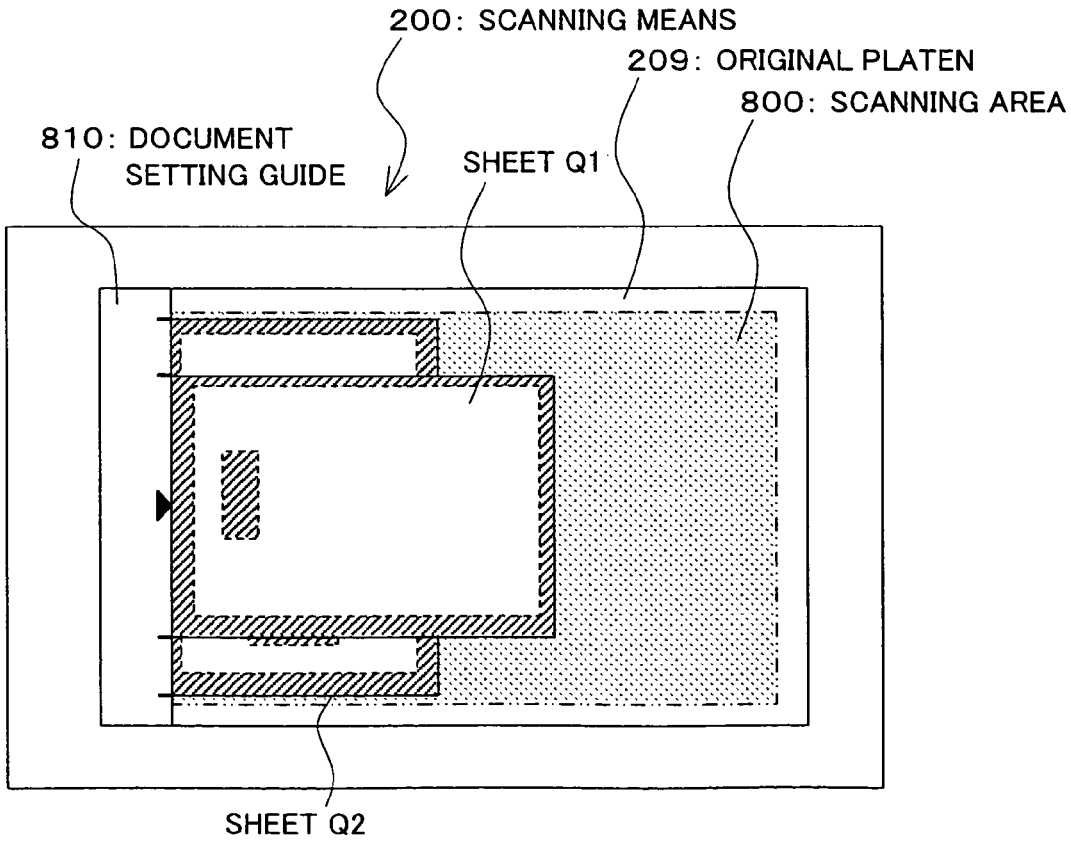
FIG. 5 shows an arrangement, according to one embodiment of the present invention, in which the sheet is brought into contact with a document setting guide.

Here, as shown in FIG. 5, the proper setting of the sheet can be ensured by placing the sheet Q1 to be in contact with the document setting guide (document reference member) 810 of the scanning means 200. Further, the document setting guide 810 may have a mark (reference mark; not shown) that denotes the size and position of the sheet. Provision of the mark further ensures the proper setting of the sheet.

Figure 6:
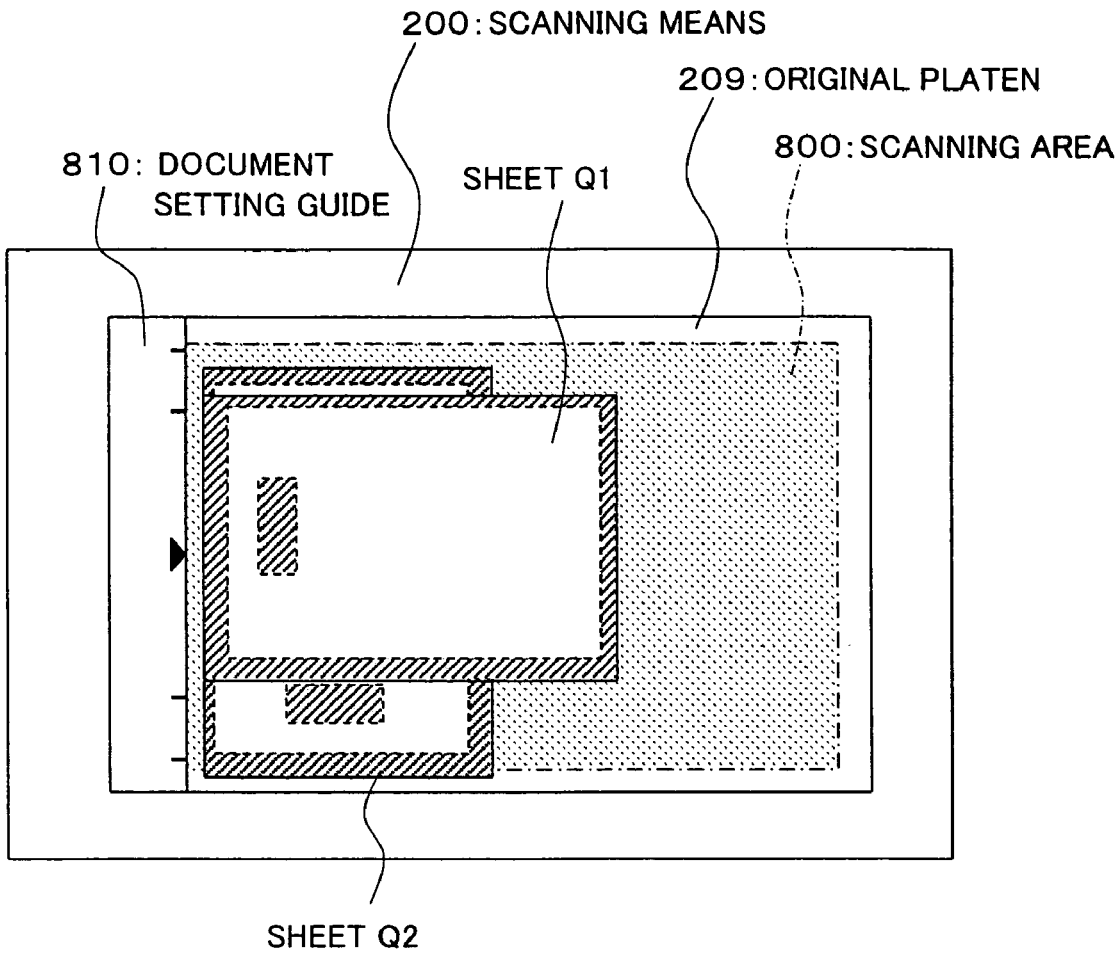
FIG. 6 shows an arrangement, according to one embodiment of the present invention, in which the sheet is placed with a gap provided between the document setting guide and an end portion of the sheet.

However, depending on the material of the document setting guide (document reference member) 810, the differentiation of the document setting guide 810 and the edge of the sheet is not clear, and there will be some difficulties of scanning of the image formed on the edges of the sheet, thereby decreasing scanning accuracy. In view of this problem, as shown in FIG. 6, the sheet is placed on the original platen 209 with a gap between the document setting guide 810 and the edge of the sheet Q1. With this arrangement, the image formed on the edges of the sheet can be securely and accurately scanned.

When the sheet is placed on the scanning area 800 of the scanning means 200 with the longer length side in parallel with the main-scanning direction of the scanning means 200, as with the sheet Q2 shown in FIGS. 5 and 6, a larger area of the scanning means 200 is used in scanning, thus requiring extra scanning sensors (not shown). This induces an increase of cost for the scanning means 200. Further, if the sheet is not properly placed in the scanning area 800, the scanning means 200 cannot accurately scan the sheet.

In contrast, as with the sheet Q1 shown in FIGS. 5 and 6, the sheet is placed on the scanning area 800 of the scanning means 200 with the longer length side in parallel with the sub-scanning direction. In this state, the required area of the scanning means 200 can be minimized, thus decreasing the cost for the scanning means 200. Further, since the sheet can be placed within the scanning area 800 even with some extra spaces, the scanning means 200 can accurately scan the sheet.

Figure 4:
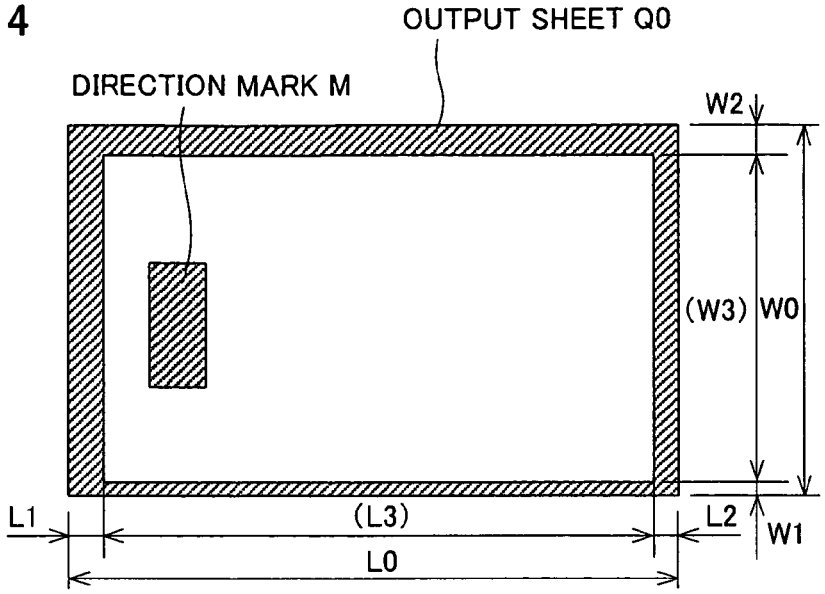
FIG. 4 shows a frame image, according to one embodiment of the present invention, which is formed on a sheet.

Here, as described, in the step S3, the scanning means 200 scans the frame image, such as the ones shown in FIG. 4, of the sheet. With this operation, the respective sheet sizes are found.

In the present embodiment, the lengths W0 and L0 of the sheet Q0 shown in FIG. 4 are scanned to find out the sheet size. Then, as shown in FIG. 4, the scanning is also performed to find the distance (W3 and L3 of FIG. 4) between the front frame and the rear frame for the main-scanning direction and the sub-scanning direction.

Then, the scanning is further performed on the front portion and the rear portion of the frame image in a direction in parallel with the sheet carriage direction (i.e., the width of the front portion and the rear portion of the frame image in a direction in parallel with the sheet carriage direction)(L1 and L2 in FIG. 4); and on the front portion and the rear portion of the frame image in a direction orthogonal to the sheet carriage direction (i.e., the width of the front portion and the rear portion of the frame image in a direction orthogonal to the sheet carriage direction)(W1 and W2 in FIG. 4). These values are calculated by the calculating means 600 based on the image data, that is supplied from the scanning means 200 to the image data input section 510, and further transferred from the image data input section 510 to the calculating means by the controlling means 500.

In the present embodiment, the data storing section 507 stores the length of longer length side of a A4 sheet, and the length of the side orthogonal to the longer length side (i.e., the vertical length (210 mm) and the horizontal length (297 mm) of the A4 sheet).

In the step S4, the data stored in the data storing section 507 is compared with a predetermined size obtained through scanning of the scanning means 200, and the calculating means 600 finds a scaling correction value of the scanning means 200.

Firstly, the scanned image is inputted to the image data input section 510. Then, the calculating means 600 compares the scanned value of W0 with the stored length of 210 mm in the direction orthogonal to the longer length side of the A4 sheet in the data storing section 507. If this comparison reveals that the W0 is not identical with 210 mm, meaning that the scaling ratio of the scanning means 200 has not been adjusted, the calculation is carried out to find the scaling ratio of the scanning means 200 in the main-scanning direction. The calculating means 600 further compares the scanned value of L0 with the stored length of 297 mm of the longer length side of the A4 sheet in the data storing section 507, so as to find the scaling ratio of the scanning means 200 in the sub-scanning direction.

In the step S5, a correction value for modifying the scaling of the image forming section 100 is found. Firstly, with reference to the scaling correction value of the scanning means 200 in the main-scanning direction, that has been found in the step S4, the image forming section 100 finds a correct size of the length of W3 (see FIG. 4) when the image is actually printed on the sheet. Then, the calculating means 600 compares the size thus found with the size of the pattern stored in the pattern storing section 506, so as to figure out a correction value (scaling correction value) for modifying the scaling of the image forming section 100 in the main-scanning direction. Then, with reference to the scaling correction value of the scanning means 200 in the sub-scanning direction, that has been found in the step S4, the image forming section 100 finds a correct size of the length of L3 (see FIG. 4) when the image is actually printed on the sheet. The calculating means 600 compares the size thus found with the size of the pattern stored in the pattern storing section 506, so as to figure out a correction value (scaling correction value) for modifying the scaling of the image forming section 100 in the sub-scanning direction.

In the next steps S6 and S7, the calculating means 600 finds a correction value for modifying the writing timing of the writing section 513 for carrying out writing of an electrostatic latent image. Note that, this process for finding the correction value does not necessarily have to be carried out in order of (1) S6, (2) S7, but may be carried out in order of (1) S7, (2) S6.

In the step S6, the calculating means 600*a* finds a correction value for the writing timing in the main-scanning direction by finding a width of the front portion of the frame image (W2 of FIG. 4) in the main-scanning direction based on the scaling correction value for the main-scanning direction obtained in the step S5. More specifically, for example, the value of W2 after modification of scanning scaling of the scanning means 200 and modification of the scaling of the image forming device 100 is first found, and then the found value is compared with the value of the pattern stored in the pattern storing means 506. In this manner, the correction value for writing timing of the writing section 513 can be found.

Further, by scanning the value of W2 (see FIG. 4) on at least two points in the main-scanning direction, inclination of the image with respect to the sheet can be found. This calculation for finding a value for correcting the inclination of the image is also performed by the calculating means 600.

In the step S7, the calculating means 600*a* finds a correction value for the writing timing in the sub-scanning direction by finding out the front portion of the frame image (L1 of FIG. 4) in the sub-scanning direction based on the scaling correction value for the sub-scanning direction obtained in the step S5. More specifically, for example, the value of L1 after modification of scanning scaling of the scanning means 200 and modification of the scaling of the image forming device 100 is found, and then the found value is compared with the value of the pattern stored in the pattern storing means 506. In this manner, the correction value for writing timing of the writing section 513 can be found.

Further, by scanning the value of L1 (see FIG. 4) on at least two points in the sub-scanning direction, inclination of the image with respect to the sheet can be found. This calculation for finding a value for correcting the inclination of the image is also performed by the calculating means 600.

In the step S8, the controlling means 500 reflects the obtained correction value for the writing timing to the image forming section 100 of the multi-functional device 1.

The writing timing in the main-scanning direction is adjusted as follows. In cases where the image forming section 100 adopts a laser beam scanning mode as the writing section 513 (exposure unit 10), the writing start point of the main-scanning direction is adjusted by the controlling means 500 by controlling the writing starting timing after the light passes through the beam detector. Meanwhile, in cases where the image forming section 100 adopts a solid-body scanning mode with an LED head or the like, as the writing section 513 (exposure unit 10), the writing timing of the main-scanning direction may be corrected by changing the first emitting element for starting lighting in the main-scanning direction. Note that, in this case, the scaling of the main-scanning direction is substantially determined, and therefore it does not necessarily have to be adjusted. However, if the error is significant, the number of lit emitting elements is decreased/increased by thinning-out/adding some of image data.

The writing timing in the sub-scanning direction is adjusted as follows. In this case, the controlling means 500 modifies the writing start point in the sub-scanning direction by adjusting the writing timing of the writing section 513 by using the writing timing correction value in the sub-scanning direction, that is found in the step S7. Note that, the writing start point in the sub-scanning direction may also be modified by adjusting connecting timing of the resist clutch 515 of the carrying means 505 shown in FIG. 2.

Further, the scaling with respect to the sub-scanning direction is modified by adjusting the speed of carriage motor 514 of the carrying means 505 so as to adjust carriage speed of the sheet. Further, the carriage speed of the sheet may also be adjusted by rotating the transcription roller 6 of the transcription section 502 at a predetermined speed; or otherwise by adjusting rotation speed of the photoconductive drum 3. However, the method of adjusting the carriage speed of the carriage motor 514 is most preferable since it does not require changes in processing condition of image forming.

In this manner, the correction value is reflected to the image forming section 100 in the step S8, and the operation is completed.

The explanation of FIG. 7 above does not mention individual adjustment for each image forming station for ease of explanation; however, in practice, the multi-functional device 1 separately adjusts the respective image forming stations as follows.

In the multi-functional device 1 of the present embodiment that includes a plurality of image forming stations so as to form images with a plurality of color materials in the image forming section 100, resist correction data is stored in the data storing section 507 shown in FIG. 2. With this arrangement, an image is formed with one of the color materials so as to find the correction value for the image forming station corresponding to the color material. The correction values for the image forming stations of the remaining colors may be found according to the obtained correction values and resist correction data. In this manner, the adjustment for the respective image forming stations can be carried out using only one of the colors, thereby economically carrying out adjustment of image forming condition with respect to the sheet.

Further, the adjustment for the plurality of image forming stations may also be separately performed. More specifically, one of the image forming stations is adjusted in image forming position and scaling with respect to both the main-scanning direction and the sub-scanning direction, and the remaining image forming stations are adjusted in scaling with respect to the main-scanning direction. In this manner, the adjustment of image forming condition with respect to the sheet can be more accurately carried out.

Further, in the color scanning means 200 of the present embodiment having photoelectric transfer elements of three primary colors, it is preferable that the color scanning means scans the image formed on the sheet by using one of the photoelectric transfer elements of the three primary colors. With this arrangement, the scanning operation becomes easier and the number of scanned data is reduced, thereby decreasing calculation time of the scanned data.

Further, it is preferable that the scanning means 200 uses a photoelectric conversion element of a complementary color of the color material used for the image forming with respect to the sheet. Specifically, if the scanning means uses photoelectric conversion elements of B, G and R, the image forming on the sheet is carried out with Y, M and C, respectively. This arrangement allows the scanning means 200 to perform scanning with high clearness, thereby obtaining more accurate data through scanning.

Further, enforcement of the image forming system made up of an image forming device and an image scanning device is not limited to the multi-functional device 1. For example, the image forming system may include an image forming section 100*a* and a scanner (scanning means) 200*a*, as with the example shown in FIG. 9. The image forming device 100*a* has the same function as that of the image forming section 100. The scanning means 200*a* has the same function as that of the scanning means 200. The computer 600*a* has the same function as that of the calculating means 600. As with this example, the scanning means 200*a* as the scanning means and the computer 600*a* (such as a personal computer) as the calculating means etc. may be provided outside the image forming device 100*a*. Note that, when an image is scanned by the scanning means 200*a* and printed through the image forming section 100*a* in this image forming system, the image data scanned by the scanning means 200*a* is inputted to the image data input section 510 operating as the data input means of the image forming device 100*a*.

Figure 9:
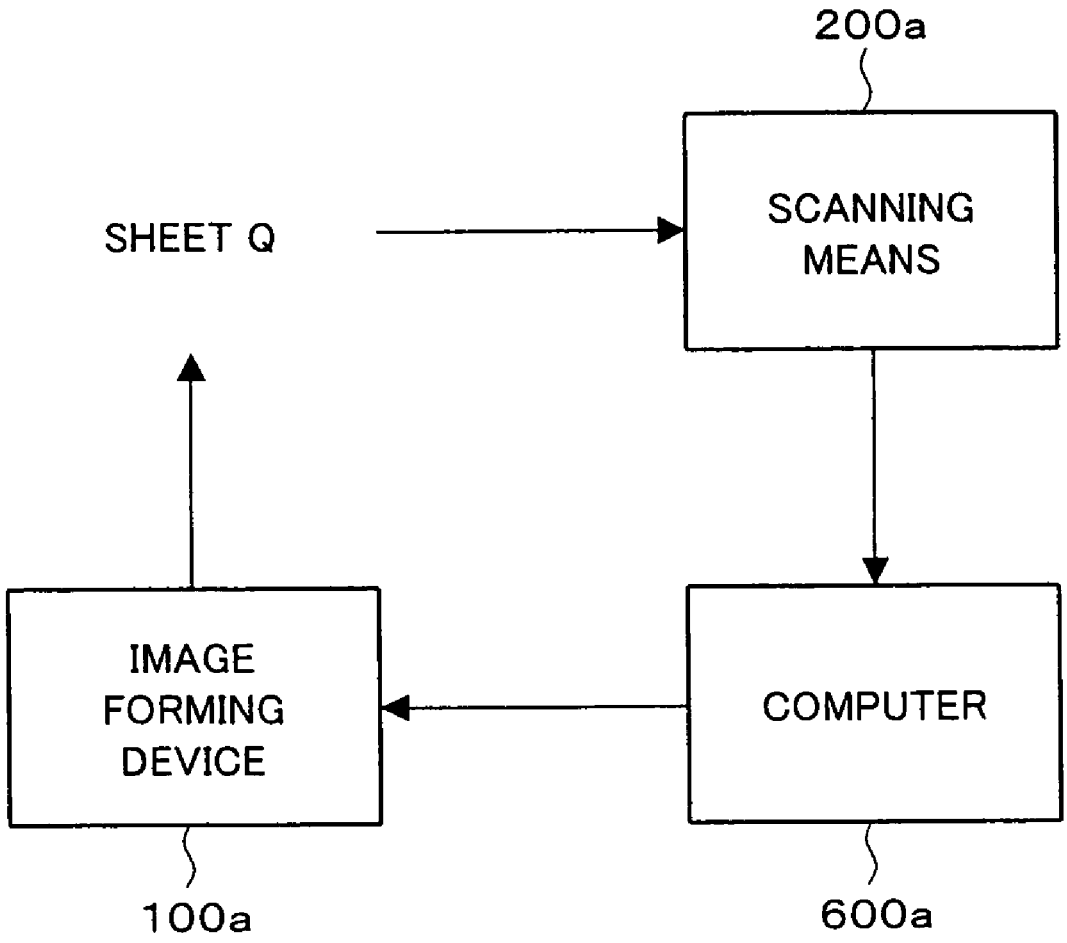
FIG. 9 shows an image forming device according to another embodiment of the present invention.

The image forming condition in this image forming system is adjusted in the following manner. Firstly, as shown in FIG. 9, an image is formed on a sheet in the image forming section 100*a* and outputted as the sheet Q. Next, the image formed on the sheet Q is scanned by the scanning means 200*a*. Further, the obtained image data is captured into the computer 600*a*.

Then, a previously-created program is installed in the computer 600*a*. This program is, for example, to find a correction value for adjusting image forming condition. Then, the pattern storing means 506 and the data storing section 507 of the image forming section 100*a* send data to the computer 600*a* so as to carry out calculation of the correction value. The program finds the correction value through analysis/calculation of the image inputted to the computer 600*a*, and displays the resulting correction value in the display screen (not shown) of the computer 600*a*. Further, the displayed correction value is inputted to the image forming section 100 through operating means (not shown) of the image forming section 100*a*, thus adjusting image forming condition with respect to the sheet.

Note that, in the structure shown in FIG. 9, the adjustment may be carried out in such a manner that the data scanned by the scanning means 200*a* is supplied to the image forming section 100*a*, and a calculating means (not shown) finds the correction value through calculation of the data, and then, the resulting correction value is reflected to a writing section (not shown) of the image forming section 100*a*. Otherwise, the calculation of the correction value is performed by a CPU (not shown) of the scanning means 200*a*, and the resulting correction value is transferred to the image forming section 100*a* as data information. The adjustment may be carried out in any one of these manners with a program to enforce the respective steps.

As described, in the present embodiment, an image is formed over at least three corners of a sheet, thereby securely scanning the corners of the sheet by the scanning means. Further, since the correction value for modifying image forming condition with respect to the sheet is found based on the scanned image data, it is possible to adjust the image forming device even when the scanning is performed by the scanning means not accurately adjusted.

Further, since the image to be formed on a sheet is stored as image data in the pattern storing section 506 of the image forming section 100, the adjustment may be carried out without preparing a reference chart, such as a test chart. Further, the first step for scanning the reference chart by an image scanning device can be omitted.

SECOND EMBODIMENT

Another embodiment of the present invention is described below with reference to FIGS. 10 through 18.

As shown in FIG. 1, the image forming system referred in the present embodiment is a multi-functional device in which an image forming section and an image scanning device are unified. For ease of explanation, materials having the equivalent functions as those shown in the drawings pertaining to the first embodiment above will be given the same reference symbols in the following description, and explanation thereof will be omitted if not particularly required. Further, the multi-functional device of the present embodiment is again referred to as a multi-functional device 1 for simplicity.

Figure 10:
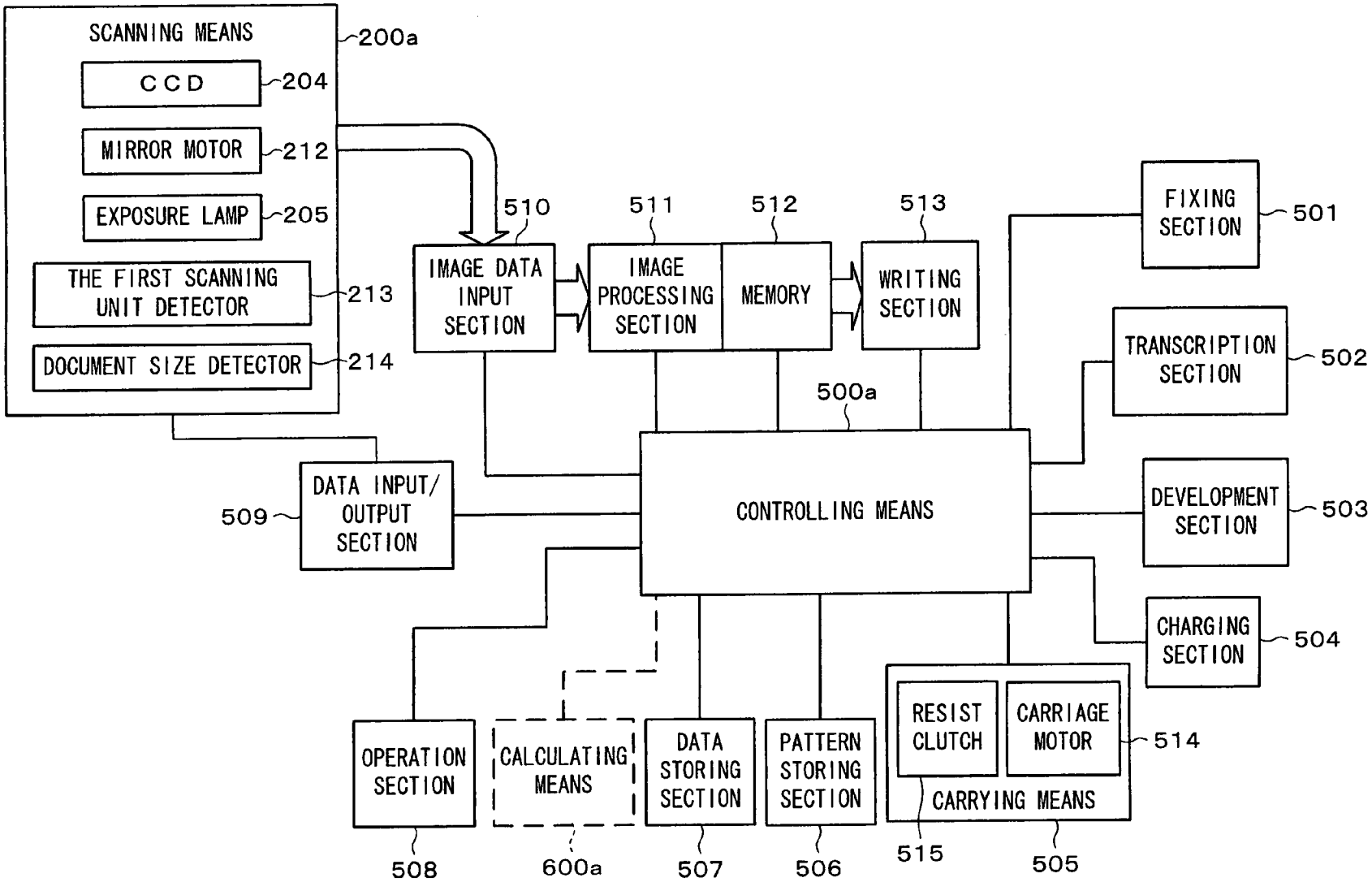
FIG. 10 is a block diagram showing an arrangement for adjusting a control condition of an image forming system according to still another embodiment of the present invention.

As shown in FIG. 10, the multi-functional device 1 of the present embodiment includes an image forming section (image forming device) 100 and scanning means (image scanning device) 200*a*. The multi-functional device 1 carries out adjustment of the scanning means 200*a* as well as adjustment of the image forming section 100. The adjustment of the image forming section 100 is carried out in the same manner as that of the first embodiment. In this embodiment, the controlling means 500 operates as the adjustment sheet creating means, the first and second correction value obtaining means, and the image forming condition correcting means.

Note that, here, it is assumed for simplicity that the scanning means 200*a* is properly adjusted for the scanning scaling in advance. This is because a general image forming device is mechanically adjusted for the scanning scaling of the main scanning direction by a jig or the like at the stage of assembling in the factory. Further, the scaling of the sub-scanning direction depends on movement speed of the first and second scanning units upon scanning, and those first and second scanning units are operated by a wire reeled off by a pulley or the like that is created with high accuracy. In this view, the scaling of the sub-scanning direction is also already adjusted upon assembling of the device.

As shown in FIG. 10, the multi-functional device 1 of the present embodiment is provided with scanning means 200*a*, controlling means 500*a*, and calculating means 600*a* that make the structure different from that of the multi-functional device 1 of the first embodiment shown in FIG. 2.

More specifically, in contrast to the first embodiment, the calculating means 600*a* calculates not only a correction value for image forming condition of the image forming section 100, but also a correction value for image scanning condition of the scanning means 200*a*, according to the frame image data scanned by the scanning means 200*a*. The controlling means 500*a* sets the correction value calculated by the calculating means 600*a* effective not only for the image forming section 100 but also for the scanning means 200*a*. The scanning means 200*a* may be adjusted with setting of scanning conditions by the controlling means 500*a* using the correction value calculated by the calculating means 600*a*.

In the multi-functional device 1 with such an arrangement, the controlling means 500*a* accesses to the pattern storing section 506 when the operation section 508 detects adjustment instruction by the user, so as to obtain the frame image data. The controlling means 500*a* causes the charging section 504 to evenly charge the photoconductive drum 3. Further, controlling means 500*a* temporarily stores the data into the memory 512, and gives output instruction to the writing section 513 and also transmits the frame image data to the writing section 513. Then, the writing section 513 forms a electrostatic latent image of the frame image on the photoconductive drum 3. The electrostatic latent image on the photoconductive drum 3 is developed by the development section 503. The developed image is transferred to a sheet by the transfer section 502, and then is fixed to the sheet by the fixing section 501. By thus printing of the frame image, the size of the sheet may be accurately scanned. On this account, it is possible to, for example, correct scanning scaling. This procedure is the same as that described in the first embodiment.

The controlling means 500*a* of the multi-functional device 1 determines the size of sheet used in the image forming section 100 in the following manner.

The controlling means 500*a* detects the size of the sheets provided in the paper feeding tray 19 and in the paper feeding trays 20*a* through 20*c* of the paper feeding desk unit 20 of the multi-functional device 1 shown in FIG. 1 by detection means (not shown). Otherwise, the controlling means 500*a* identifies each tray in accordance with the information previously made for each paper feeding tray, and selects a paper feeding tray containing sheets of an appropriate size. A sheet is carried from the selected paper feeding tray by the carrying means 505 to carry out printing of the frame image. The controlling means 500*a* selects a smaller sheet than that of the maximum size of the acceptable range of the image forming section 100.

As one specific example, the following describes the case where the maximum image forming size, i.e., the maximum sheet size accepted in the image forming section 100 is A3 (297 mm×420 mm). Further, it is assumed here that the image forming effective width of the image forming section 100 is set to 297 mm, which is the same as the size of the maximum sheet (A3). In this case, the controlling means 500*a* selects a A4 (210 mm×297 mm) sheet or a B5 (182 mm×257 mm) sheet.

In the case of using a B5 sheet, the image formed on the photoconductive drum 3 can be securely transferred to the B5 sheet so that the edge of the image falls outside the sheet, regardless of the sheet carrying direction (both in the vertical and horizontal direction).

Further, in the case of using a A4 sheet, since the effective image forming width is the same as the longer length side of the sheet, the image formed on the photoconductive drum 3 cannot be formed on the sheet with the edge of the image falling outside the sheet when the sheet is carried in the main-scanning direction corresponding to the longer length direction (with horizontal setting). In this view, when a A4 sheet is used, the sheet is vertically carried, i.e., in a state where the longer length side of the sheet is in parallel to the sub-scanning direction.

In the case of using a A4 sheet, W0 of FIG. 4 is 210 mm, and L0 is 297 mm. Further, in the frame image shown as a reference image P in FIG. 3, the outline width J3 in the main-scanning direction D2 is set to, for example, 230 mm to be greater than the sheet size of 210 mm. Further, the outline width J1 in the sub-scanning direction (carriage direction D1) of the frame image is set to, for example, 317 mm to be greater than the sheet size of 297 mm. The internal interval J4 (corresponding to W3 of FIG. 4) of the frame image in the main-scanning direction is set to, for example, 180 mm, to be sufficiently smaller than the sheet size of 210 mm. Further, the internal interval J2 (corresponding to L3 of FIG. 4) of the frame image in the sub-scanning direction is set to, for example, 267 mm, to be sufficiently smaller than the sheet size of 297 mm. In the present embodiment, the pattern storing section 506 stores such frame image data corresponding to the sheet size. The controlling means 500*a* obtains an appropriate frame image data from the pattern storing section 506 according to the size of the sheet of the selected tray, and transmits the frame image data to the calculating means 600*a*.

Here, when the frame is too large, it causes a greater consumption of developer (toner) or other expendable supplies. In view of this problem, a certain error value of the target device of adjustment may be found in advance through a test etc. In this case, the frame image data is created with the width wide enough to ensure secure forming of a frame image with reference to the estimated carriage error. The created data is stored in the pattern storing section 506. The pattern storing section 506 may store plural patterns of image data corresponding to plural sizes of sheets, or may store a single-sized frame image corresponding to at least one sheet size.

Figure 17:
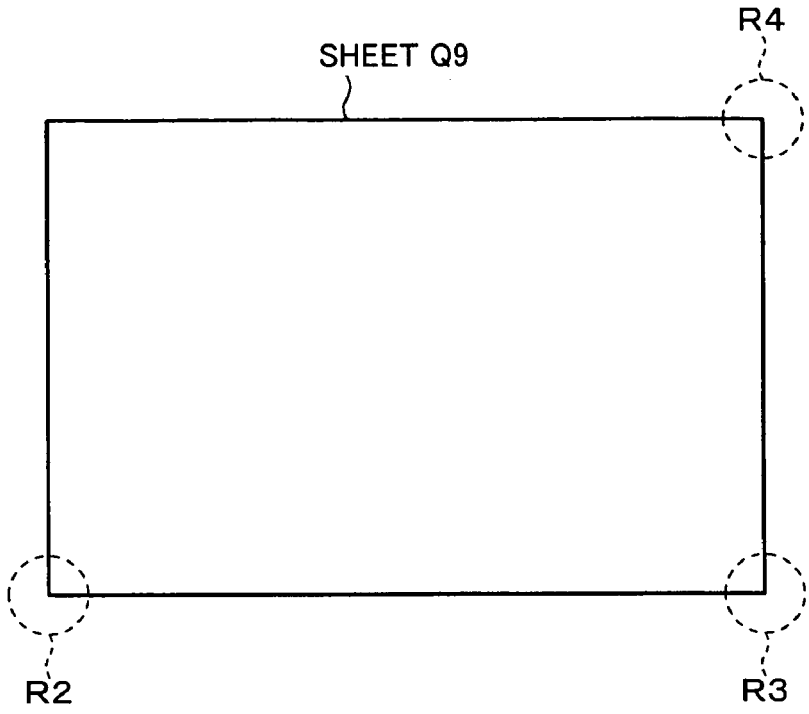
FIG. 17(*a*) is a plan view of a sheet, and FIG. 17(*b*) is a plan view of still another sheet.
Figure 17:
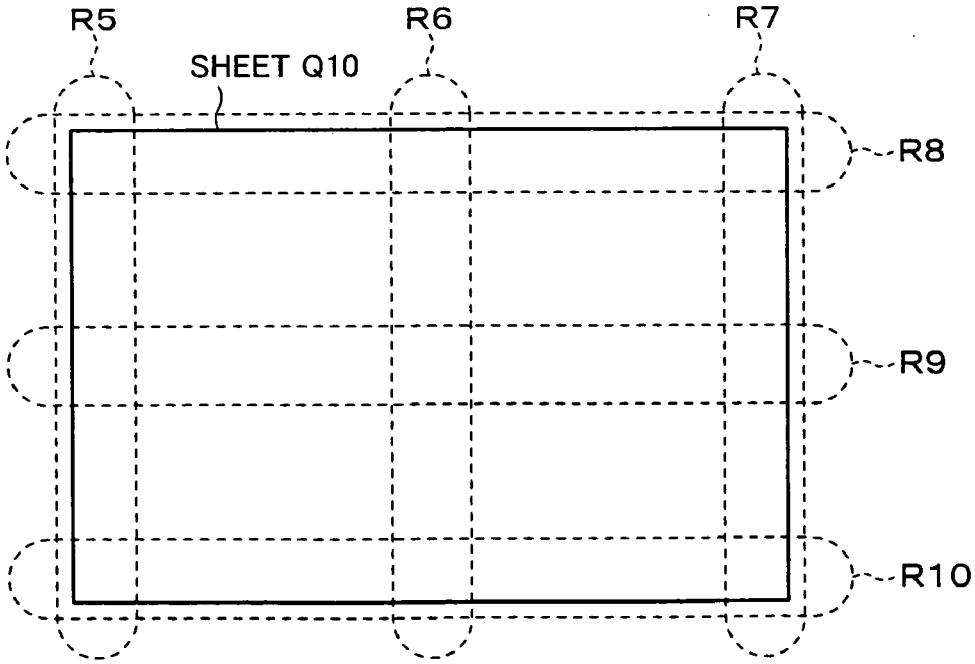

Further, the circumference of the frame image does not necessarily have to be endless, as long as it covers the areas R2, R3, and R4 of the sheet Q9 shown in FIG. 17(*a*). With this arrangement, the frame image is printed on at least three corners of the sheet Q9. In this case, the amount of the developer used for adjustment can be reduced. When, the frame image is printed, the frame image covers the whole of the circumference of the sheet so as to allow easy scanning of the edge of the sheet. Namely, by printing the frame image as a black frame covering the whole edge of the sheet, the edge of the sheet can be easily scanned.

Further, this structure also allows the use of a B4 sheet (257 mm×364 mm). However, it should be noted that a sheet of a larger size requires forming of a larger image, thus increasing consumption of the developer and the time needed for adjustment.

Secondly, the outputted sheet is placed on the original platen 209 of the multi-functional device 1, for example by a user. Then, the operation section 508 of the multi-functional device 1 detects the user's instruction for scanning, and the scanning means 200*a* starts scanning the image on the sheet.

Figure 19:
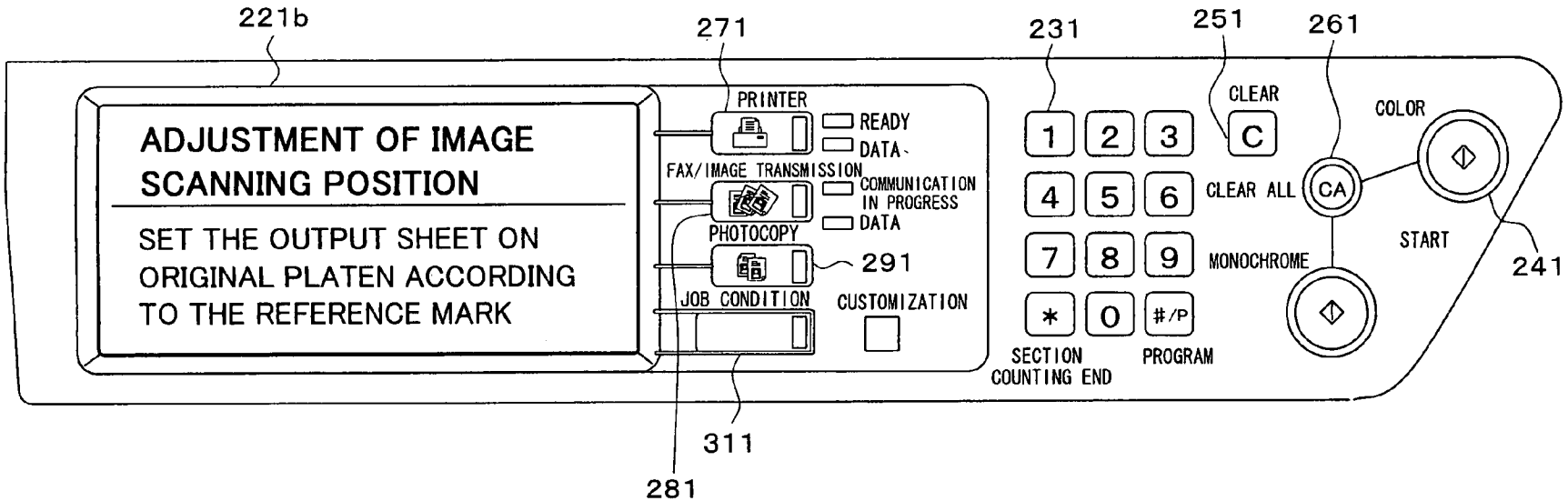
FIG. 19 is a plan view showing another example of the operation panel of the image forming system.

Here, in the present embodiment, the controlling means 500*a* of the multi-functional device 1 displays the following message with respect to the user, for example, in the LCD panel 221 of the control panel 220 (operation section 508) in order to ensure accurate scanning of the sheet by the scanning means 200*a*. As shown in FIG. 19, the LCD 221*b* displays a message saying: "please place the outputted sheet on the original platen in accordance with the reference mark". This is an instruction for "image scanning position adjustment". However, such a guidance is not limited to this arrangement displayed in the LCD 221 as one of service modes, but may be printed on the sheet with the same or a similar message as above.

Figure 11:
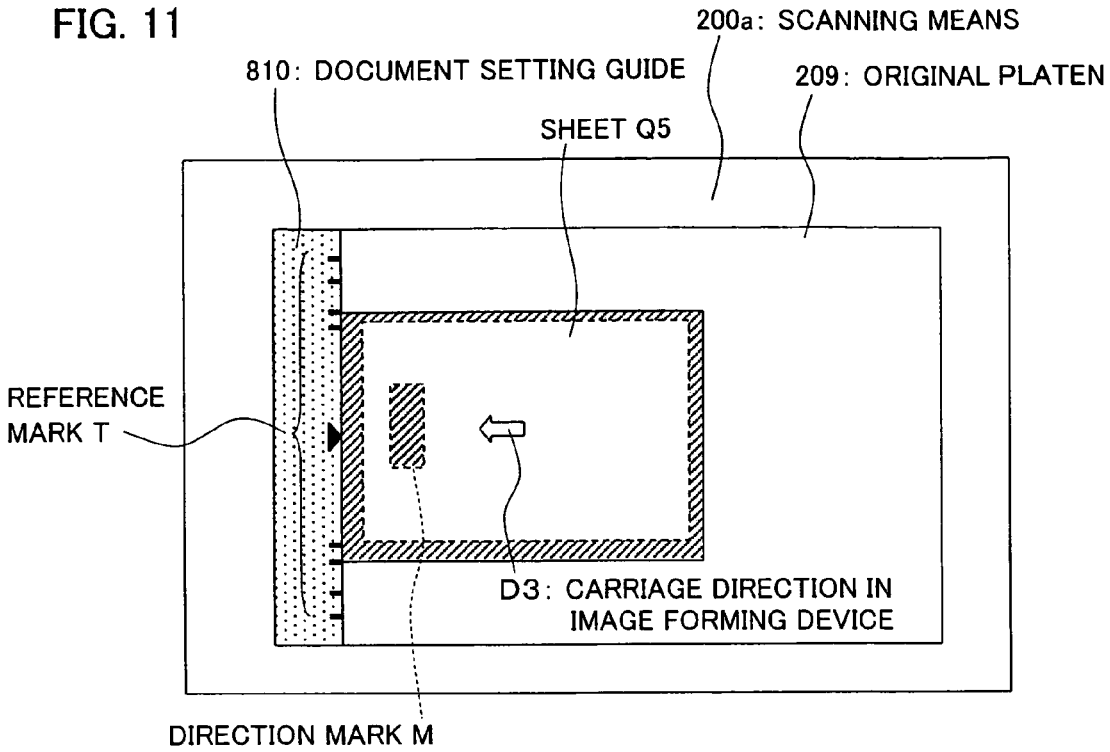
FIG. 11 is a plan view showing a sheet placed on an original platen of the image forming system.

FIG. 11 shows a state where the sheet Q5 is placed by a user on the original platen 209 of the scanning means 200*a* in accordance with the reference mark T of the document setting guide 801.

The sheet Q5 is provided with a direction mark M that indicates the direction of the formed image. This direction mark M allows the user to place the sheet Q5 while confirming the carriage direction D3 of the image forming section 100. Therefore, as shown in FIG. 11, the user can set the sheet in the right direction.

Figure 18:
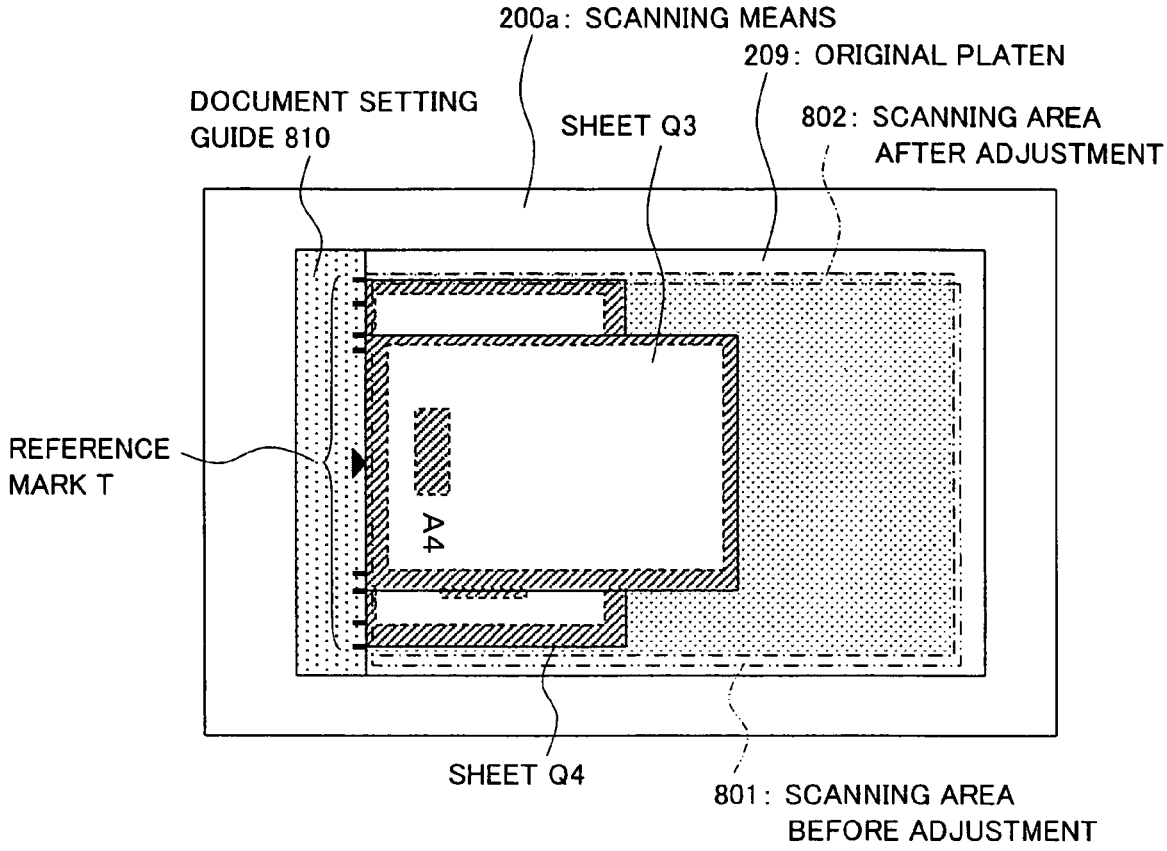
FIG. 18 is a plan view showing a condition under which a sheet whose size is different from that of the sheet shown in FIG. 12

Further, as with the sheet Q3 shown in FIG. 18, in the case of using a A4 sheet, the sheet is placed with the shorter length side in parallel to the main-scanning direction so as to enable secure scanning of the image. In contrast, in the state of the sheet Q4 (a A4 sheet) shown in FIG. 18, the longer length side of the sheet is placed in parallel with the main-scanning direction. In this state, the sheet may fall outside the scanning area 801 before adjustment. However, if the adjustment of scanning area for the scanning means 200*a* has been already carried out, the sheet Q4 is placed within the scanning area 802 after adjustment, as shown in FIG. 18, thereby enabling scanning.

Figure 12:
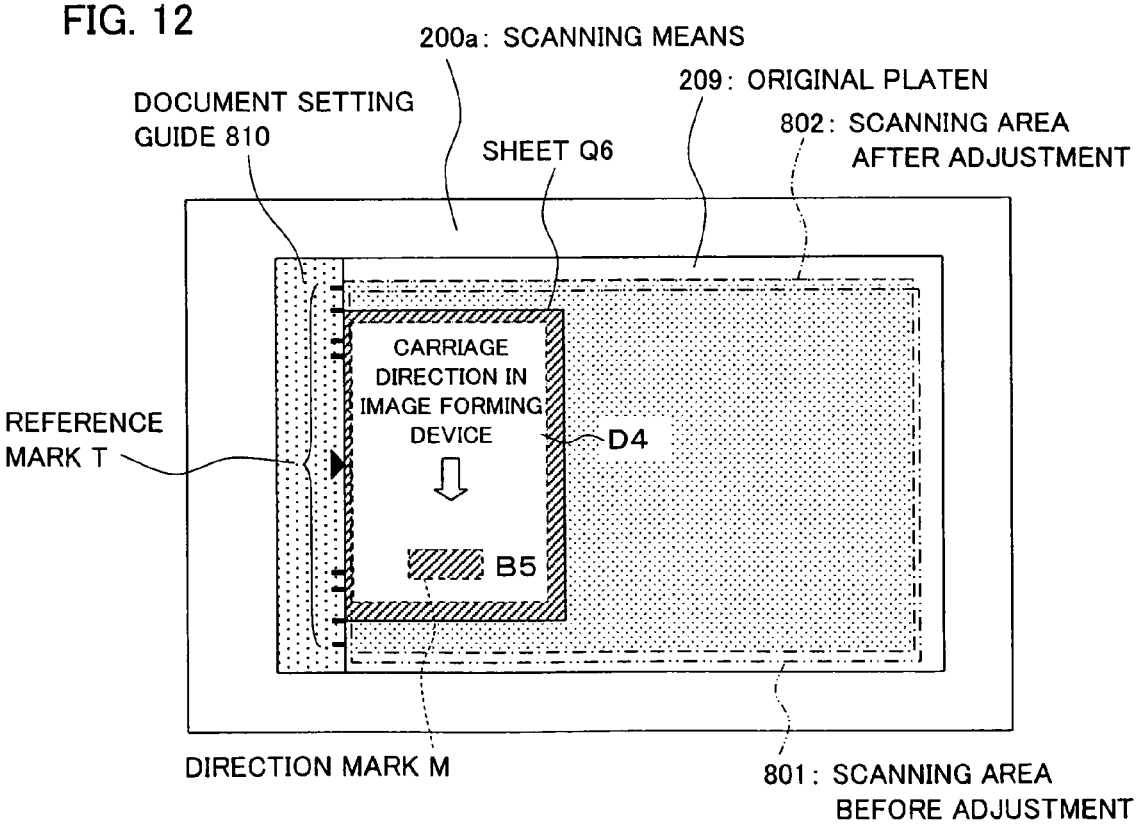
FIG. 12 is a plan view showing a sheet placed on the original platen of the image forming system under a condition different from the condition shown in FIG. 11.

Further, as with the sheet Q6 shown in FIG. 12, the sheet may be placed in an undesirable direction. In this case, the user may misjudge the placing direction or the carriage direction. To handle this case, the multi-functional device 1 is arranged so that the calculating means 600*a* detects the carriage direction D4 of the image forming section 100 according to the direction mark M when the scanning means 200*a* scans the image of the sheet Q6, so as to obtain the placing direction of the sheet. Through this operation, an appropriate scanning condition and an appropriate image forming condition can be found. With such a manner, the setting direction of the sheet may be automatically detected in the multi-functional device 1.

Note that, the present embodiment shows the direction mark M as a rectangle pattern for the sake of simplicity; however, the direction mark is not limited to this shape. For example, the mark may be an arrow shape in terms of visuality, which however requires a larger data memory in the storage section. Further, when the scanning means 200*a* scans the sheet setting state, the mark of an arrow shape makes the judgment of scanning result more complex. For this reason, the present embodiment uses a simple rectangle pattern, which is formed to be closer to one side of the frame image.

When the sheet is placed on the original platen 209 in the state of the sheet Q5 of FIG. 11, the operation section 508 of the multi-functional device 1 detects the instruction for scanning by the user, and the scanning means 200*a* starts scanning of the image of the sheet. Here, as in the present embodiment, when the scanning condition of the scanning means 200*a* is corrected as well as the image forming condition of the image forming section 100, it is necessary to determine the central point of the scanning area in the main-scanning direction, and to determine an accurate scanning starting point if the sub-scanning direction.

Figure 13:
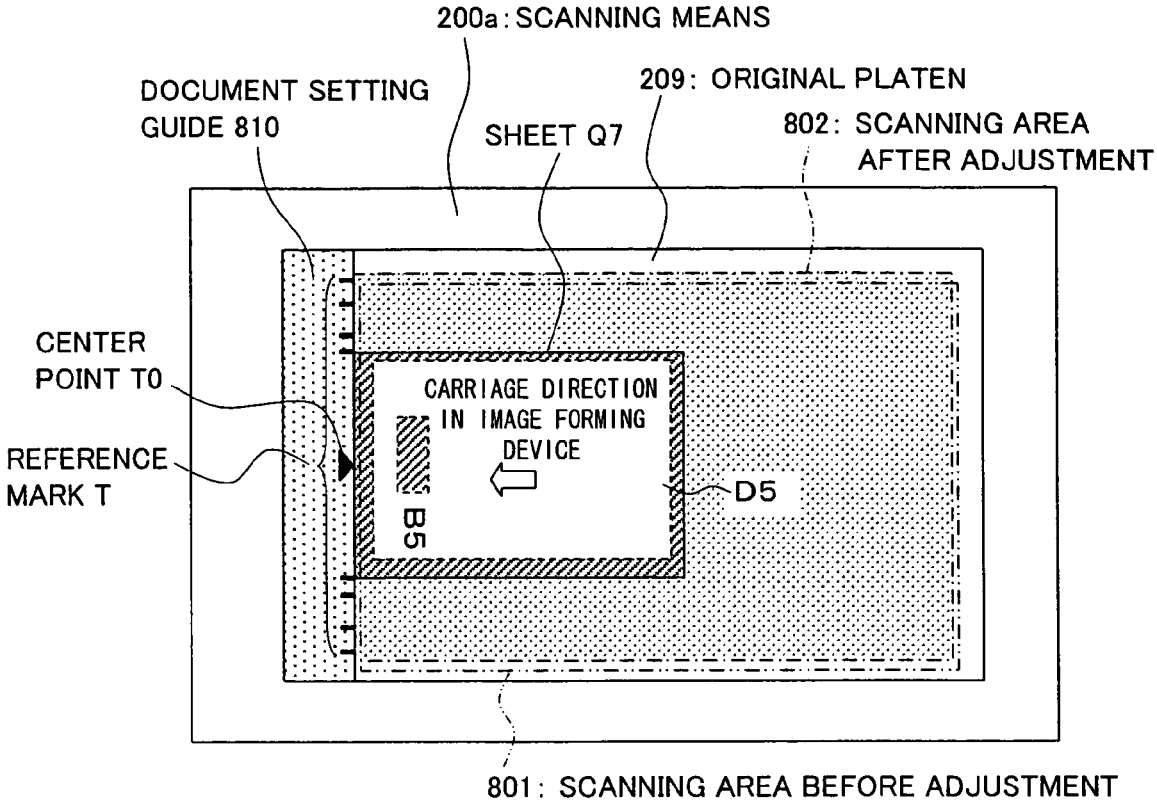
FIG. 13 is a plan view showing a sheet placed on the original platen of the image forming system under a condition different from the condition shown in FIG. 12.

As shown in FIG. 13, the central point of the scanning area corresponds to the central point T0 of the reference mark T provided in the main-scanning direction of the scanning area. To adjust the central point, the controlling means 500*a* of the multi-functional device 1 may display a message to the user, for example, with a wording: "please match the center of the sheet with the center of the reference mark of the document setting guide" in the LCD 221 of the control panel 220.

Further, as shown in FIG. 13, the sheet Q7 is placed on the document platen in the carriage direction D5, according to the central point T0 and the reference mark T. Then, the scanning means 200*a* scans the sheet, and the calculating means 600*a* calculates the correction value. Since the center of the scanned frame indicates the actual center point, the value for finding the accurate position of the center point T0 may be figured out by finding the center point of both edges of the outer frame of the main-scanning direction of the sheet Q7. As described, the correction value for the scanning means 200*a* should be found by using data of the outer frame of the frame image on the sheet, which does not include an error due to the type of image forming by the image forming section 100. By carrying out scanning by the scanning means 200*a* with this correction value, the scanning area 801 may be modified to be the scanning area 802 in which the center point T0, i.e., the center of the reference mark T is matched with the center of the scanning position in the main-scanning direction.

Note that, in the scanning means 200*a*, by carrying out scanning of an area including at least three corners (such as the areas R2, R3, R4 in FIG. 17(*a*)) of the sheet Q9, it is possible to scan the image of the outer frame of the sheet. However, to obtain more accurate correction value, as shown in FIG. 17(*b*), the scanning means may scan the areas R5 through R7 and R8 through R10 of the sheet Q10 with a printed frame image (not shown). This arrangement offers a more accurate correction value. In other words, the scanning is performed three times for the areas R5 through R7 along the longer length side of the sheet, and the areas R8 through R10 along the shorter length side, thus obtaining a more accurate scanning value.

Therefore, even when the sheet on the original platen 209 is not completely in parallel with the document setting guide 810, inclination of the sheet can be detected with this arrangement in which scanning is performed with respect to three places (at least two places) in the main-scanning direction or in the sub-scanning direction.

For example, the length W0 of the main-scanning direction shown in FIG. 4 is detected by scanning of two or more portions of the sub-scanning direction. Here, for example, if the respective detection starting points of the two or more detection portions of the outer frame of the sheet differ from each other (if the detection starts from different pixel numbers), that indicates inclination of the sheet. The inclination of the sheet can be found by the calculating means 600*a* with reference to the difference of the pixel number in the two or more portions and the distance between these positions in the sub-scanning direction. Further, if the width W1 of one of the frames in the main-scanning direction varies in the two or more scanning points, that indicates that the writing timing of the image forming section 100 is not accurate, and the image printed on the sheet is inclined. In the same manner as above, this degree of inclination may be figured out with reference to the variation of the frame width W1 in the two or more portions and the distance between these positions in the sub-scanning direction. When the scanning is performed with respect to three points, the inclination may be found with reference to the scanning results of two end points among the three points. As to displacement of the sheet, it may be figured out according to an average value of the three points, or according to the intermediate value among the three points. Calculation of the inclination degree figures out a correction value. In this manner of calculating the inclination degree of the sheet, the correction value with respect to the sub-scanning direction can also be found.

Further, if the sheet is for some reason greatly inclined on the original platen 209, the start point for scanning by the scanning means 200*a* cannot be found since the sheet is not placed on the original platen 209 along the document setting guide 810. This defect is specifically explained later. In view of this problem, the multi-functional device 1 of the present embodiment is arranged so that a storage section (not shown) stores information of an allowable inclination range in advance. Then, the controlling means 500*a* displays error message in a display area of the operation section 508 when the inclination found in the foregoing manner falls outside the predetermined allowable range. For example, the controlling means 500*a* displays error message when the inclination is figured out as 2 mm as a result of measurement of two edges of the sheet. With this display, the user re-checks the setting condition of the sheet on the original platen 209, which allows the scanning means 200*a* to carry out the scanning again with the sheet now properly placed.

Another assumable case is that the main-scanning line of the image forming section 100 is curved. In an arrangement in which the writing section 513 adopts a laser scanning method, the scanning line can be curved depending on the inclination degree of the incident angle of the laser beam with respect to the deflecting means, or the optical characteristics of the lens system. Further, in an arrangement in which the writing section 513 adopts a solid-body scanning method with an optical LED head or the like, the scanning line can be curved due to such as non-linear alignment of the light emitting section, or arcuation of the optical writing unit caused by external force etc.

In these cases, the inclination of the line may not be detected only with the scanning at the two points in the sub-scanning direction or in the main-scanning direction. If the inclination of the line can be predicted, it is preferable that the scanning is performed at three or more points in the sub-scanning direction or in the main-scanning direction.

Figure 14:
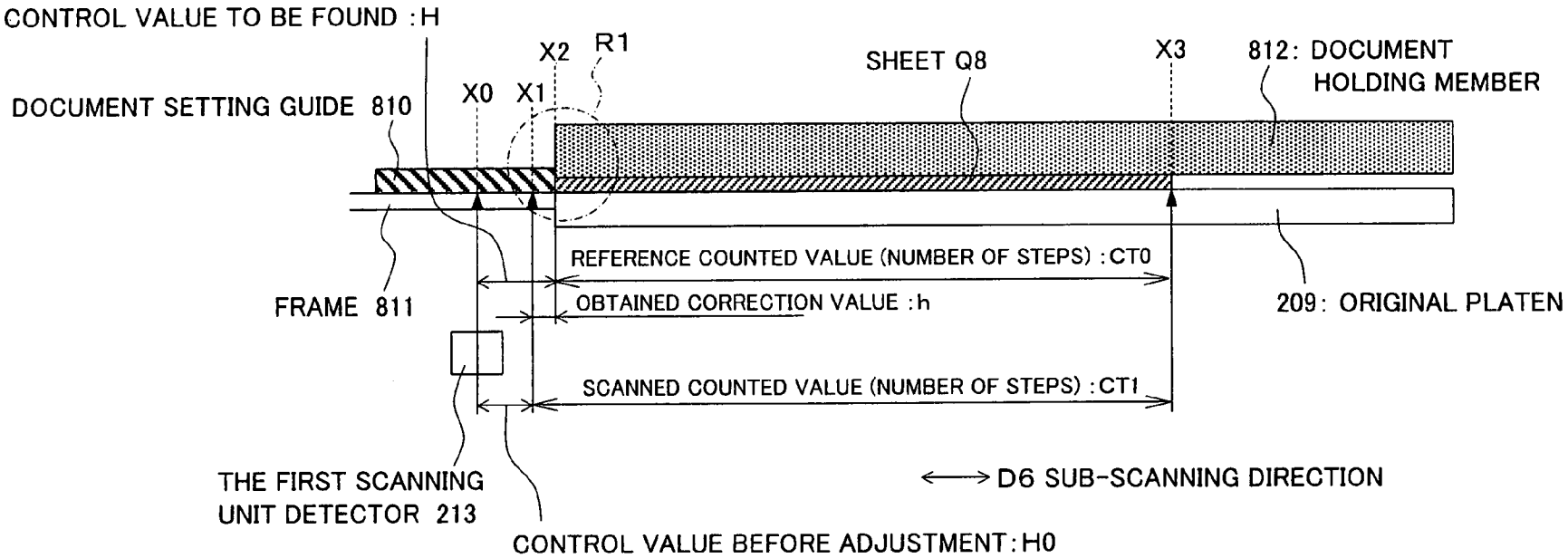
FIG. 14 is a cross sectional view showing a part of scanning means of the image forming system.

Next, the following describes how to find the scanning starting point of the sub-scanning direction with reference to FIG. 14. The sheet Q8 with a printed image is placed on the original platen 209 while being in contact with the document setting guide 810.

The image formed on the sheet Q8 is scanned by the first scanning unit detector 213 etc. provided under the original platen 209. The scanning unit detector 213 scans the sheet by moving in the sub-scanning direction D6. The first scanning unit detector 213 and the second scanning unit (not shown) that perform scanning are driven by a stepping motor. Therefore, the controlling means 500*a* counts a number of rotation steps of the stepping motor (i.e., a number of pixels), so as to figure out the movement distance of the first scanning unit detector 213 etc. The counting number is inputted from the controlling means 500*a* to the calculating means 600*a*. In cases where the scanning unit is driven by other motor than the stepping motor, for example, a DC motor, the counting of pixel number may be performed by connecting the transmission system to an encoder etc.

In FIG. 14, the position X0 denotes a point where the first scanning unit detector 213 is placed to be ready for scanning. The position X1 denotes a point where the scanning begins by the first scanning unit detector 213, before the scanning is adjusted. The position X2 is the front end of the sheet Q8 placed in contact with the document setting guide 810. Accordingly, the position X2 indicates an accurate position for starting scanning.

In the present embodiment, the scanning stating point (scanning starting timing) is adjusted by finding the position X2 according to the position X3, that is the rear edge of the sub-scanning direction of the sheet. In this manner, an accurate position X2 for start scanning by the scanning means 200*a* can be found.

More specifically, firstly, the value counted before adjustment, i.e., the pixel number between the position X0 where the scanning unit starts moving and the position X1 where the actual scanning of the sheet begins, is expressed as H0. Next, the counting value from the position X1 where the actual scanning begins to the position X3 (the rear edge of the sheet) where the scanning finishes is expressed as CT1. Further, the counting value of the length (reference length) of the sheet Q8 is expressed as CT0.

Here, assuming that the value counted from the position X0 to the X2, an accurate scanning starting point, is H, there is found an equation: H+CT0=H0+CT1. This leads another equation: H=H0+CT1−CT0, and the calculating means performs this calculation to find the value of H. In this manner, it is possible to obtain a correction value h=H−H0. With this value h, the predetermined counted value H0 for starting scanning can be corrected. By operating the first scanning unit detector 213 according to the predetermined value H and the correction value h, the scanning of image by the first scanning unit detector 213 may be carried out with an accurate starting position X2.

As with the example above, when the scanning is performed with respect to the printed sheet Q8 placed on the original platen 209, the position of the sheet Q8 can be easily determined if the sheet Q8 is placed in contact with the document setting guide 810 provided as a document reference member, thus properly placing the sheet on the document platen 209. On this account, adjustment of image scanning stating point may be easily carried out by only scanning a portion (the rear edge of the sub-scanning direction) of the outer frame image of the sheet Q8.

Further, in the foregoing example, the position X2 is figured out according to the position X3, that is the rear edge of the sheet Q8 in the sub-scanning direction, in consideration of assumed difficulties in scanning a border of the document setting guide 810 and the sheet Q8 in the area R1. When the first scanning unit detector 213 etc. scans the area R1 via the rear surface of the original platen 209, the frame 811 of the scanning means 200*a* (such as the first scanning unit detector 213) and the glass edge of the original platen 209 are partly overlaid. Therefore, there may be some difficulties to detect a certain edge of the sheet Q8 in some cases. In this view, the scanning is not performed on the portion (of the sheet Q8) in touch with the document setting guide 810.

However, the present invention is not limited to this arrangement. The value can also be found through direct scanning of the front edge of the sheet Q8 on condition that these edges and the edge of the sheet are not overlaid with each other. For example, the direct scanning can be performed if the device has an arrangement such that the glass edge of the original platen 209 and the frame 811 of the scanning means 200, that is provided more closer to the end, are in contact with each other in a portion other than the document setting guide 810 and the sheet Q8. Namely, in this case, the position X2 may be detected directly with reference to the scanned image data of the sheet Q8.

Further, the scanning accuracy may decrease when the reference position for setting the document on the original platen 209 and the edge of the original platen 209 coincide with each other as with the case above, since it makes division of the document setting guide 810 and the sheet Q8 more difficult. In this case, as shown in FIG. 6, the respective ends of the sheets Q1 and Q2 are separated from the document setting guide 810 on the original platen 209. With this arrangement, the scanning may be securely carried out including the edge of the sheet with a certain division of the document setting guide 810 and the front edge of the sheet.

However, in this case, the scanning starting point of the sub-scanning direction, i.e., the front edge of the scanning area in the sub-scanning direction is not identical with the front edge of the document. In this view, the scanning is performed twice. More specifically, the scanning is carried out, for example, in such a manner that the sheet is first scanned with the edge along the document setting guide 810, and then scanned again with the edge separated from the document setting guide 810.

Further, the foregoing explanation describes only a case of referring to the outer frame of the sheet Q8. However, the present invention is not limited to this arrangement, but may detect the position of the inner frame of the frame image formed on the sheet. Here, the inner frame of the frame image includes scaling error of the image forming section 100; however, the data of the inner frame may still be used for adjusting the scanning means 200*a* if an error within ±0.5 mm is allowable.

In such a manner, the error of the scanning starting point (in the main-scanning direction and in the sub-scanning direction) by the scanning means 200*a* can be detected, and the correction value may be found. In the present embodiment, the scanning scaling of the scanning means 200*a* is adjusted in advance as described above. Therefore, the scanning condition of the scanning means 200*a* is modified with a correction value that is found by a single scanning as in the case above.

Next, the following describes the case where the scanning scaling is not adjusted in advance. In this case, the adjustment of scanning condition is carried out in such a manner that the first scanning is performed so as to modify the scaling error and position error of the image forming section 100, and then, the frame image is printed by the modified image forming section 100 to be scanned for adjusting the scanning means 200*a* in the following manner.

In the case of carrying out minute adjustment of scanning scaling, an adjustment sheet is printed in the image forming section 100 having been modified. With this adjustment sheet, fine adjustment of the scanning means 200*a* may be performed. In this method, the frame image is successfully formed around the sheet with precise scaling, as it is printed by the image forming section 100 that has been modified, thereby adjusting the scanning means 200*a* with higher accuracy.

More specifically, as to the main-scanning direction, when the document setting reference of the scanning means 200*a* is identical with the center of the main-scanning direction, an error of scanning scaling of the scanning means 200*a* does not affect the adjustment of scanning position, though it affects the correction value of image forming timing of the image forming section 100.

That is, the center of the main-scanning direction may be determined with reference to the central portion of the both ends of the sheet, that can be found through the scanning of the sheet. Accordingly, the accurate position of the center of the main-scanning direction can be found as long as the sheet is properly placed according to the reference mark of the document setting guide even with several quantity of error of the scanning scaling of the scanning means 200*a*.

Further, the scanning starting point of the sub-scanning direction can be found by the calculating means 600*a* using the reference value (sheet size) based on the position of the rear end of the sub-scanning direction. This calculation of the correction value will be described later.

Further, when the scanning means 200*a* carries out scanning with reference to not the central reference mark but a reference mark on one side, the scanning starting point may be determined according to the detected position of the outer frame of the frame image printed on the sheet. However, in this case, the scanned image data needs to be outputted to the image forming section 100 in consideration of the scaling error. Otherwise, it is necessary to output information of the scaling error to the image forming section 100 with the image data so as to correct the scaling error through image forming of the image forming section 100.

Here, the following minutely describes a method of modifying scaling error based on the position of the outer frame. Firstly, the scanning means 200*a* scans the length W0 of the sheet Q0 shown in FIG. 4, for example. The length of the W0, that is obtained as a number of pixels, is then compared with the original pixel number of a 210 mm length of a A4 sheet, so as to find a scaling ratio (scanning scaling, scaling error) Am of the scanning means 200*a* with respect to the main-scanning direction. Secondly, the scanning means 200*a* scans the length L0, that is then compared to the original pixel number of another length of 297 mm of the A4 sheet, so as to find a scaling ratio As of the scanning means 200*a* with respect to the sub-scanning direction. The scaling ratio (scaling error) here is defined as: (counted pixel number)/(pixel number of the image data).

With reference to a scaling correction coefficient 1/Am for correcting scaling error in the main-scanning direction, and a scaling correction coefficient 1/As for correcting scaling error in the sub-scanning direction, an accurate scaling ratio (no magnification ratio) 1 may be found. As to the actual length, it may be found by multiplying the counted pixel number obtained through scanning by a resolution value.

Further, in the case of obtaining the scanning starting point of the sub-scanning direction according to the rear end of the sheet as in the example described with FIG. 14, the calculating means 600*a* finds the correction value according to the scaling error in the following manner. The scanned pixel number CT1 is multiplied by the correction coefficient 1/As, and then subtracted by CT0 to find the correction value h. Note that, in the case of performing scanning by directly scanning the front edge of the sheet having a frame image, the consideration of the scaling error is not necessary.

Further, as with the case above, if there are any scanning errors of the scanning means 200*a*, the scaling error of the scanning means 200*a* and the scaling error of the image forming section 100 both need to be taken into account upon image forming of the image forming section 100. The following explains adjustment operation in this case.

The correction values Am and As, that are scaling error of the scanning means 200*a*, are found by the calculating means 600*a* through the first scanning operation. Then, the scaling error of the image forming section 100 is found by the calculating means 600*a* with reference to the scanned data of the size of the inner frame of the frame image in consideration of the foregoing scaling error of the scanning means 200*a*. This calculation for finding the error and the correction value is explained below referring to FIG. 4. Firstly, with the scaling correction coefficients Am and As found in the foregoing method, the lengths W3 and L3 are respectively multiplied by 1/Am and 1/As. Through this calculation, the actual size of the frame image formed on the sheet Q0 is found. This actual size is compared with the proper size of the frame image stored in the image forming 100, so as to find the scaling error (scaling error in image forming) of the image forming section 100. Consequently, coefficients 1/Am' and 1/As' respectively with respect to the main-scanning direction and the sub-scanning direction, for correcting image forming scaling of the image forming section 100 are found. This information is inputted to the image forming section 100.

The writing timing of the image forming section 100 in the main-scanning direction may be found by comparing the proper W1 value based on the image data with the values obtained by multiplying the scanned W1 value by 1/Am and 1/Am' for correcting the scaling error of the main-scanning direction of the scanning means 200*a* and the image forming section 100. This comparison is carried out by the calculating means 600*a*. Through this operation, a correction value for modifying the previously determined writing timing of the main-scanning direction can be found.

Similarly, the writing timing of the image forming section 100 in the sub-scanning direction may be found by comparing the proper L1 value based on the image data with the values obtained by multiplying the scanned L1 value by 1/As and 1/As' for correcting the scaling error of the sub-scanning direction of the scanning means 200*a* and the image forming section 100, by the calculating means 600*a*. Through this operation, a correction value for modifying the previously determined writing timing of the sub-scanning direction can be found.

When the scaling of the main-scanning direction is adjusted in the structure where the image forming section 100 adopts a laser beam scanning method, the controlling means 500*a* adjusts the writing start position by controlling the writing starting timing after the light passes through the beam detector, so that pixel lighting timing is adjusted for each pixel.

Meanwhile, in cases where the image forming section 100 adopts a solid-body scanning method with an LED head or the like, the writing position of the main-scanning direction may be corrected by changing the first emitting element for starting lighting. The scaling of the main-scanning direction is substantially determined in this case, and therefore it does not necessarily have to be adjusted. However, if the error is significant, the number of lit emitting elements is decreased/increased by thinning-out/adding some of image data.

The adjustment with respect to the sub-scanning direction of the image forming section 100 may be performed by the controlling means 500*a* by adjusting at least either one of the writing timing of image forming or the connecting timing of the resist clutch.

Further, the scaling with respect to the sub-scanning direction of the image forming section 100 may be corrected by the controlling means 500*a* by adjusting either the rotation speed of the photoconductive drum 3 or the carriage speed of the sheet. In the present embodiment, the scaling is corrected by adjusting the speed of carriage motor provided on a back portion of the carriage device, since adjustment of the speed of the carriage direction of the sheet does not affect the processing condition of the image forming.

Further, the scaling error of the scanning means 200*a* may be corrected as follows. For example, the scaling error of the sub-scanning direction is corrected by the controlling means 500*a* by adjusting the scanning accuracy of the scanner according to the scanning speed. The scaling of the main-scanning direction is substantially determined in this case, and therefore it does not necessarily have to be adjusted. However, if the error is significant, the scaling is adjusted by thinning-out/adding some of image data.

Note that, in the multi-functional device 1 according to the present embodiment, the correction value is found by the calculating means 600*a* using the image data inputted from the scanning means 200*a*, and then the image forming section 100 is adjusted according to the correction value. However, the present invention is not limited to this arrangement. Alternatively, the calculating means may be provided as dedicated means for the image forming means 100 or the scanning means 200*a* of the multi-functional device 1. In this arrangement, at least one of the image forming section 100 or the scanning means 200*a* includes the dedicated calculating means, and if they both includes the calculating means, the correction value is found by either of them. Further, the present invention may also be arranged so that the calculating means is provided as processor such as a CPU in the image forming means 100 or the scanning means 200*a*. In this arrangement, at least one of the image forming section 100 or the scanning means 200*a* includes the processor, that operates as calculating means by carrying out a program read out from the storage section. For example, it may be so arranged that the scanning means 200*a* includes a CPU that operates as calculating means by carrying out a program, and the correction value data resulting from the enforcement of the program is transmitted to the image forming section 100 so as to adjust the image forming section 100.

Figure 15:
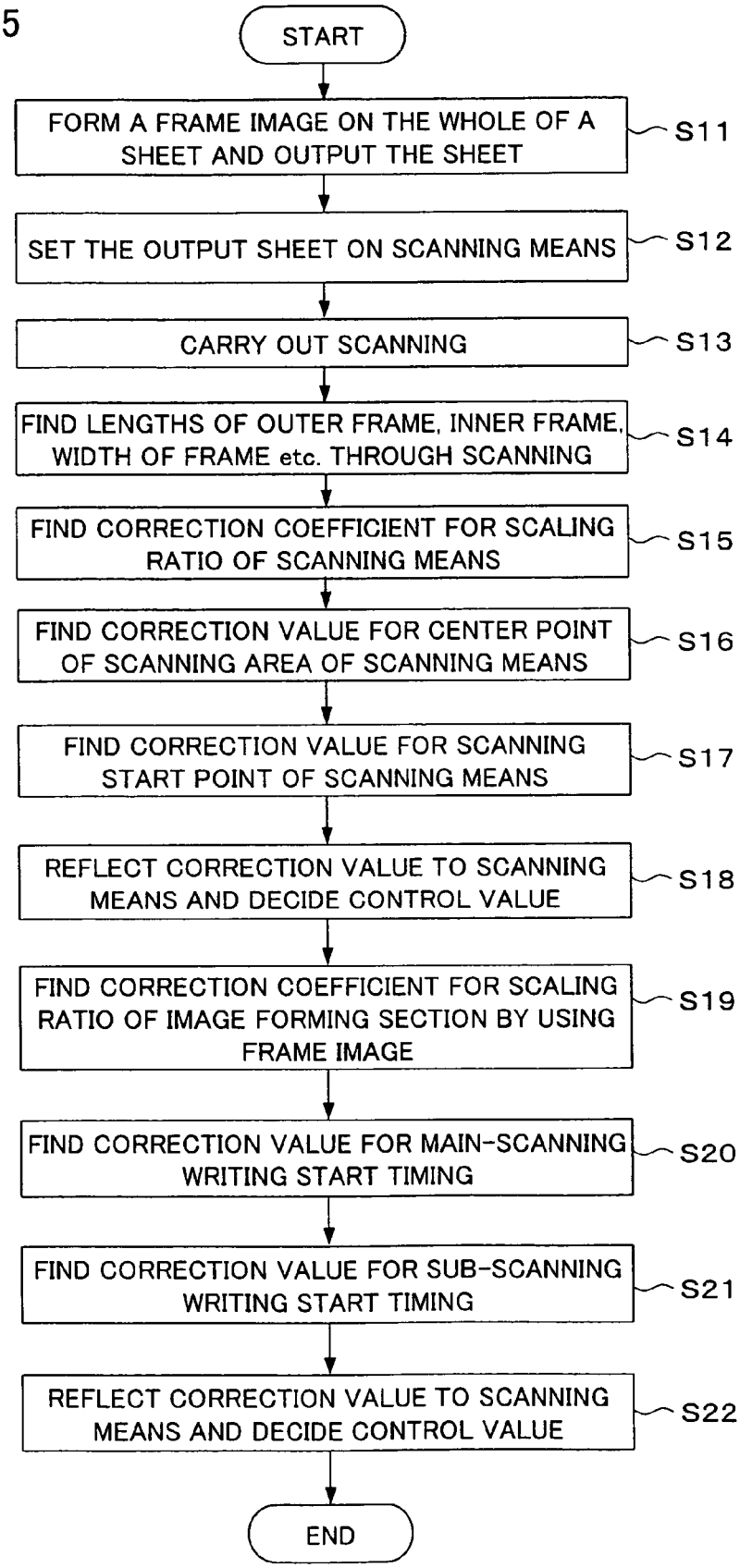
FIG. 15 is a flowchart illustrating an adjustment operation of the image forming system.

Here, the foregoing single scanning correction operation of the image forming section 100 and the scanning means 200*a* is explained below with reference to FIG. 15. In the step S11, the image forming section 100 of the multi-functional device 1 forms a frame image on the sheet with respect to an area including the whole circumference of the sheet, and outputs the sheet. In the step S12, the setting of the outputted sheet to the scanning means 200*a* is detected. In the step S13, the scanning means 200*a* scans the sheet. In the step S14, the scanning means 200*a* obtains data regarding the outer frame, the inner frame, frame width etc. of the sheet through scanning operation. These steps are the same as those described in the first embodiment.

In the step S15, with the receipt of the image data from the scanning means 200*a*, the controlling means 500*a* of the multi-functional device 1 causes the calculating means 600*a* to find a scaling correction coefficients 1/Am and 1/As.

Next, in the present embodiment, the multi-functional device 1 finds a correction coefficient of the scanning means 200*a* in the steps S16 through S18 to carry out adjustment of the scanning means, and also finds a correction coefficient of the image forming section 100 in the steps S19 through S22 to carry out adjustment of the image forming section. These adjustments of the scanning means 200*a* and the image forming section 100 may be carried out in turn (in an arbitrary order), or at the same time.

In the step S16, the calculating means 600*a* finds a correction value for adjusting the center point of the scanning area of the scanning means 200*a*. In the step S17, the calculating means 600*a* finds a correction value for adjusting the scanning starting point of the scanning means 200*a*. In the step S18, the controlling means 500*a* reflects the obtained correction values to the scanning means 200*a* and determines a control values.

In the step S19, the controlling means 600*a* finds a scaling correction coefficient of the image forming section 100 based on the data of the frame image. In the step S20, the calculating means 600*a* finds a correction value of the writing starting timing of the image forming section 100 with respect to the main-scanning direction. In the step S21, the calculating means 600*a* finds a correction value of the writing starting timing of the image forming section 100 with respect to the sub-scanning direction. In the step S22, the controlling means 500*a* reflects the obtained correction values to the image forming section 100 and determines a control values.

By thus printing the frame image on the sheet (S11), scanning the frame image (S13), and then carrying out adjustment, the scanning condition and the image forming condition of the multi-functional device 1 can be adjusted through a single printing and a single scanning.

Note that, the present invention is not limited to the described adjustment method using commercially available sheets of the regulation sizes, but may be enforced with the use a sheet of an arbitrary size. This case requires input of the desired sheet size to the operation section 508 (control panel 220) of the multi-functional device 1.

Figure 16:
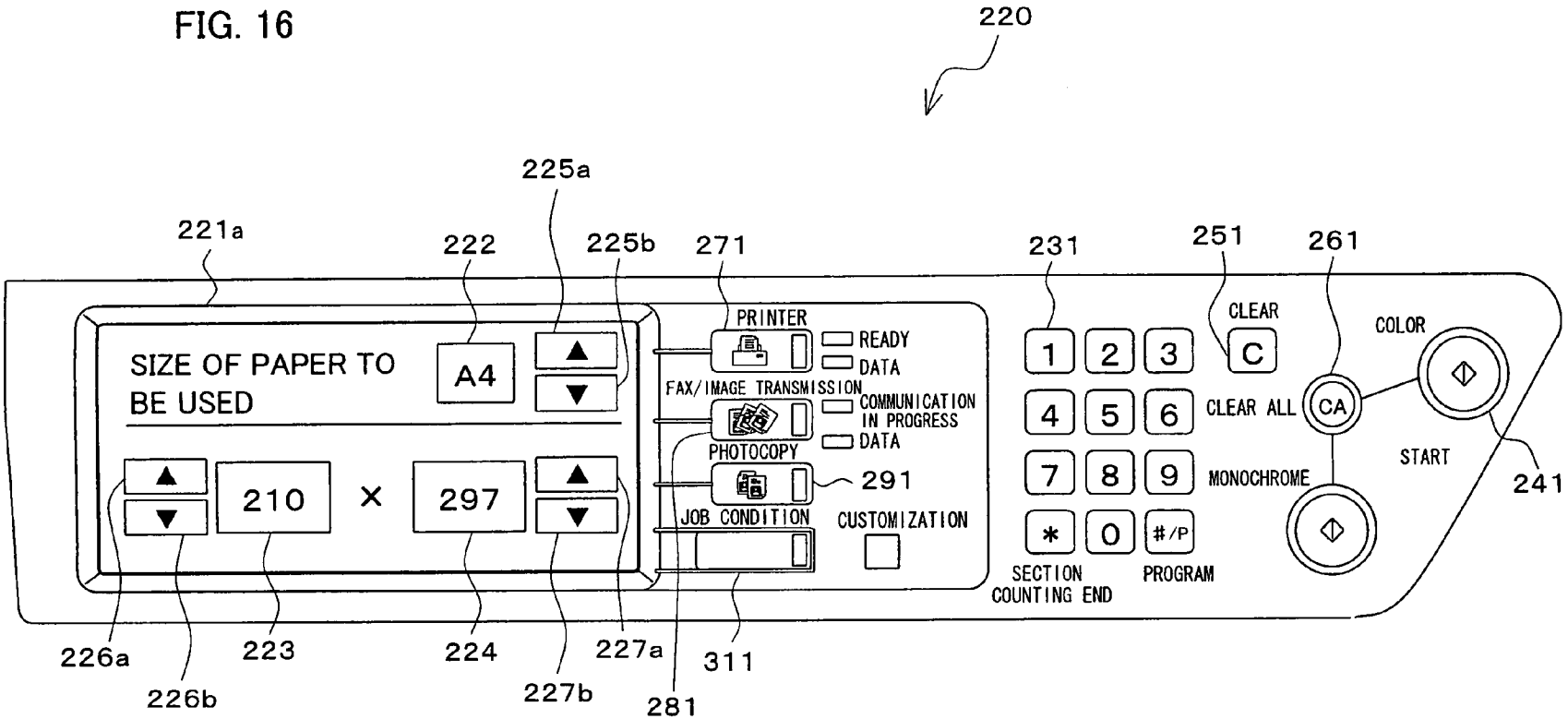
FIG. 16 is a plan view showing an example of an operation panel of the image forming system.

The following describes this operation with respect to the control panel 220 referring to FIG. 16. When a predetermined key is pressed in the control panel 220, the LCD 221*a* displays some contents, such as the ones denoted by 222, 223 and 224 in FIG. 16.

The content 222 is a key for setting the size of the paper. The content 222 is changeable with an increase key 225*a* and a decrease key 225*b* that are provided on the LCD 221*a* operating as a touch panel. For example, FIG. 16 shows a case where "A4" is selected. Further, the content 222 may be set to "others" so as to select a special size with the increase key 225*a* and the decrease key 225*b*, which allows setting of an arbitrary sheet size. Further, this operation may also perform setting of the sizes of an outer frame and an inner frame of the frame image of the sheet.

When the content 222 is pressed, the size of the sheet is displayed in the contents 223 and 224. The content 223 displays the length in main-scanning direction, and the content 224 displays the length in the sub-scanning direction. The content 223 is changeable with an increase key 226*a* and a decrease key 226*b*, and the content 224 is changeable with an increase key 227*a* and a decrease key 227*b*.

Further, the setting of the contents 223 and 224 may also be carried out by using the numeric keys 231, instead of the increase key 226*a* and the decrease key 226*b*, and the increase key 227*a* and the decrease key 227*b*.

Note that, the sheet used for adjustment is a general sheet for image forming with the regulation size. However, such a sheet may have a slight size difference, for example, ±1 mm at maximum, in some cases. Further, the fixing unit (fixing unit 12) may change water content of the sheet as a result of image forming. More specifically, the water content of the sheet may be reduced through image forming, which causes a decrease of sheet size. In this case, the sheet size, preferably the size after the image forming, is measured and inputted to the operation panel 220 so as to accurately carry out adjustment. Further, this method may also be performed by inputting the difference between the sheet size and the reference size. In these ways, the adjustment can be carried out with high accuracy even with a slight difference of the sheet size.

Further, the present invention is not limited to the foregoing method in which the controlling means 500*a* directly perform setting of the obtained correction data with respect to the image forming section 100 or the scanning means 200*a*. For example, the correction data may be displayed in the LCD 221 of the control panel 220 so as to allow a service person or the administrator of the device to manually input the correction value.

THIRD EMBODIMENT

Still another embodiment of the present invention is described below with reference to FIGS. 20 through 29.

Figure 20:
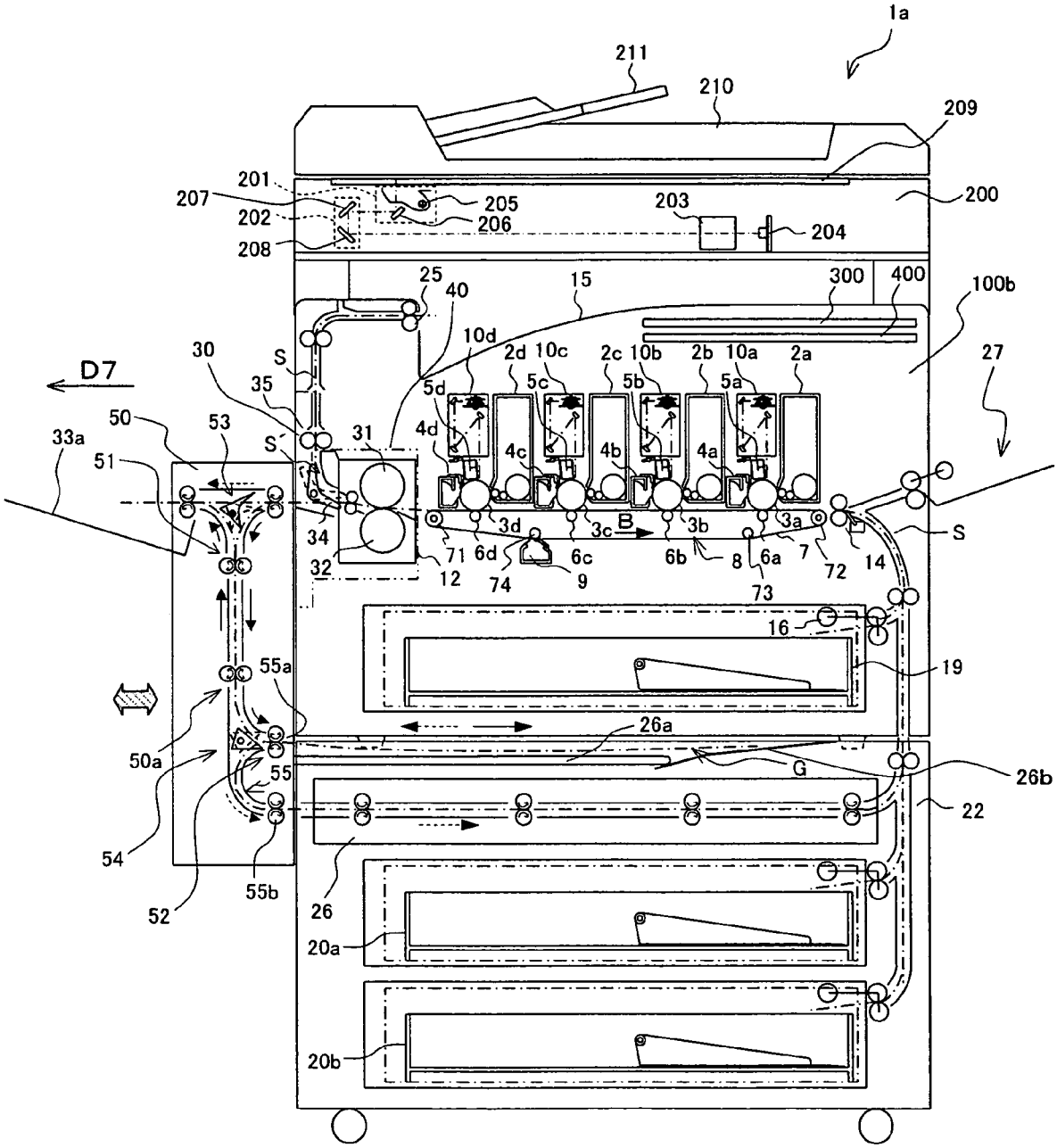
FIG. 20 shows an internal arrangement of an image forming system according to further another embodiment of the present invention.

As with the one shown in FIG. 20, the image forming system referred in the present embodiment is a multi-functional device 1*a* in which an image forming section and an image scanning device are unified. For ease of explanation, materials having the equivalent functions as those shown in the drawings pertaining to the first and second embodiments above will be given the same reference symbols in the following description, and explanation thereof will be omitted if not particularly required.

As shown in FIG. 20, the multi-functional device 1*a* of the present embodiment includes the automatic document carrying device 210, scanning means (image scanning device) 200, an image forming section (image forming device) 100*b*, a paper feeding desk unit 22, and an intermediate carriage device 50. Among these, the image forming section 100*b* includes two types of paper feeding trays, a paper feeding tray 19 and a manual paper feeding tray 27. Further, the paper feeding desk unit 22 includes the two-stage paper feeding trays 20*a* and 20*b*. The sheets from the respective paper feeding trays are carried through predetermined carriage paths, and the image forming section 100*b* forms a desired image on each sheet.

The multi-functional device 1*a* controls the image forming condition for each paper feeding tray. More specifically, the adjustment of image forming condition by the multi-functional device 1*a* is performed by forming a frame image for each size of the sheets from the respective trays. When the sheets are placed on the automatic document carrying device 210, scanning means 200 sequentially scans the images on the respective sheets, and the obtained correction values are inputted to the image forming section 10*b*. With these correction values, the multi-functional device 1*a* adjusts the image forming condition of the sheet for each paper feeding tray.

Further, in the multi-functional device 1*a* of the present embodiment, a sheet carried from a paper feeding tray passes through the intermediate carriage device 50 and the two-sided copying tray unit 26 so that the frame image is formed on the both side of the sheet.

Further, the image forming section 100*b* of the present embodiment deals with up to the maximum sheet size accepted in the image forming section 10*b*, among the standard sheet size range. However, it should be noted that the sheet size may be manually inputted through the control panel 220 so as to carry out accurate image forming even in the presence of slight differences in size between the respective sheets, changes in size through image forming, or the use of a non-standard size sheet.

Note that, in the multi-functional device 1*a* of the present embodiment, it is assumed for simplicity that the scanning means 200 is properly adjusted for the scanning scaling in advance. This is because a general image forming device is mechanically adjusted for the scanning scaling of the main scanning direction by a jig or the like at the stage of assembling in the factory. Further, the scaling of the sub-scanning direction depends on movement speed of the first and second scanning units upon scanning, and those first and second scanning units are operated by a wire reeled off by a pulley or the like that is created with high accuracy. In this view, the scaling of the sub-scanning direction is also already adjusted upon assembling of the device.

Here, the image forming section 100*b* of the present embodiment is provided with the manual paper feeding tray 27 that make the structure different from that of the image forming section 100 of the first embodiment. As another difference between the image forming section 100*b* from the image forming section 100, the image forming section 100*b* carries out printing with respect to both sides of the sheet, with the intermediate carriage device 50 and the two-sided copying tray unit 26 provided in the paper feeding desk unit 22.

Further, the paper feeding desk unit 22 of the present embodiment is provided with the two-sided copying tray unit 26 used for double-sided copying, that make the structure different from that of the paper feeding desk unit 20 of the first embodiment. Further, the paper feeding desk unit 22 provided with a different number of paper feeding trays from that of the paper feeding desk unit 20.

Here, the following describes the paper feeding desk unit 22 in detail. The paper feeding desk unit 22 is an optional unit, and includes the paper feeding trays 20*a* and 20*b* for storing sheets. The paper feeding trays 20*a* and 20*b* are compatible with various kinds of sheet, and one of the varieties is selected to be stored.

Further, the paper feeding desk unit 22 includes the two-sided copying tray unit 26. The two-sided copying tray unit 26, provided on the top of the paper feeding desk unit, sends a sheet whose one side is printed with an image to the image forming section 100*b* again, so as to allow the image forming section 100*b* to carry out printing on the other side of the sheet. The two-sided copying tray unit 26 is provided above the paper feeding trays 20*a* and 20*b*.

The two-sided copying tray unit 26 includes two paper inverting trays, a first tray 26*a* and a second tray 26*b*. The first tray 26*a* is supported by the intermediate carriage device 50. The second tray 26*b* is provided by being supported by an upper portion of the paper feeding desk unit 22. The second tray 26*b* supports the front end of the first tray 26*a*. The image forming section 100*b* is provided with rubber legs, that create a space between the image forming section 100*b* and the paper feeding desk unit 22, when the image forming section 100*b* is placed on the paper feeding desk unit 22.

The paper feeding desk unit 22 may be provided with other tray than the two-sided copying tray unit 26, for example, in the case of not requiring the two-sided image forming function. Note that, the image forming section 100*b* of the present embodiment is not limited to this arrangement with the three-stage paper feeding desk unit 22 shown in FIG. 20 but may be an arrangement with a low single-stage paper feeding tray, one having a tandem tray with two parallel trays, or one with a simple desk function. A suitable paper feeding desk unit may be selected from various kinds of desk devices according to user's purpose, budget etc.

Next, the following describes the intermediate carriage device 50. The intermediate carriage device 50 serves as an intermediate device for transferring the sheet discharged from the image forming section 100*b* to respective processing sections for carrying out various predetermined functions. The processing sections may be a discharge tray, a paper inverting tray, the two-sided copying tray unit of the paper feeding desk unit etc. In case of the present embodiment, the processing sections can be a discharge tray 33*a*, or the two-sided copying tray unit (intermediate tray) 26 of the paper feeding desk unit 22. The intermediate carriage device 50 is mounted to a paper discharge section of the image forming device 100*b*. The portion where the paper discharge section is provided corresponds to the portion where the discharge tray 33 of the image forming section 100 shown in FIG. 1 is provided.

The intermediate carriage device 50 includes a first inversion section 51 and a second inversion section 52. More specifically, the intermediate carriage device 50 includes a first inversion path 50*a* in which the first inversion section 51 and the second inversion section 52 are provided on the upper part and the lower part, respectively.

The first inversion section 51 serves to carry out inversion operation (switch-back operation) of the sheet so that the sheet is discharged to the discharge tray 33*a* with the surface facing down. Note that, the discharged sheet may be outputted to an optional post-processing device (not shown), instead of the discharge tray 33*a*.

The second inversion section 52 serves to perform inversion (switching-back) of a sheet in the case of forming an image on both sides of the sheet. More specifically, the second inversion section 52 leads the sheet to the first tray 26*a*, that is provided between the paper feeding desk unit 22 and the image forming device 10*b*, so as to inverse (switch-back) the sheet. Further, the first tray 26*a* and the second tray 26*b* of the paper feeding desk unit 22 constitute an inversion path.

Further, the intermediate carriage device 50 includes a first gate 53 and a second gate 54. Further, a carriage path 55 is provided from the second inversion section 52 to the two-sided copying tray unit 26 of the paper feeding desk unit 22. The carriage path 55 has an upper opening 55*a*, that is opened to the first tray. The carriage path 55 also has a lower opening 55*b*, that is connected to the two-sided copying tray unit 26.

Note that, the automatic document carrying device 210 and the scanning means 200 have the same structures as those explained in the first embodiment. The scanning means 200 operates together with the automatic document carrying device 210 so as to scan the image of the document automatically carried by the automatic document carrying device 210. Note that, though this is not explained in the first embodiment, the scanning means also scans the rear surface of the document carried by the automatic document carrying device 210, with a contact image sensor provided on the side of the automatic document carriage device 210, while scanning the front surface of the document by a CCD line sensor 204 etc. Otherwise, the scanning means 200 may be a so-called two-sided automatic document carrying device (RADF: Reversing Automatic Document Feeder). The two-sided automatic document carrying device first scans one side of a document, and then reverses the document and carries it to the scanning section (scanning area of the scanning means) again so as to scan the other side of the document. Thereafter, the data of the scanned image is transferred to the image forming section 100*b*. In the image forming section 100*b*, the image data is transferred to the image data input section 510 shown in FIG. 2, and is subjected to a predetermined processing in the image processing section 511 and than stored in the memory 512. Further, the image is read out from the memory 512 by the controlling means in response to the output instruction of the user that is detected in the control panel (not shown), and is transferred to the writing section 513, that forms an electrostatic latent image on the sheet based on the image data.

Next, the following describes a sheet used for adjustment of image forming condition. The sheet is printed in the image forming section 100*b* described above. The image forming section 100*b* of the present embodiment forms an image on the sheet with respect to an area including at least three corners of the sheet. In the following, a frame image is formed on an area including the circumference of the sheet.

In the case of a A4 sheet, the size of the outer frame of the frame image formed on the photoconductive drum 3 (3*a*, 3*b*, 3*c* or 3*d*) is determined in the following manner. The length in the main-scanning direction of the frame is set to, for example, 307 mm to be greater than 297 mm and to be not more than the effective image forming width. Further, the length in the sub-scanning direction is set to, for example, 430 mm to be greater than 420 mm. However, it should be noted that an excessively large image requires a larger image forming section 10*b*. In view of this problem, it is preferable that a certain error value of the target device of adjustment is found in advance through a test etc., and the frame image data is created with the width wide enough to ensure secure forming of a frame image with reference to the estimated carriage error. The created data is stored in the pattern storing section 506.

Further, the internal interval (corresponding to W3 of FIG. 4) of the frame image in the main-scanning direction is set to, for example, 180 mm, to be sufficiently smaller than 210 mm (i.e., 30 mm smaller), in the case of a A4 sheet. The internal interval (corresponding to L3 of FIG. 4) of the frame image in the sub-scanning direction is set to, for example, 267 mm, to be sufficiently smaller than 297 mm (i.e., 30 mm smaller). These determined sizes are only an example, and the present invention is not limited to the described size range.

In the present embodiment, the pattern storing section 506 stores plural patterns of image data corresponding to the respective sheets kept in the plural paper feeding trays (19, 20*a*, 20*b*, 27 etc.).

Further, the multi-functional device 1*a* of the present embodiment carries out image forming either one side or both sides of the sheet so as to find a correction value for adjusting the two-sided printing tray unit 26.

When the adjustment image is formed on one side of the sheet, a supplied sheet is sent to the two-sided printing tray unit 26 with no printing on a first side (one side). Then, the sheet is carried from the two-sided printing tray unit 26 to the image forming section for carrying out printing of the adjustment image on a second side (other side) of the sheet. Here, a mark (identification mark) is added to the second side to indicate that the sheet has been carried from the two-sided printing tray unit 26 and has been subjected to image forming.

On the other hand, when the adjustment image is formed on both sides of the sheet, a mark indicating the paper feeding tray where the sheet was stored is printed on the sheet together with the frame image. Then, the sheet is carried to the two-sided printing tray unit 26, and further carried from the two-sided printing tray unit 26 to the image forming section so as to carry out printing of the frame image and the mark for indicating that the sheet has been carried from the two-sided printing tray unit 26 and has been subjected to image forming.

Two-sided printing tray means, that is realized here as the two-sided printing tray unit 26, generally includes matching means for matching, for example, the positions of the respective sheets carried from the paper feeding trays. Therefore, the correction value found for the two-sided printing tray unit 26 may be adopted for any sheets of paper feeding trays. On this account, the correction value for the two-sided printing tray unit 26 may be found by performing image forming on one side of a sheet. More specifically, the adjustment image is printed on one side of each sheet from the plural paper feeding trays (19, 20*a*, 20*b* and 27), and also is printed on a sheet carried from one of the trays and has passed through the two-sided printing tray unit 26. Accordingly, the two-sided printing tray unit 26 for performing two-sided image forming can be regarded one of the paper feeding trays (sheet containing means). By thus printing the adjustment image only on one side of the sheet, the processing operation is required for only one side of the sheet. On this account, the sheets can be scanned all together when they are processed together by the scanning means 200 and the automatic document carrying device 210.

Meanwhile, in consideration of the provision of the matching means, the forming of adjustment image may be performed in such a manner that the adjustment image is formed on both sides of a sheet passing through the two-sided printing tray unit 26, and formed on only one side for the remaining sheets. However, as with the case above, if the printing of the adjustment image is performed on one side of the sheet in some cases, and on both sides in other cases, scanning of these sheets by the scanning means 200 for finding a correction value becomes complicated.

Further, another possible case is that the adjustment image is formed on both sides for all of the sheets. In this case, the adjustment may be performed in consideration of a matching error that may occur in the matching means upon matching of the various sizes of sheets from the respective paper feeding trays. However, such an error does not significantly affect the image forming, and printing on both sides of the sheet results in needless labor.

Next, the following explains the mark (identification mark) formed on the sheet together with the adjustment frame image.

The multi-functional device 1*a* of the present embodiment forms an identification mark on a sheet together with the adjustment frame image. The identification mark indicates that the sheet was carried from which paper feeding tray. The identification mark also indicates the carriage direction of the sheet (the direction of the formed image) in the image forming section 10*b*. When the sheet with the frame image is placed on the document setting tray 211 of the automatic document carrying device 210 by the user, the user places the sheet in a proper direction according to the identification mark.

Further, the present embodiment uses an identification mark of a rectangle pattern; however, the identification mark is not limited to this shape. For example, the mark may be an arrow shape in terms of visuality, which however requires a larger data memory when the pattern is stored in the pattern storing section 506. Further, when the scanning means 200 scans the sheet setting state, the mark of an arrow shape makes the judgment of scanning result more complex. For this reason, the present embodiment uses a simple rectangle pattern, which is formed to be closer to one side of the frame image.

Figure 21:
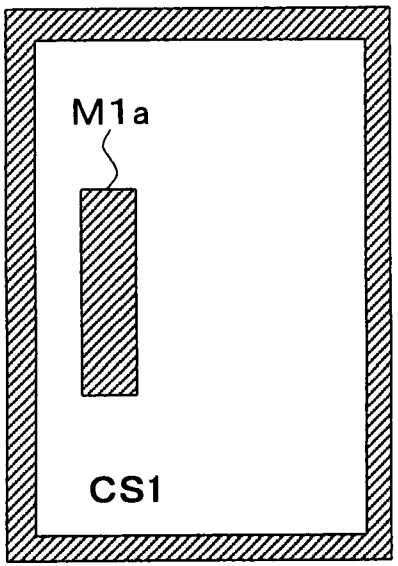
FIG. 21(*a*) is a plan view showing an example of a condition under which a frame image is formed on a sheet by the image forming device of the image forming system, and FIG. 21(*b*) is a plan view showing an example of a condition under which the frame image is formed on another sheet by the image forming device, and FIG. 21(*c*) is a plan view showing an example of a condition under which the frame image is formed on still another sheet by the image forming device.
Figure 21:
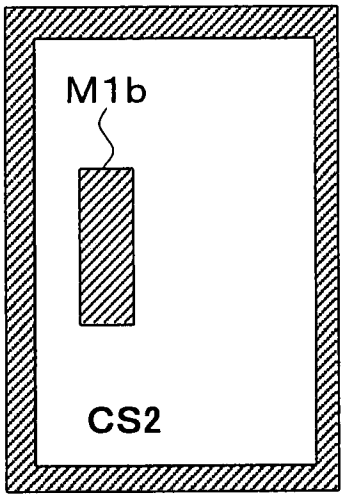
Figure 21:
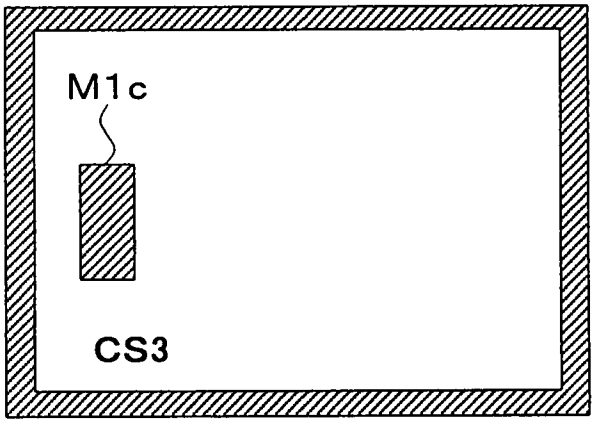
Figure 22:
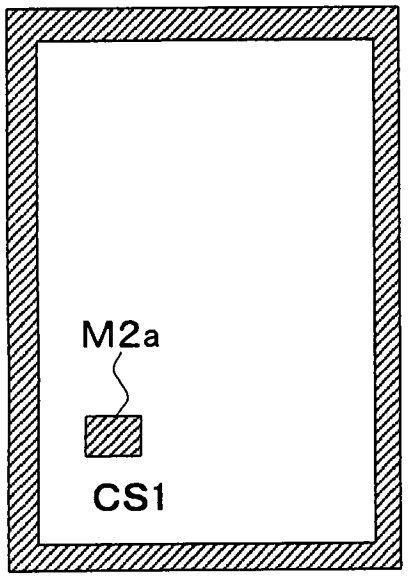
FIG. 22(*a*) is a plan view showing another example of a condition under which a frame image is formed on a sheet by the image forming device of the image forming system, and FIG. 22(*b*) is a plan view showing an example of a condition under which the frame image is formed on another sheet by the image forming device, and FIG. 22(*c*) is a plan view showing an example of a condition under which the frame image is formed on still another sheet by the image forming device.
Figure 22:
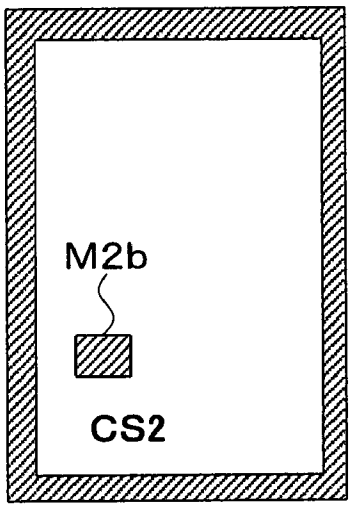
Figure 22:
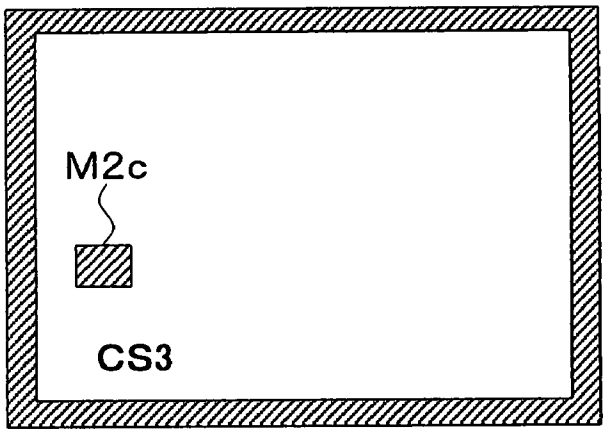
Figure 23:
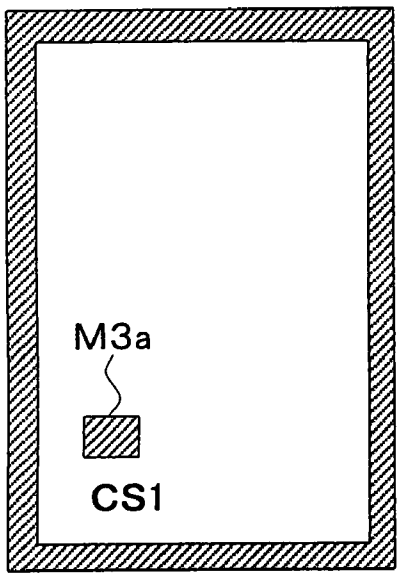
FIG. 23(*a*) is a plan view showing still another example of a condition under which a frame image is formed on a sheet by the image forming device of the image forming system, and FIG. 23(*b*) is a plan view showing an example of a condition under which the frame image is formed on another sheet by the image forming device, and FIG. 23(*c*) is a plan view showing an example of a condition under which the frame image is formed on still another sheet by the image forming device.
Figure 23:
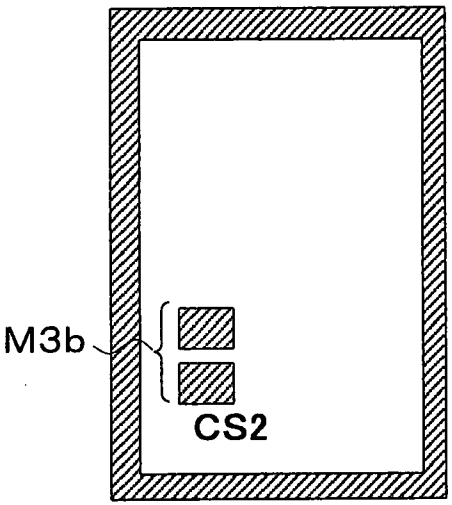
Figure 23:
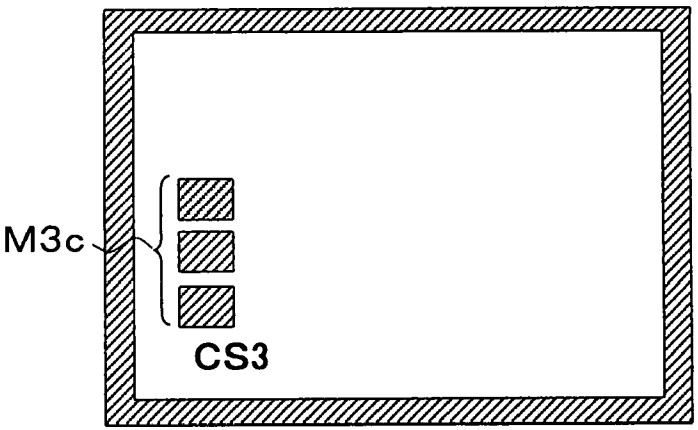
Figure 24:
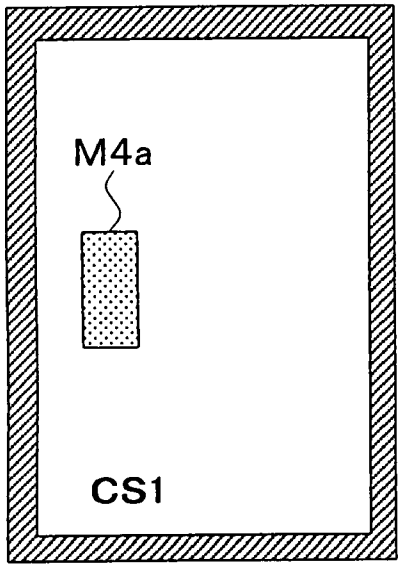
FIG. 24(*a*) is a plan view showing further another example of a condition under which a frame image is formed on a sheet by the image forming device of the image forming system, and FIG. 24(*b*) is a plan view showing an example of a condition under which the frame image is formed on another sheet by the image forming device, and FIG. 24(*c*) is a plan view showing an example of a condition under which the frame image is formed on still another sheet by the image forming device.
Figure 24:
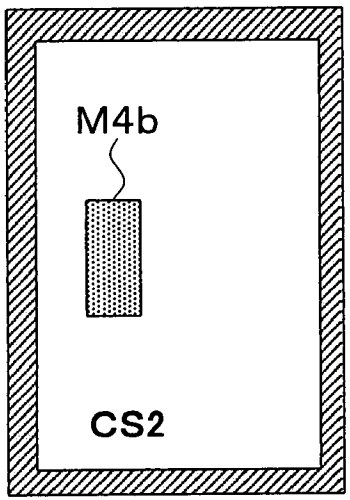
Figure 24:
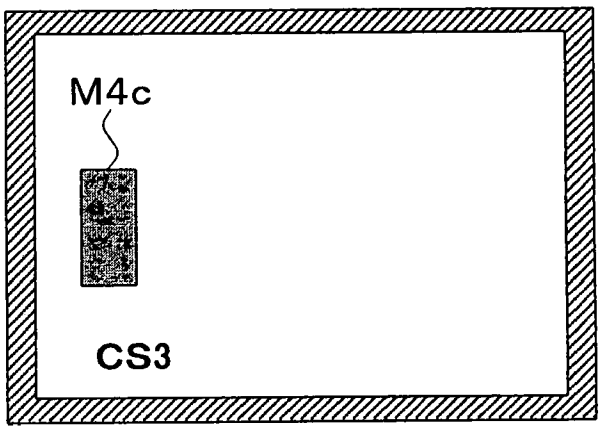
Figure 25:
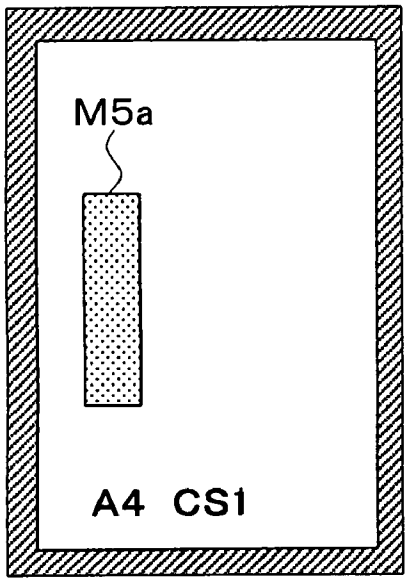
FIG. 25(*a*) is a plan view showing still further another example of a condition under which a frame image is formed on a sheet by the image forming device of the image forming system, and FIG. 25(*b*) is a plan view showing an example of a condition under which the frame image is formed on another sheet by the image forming device, and FIG. 25(*c*) is a plan view showing an example of a condition under which the frame image is formed on still another sheet by the image forming device.
Figure 25:
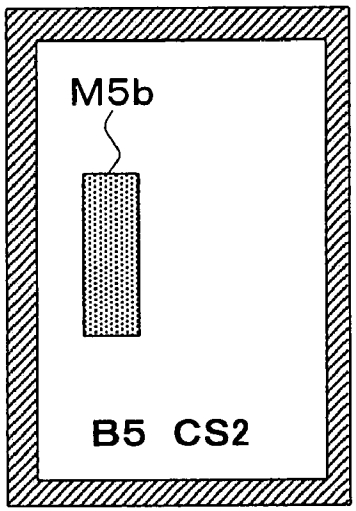
Figure 25:
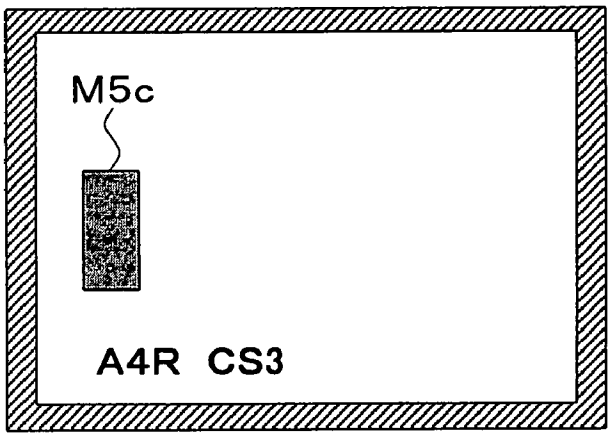
Figure 26:
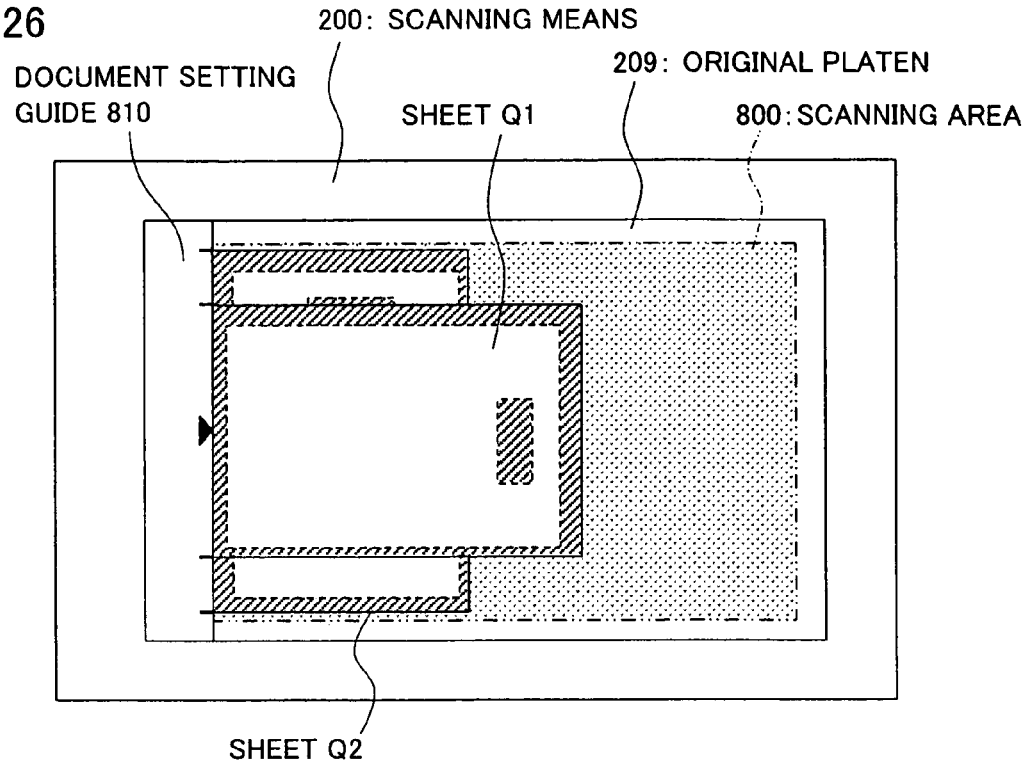
FIG. 26 is a plan view showing a sheet placed on the original platen of the image forming system under a condition different from the condition shown in FIG. 5.
Figure 27:
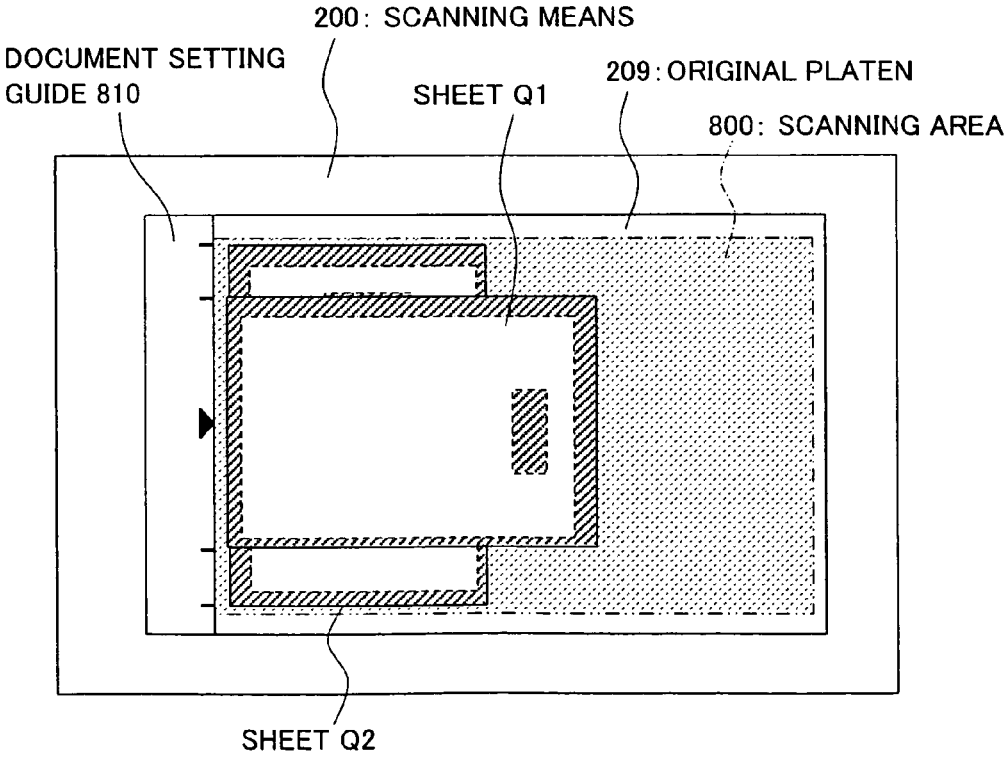
FIG. 27 is a plan view showing a sheet placed on the original platen of the image forming system under a condition different from the condition shown in FIG. 6.

FIGS. 21(*a*) through 21(*c*) show examples of adjustment sheet in which a direction mark (identification mark) is printed. The sheet is outputted from the image forming system 1*a* having the image forming section 100*b*.

FIG. 21(*a*) shows a A4 sheet in which a frame image and a direction mark M1*a* is formed, placed on the paper feeding tray 20*a* (cassette 1: CS1). FIG. 21(*b*) shows a B5 sheet in which a frame image and a direction mark M1*b* is formed, placed on the paper feeding tray 20*b* (cassette 2: CS2). FIG. 21(*c*) shows a A4R (horizontal setting) sheet in which a frame image and a direction mark M1*c* is formed, placed on the paper feeding tray 20*c* (cassette 3: CS3). As with these examples, each sheet from different paper feeding trays is provided with a corresponding identification mark different in size for identifying the paper feeding tray. As with the examples shown in FIGS. 21(*a*) through 21(*c*), provision different sized direction marks M1*a* through M1*c* corresponding to the respective paper feeding trays indicates that the sheet is carried from which paper feeding tray.

Further, the direction mark may also be used for identification of the sheet size. In this case, when scanning is performed with respect to the sheets different in size that are carried from the automatic document carrying device 210, so as to find correction values, the sheet size may be easily found out with reference to the direction mark, thereby effectively performing the scanning. Further, to allow the user to easily recognize the identification of the paper feeding tray, each sheet may have a printed character string (e.g. CS1, CS2, CS3 etc.) corresponding to the paper feeding tray.

The direction mark formed by the image forming section 100*b* is not limited to those described above. For example, as with the marks M2*a* through M2*c* shown in FIGS. 22(*a*) through 22(*c*), the direction marks may be provided on the predetermined positions of the sheet, with the same distance from the corner of the sheet. Further, as with the marks M3*a* through M3*c* shown in FIGS. 23(*a*) through 23(*c*), the respective marks, that are formed with a predetermined area, may differ in number for each of the sheet. As described, the image forming section 100*b* may print the direction marks same in area but different in number or positions so as to indicate that the respective sheets are carried from which of the paper feeding trays. Further, as with the marks M4*a* through M4*c* shown in FIGS. 24(*a*) through 24(*c*), the images of respective marks may differ in color density for each of the sheet. Further, if the device is a color image forming device as with the image forming device 100*b*, the direction marks may differ in color so as to identify the paper feeding trays by the color.

Further, the described arrangements for differentiating the respective direction marks may be adopted as a combination. That is, as with the marks M5*a* through M5*c* shown in FIGS. 25(*a*) through 25(*c*), the respective marks may differ in color density and in size.

Further, as described above, one assumable case is that the user is in error in judging the sheet carriage direction, and set the sheet on the automatic document carrying device 210 in a wrong direction. To handle such a case, the multi-functional device 1*a* of the present embodiment may be arranged so that the scanning means 200 scans the image on the sheet, and the controlling means 500 of the image forming section 100*b* detects the sheet setting direction and finds an accurate correction value.

More specifically, as shown in FIG. 5, the sheet Q1 is placed on the automatic document carrying device 210 by the user in an appropriate direction. Then, the sheet is carried from the automatic document carrying device 210 to be placed on the original platen 209 in the state shown in the figure. However, even if the sheet is placed on the original platen in the state shown in FIG. 26, the controlling means 500 of the image forming section 100*b* detects the sheet setting direction and finds an accurate correction value. Similarly, when the sheet is placed on the original platen 209 with a gap between the document setting guide 810 and the edge of the sheet Q1 as shown in FIG. 6, the sheet may also be placed in the state shown in FIG. 27. In this case, the controlling means 500 of the image forming section 100*b* detects the sheet setting direction and finds an accurate correction value. As described, the control means 500 may automatically detect the sheet setting direction.

Note that, the outputted sheet may be placed directly on the original platen 209 for scanning without using the automatic document carrying device 210. In this case, for example, the LCD 221 of the control panel 220 displays a guidance to get the user to place a sheet on the original platen 209. The sheet is brought into contact with the document setting guide (document reference member) 810 so as to be accurately placed on the original platen 209.

However, in this case, there are some difficulties in dividing the document setting guide 810 and the sheet, and may decrease the scanning accuracy. However, if the image forming condition of the sheet is not severe, for example, if it allows a position error of approximately ±0.5 mm in forming the image on the sheet, the decrease of the scanning accuracy does not practically cause significant influence. On the other hand, if the image forming condition of the sheet is severe, in order to carry out secure scanning including the edge of the sheet, the sheet is set on the original platen 209 by placing the edge away from the document setting guide 810. In this case, to ensure secure scanning of the rear edge of the sheet, the image scanning area of the scanning means 200 is extended in the sub-scanning direction. When scanning of a sheet is completed, the LCD 221 of the control panel 220 displays a screen of two choices: to finish the scanning and carry out adjustment, or to continue the scanning and scan the next sheet. With this display, the user decides the next operation.

Note that, as with the case explained above, when the outputted sheet is automatically carried by the automatic document carrying device 210 to be subjected to scanning, no concern is necessary for the foregoing problem, as the sheet can be properly set in the accurate position.

Next, the following explains scanning operation by the scanning means 200. As described above, the scanning means 200 scans one side of the document with a CCD line sensor 204 or the like provided under the original platen 209, while also scanning the other side of the document with a contact image sensor provided on the side of the automatic document carrying device 210, i.e., above the original platen 209. Here, it may occur that scanning is carried out to the sheet slightly inclined due to, for example, inadequate paper supply. Further, it may also occur that the sheet is slightly inclined when placed on the original platen 209. The following explains an example of this case. This example assumes that the sheet Q0 of FIG. 4 is inclined when placed on the original platen.

In this case, the width W0 of the sheet Q0 in the main-scanning direction is measured at two or more points of the sub-scanning direction (the direction L0 in FIG. 4), so as to detect inclination of the sheet. For example, the scanning start point and the scanning end point of the width W0 are detected at different points, so as to find inclination of the sheet Q0. If the measured widths of the W1 differ in the respective positions, it indicates that the sheet is inclined. By taking the inclination into account, it is possible to find a correction value for modifying the width of W1 obtained by the scanning, and for adjusting the writing timing in the main-scanning direction. This method may also be used for adjustment of the sub-scanning direction. Further, this method also enables measurement of such as inclination of the image with respect to the sheet, thereby adjusting the inclination of the image to be formed by the image forming section 100*b*.

Further, it is preferable that the distance or position of the edge of frame image formed in the main-scanning direction is scanned at three or more points in the sub-scanning direction. With this arrangement, if the main-scanning line of the image forming section (image forming device) 100*b* is curved, error correction can be properly carried out with secure detection of the curve. In contrast, if the scanning is carried out at two points, the detection of the curve may be failed, or the curve may be detected as inclination of the line. Note that, in an arrangement in which the writing unit adopts a laser scanning method, the scanning line is curved in some cases depending on the inclination degree of the incident angle of the laser beam with respect to the deflecting means, or the optical characteristics of the lens system. Further, in an arrangement in which the writing unit adopts a solid-body scanning method with an optical LED head or the like, the scanning line can be curved due to such as non-linear alignment of the light emitting section, or arcuation of the optical writing unit caused by external force etc.

As described, the image data (frame image, direction mark) of the sheet is scanned by the scanning means 200, and is sent to the calculating means 600 by the controlling means 500 via the image data input section 510. The calculating means 600 calculates a correction value for modifying image forming condition of the image forming section 100*b* with respect to the sheet.

Here, the correction value for modifying image forming position with respect to the sheet is calculated for each sheet. On the other hand, the correction value for modifying the image forming scaling with respect to the sheet is calculated for one of the sheets, since the image forming scaling is the same for all sheets of the respective paper feeding trays in the image forming using a single image forming station. On this account, a correction value found for one sheet carried from one of the paper feeding trays may also be used as a correction value for the sheets carried from the other paper feeding trays. In this manner, number of the calculation for finding the correction value can be reduced (calculation for the other sheets can be omitted), thus reducing processing time and working time.

Note that, the calculation of the correction value for modifying the scaling ratio can be performed with a single calculation for finding a correction value of a sheet supplied from a certain paper feeding tray. However, in practice, the calculation result will be the same for any sheets from the respective paper feeding trays. The correction value is however preferably found by using a sheet from paper feeding tray storing large size sheets. In this manner, the correction accuracy slightly increases.

Figure 28:
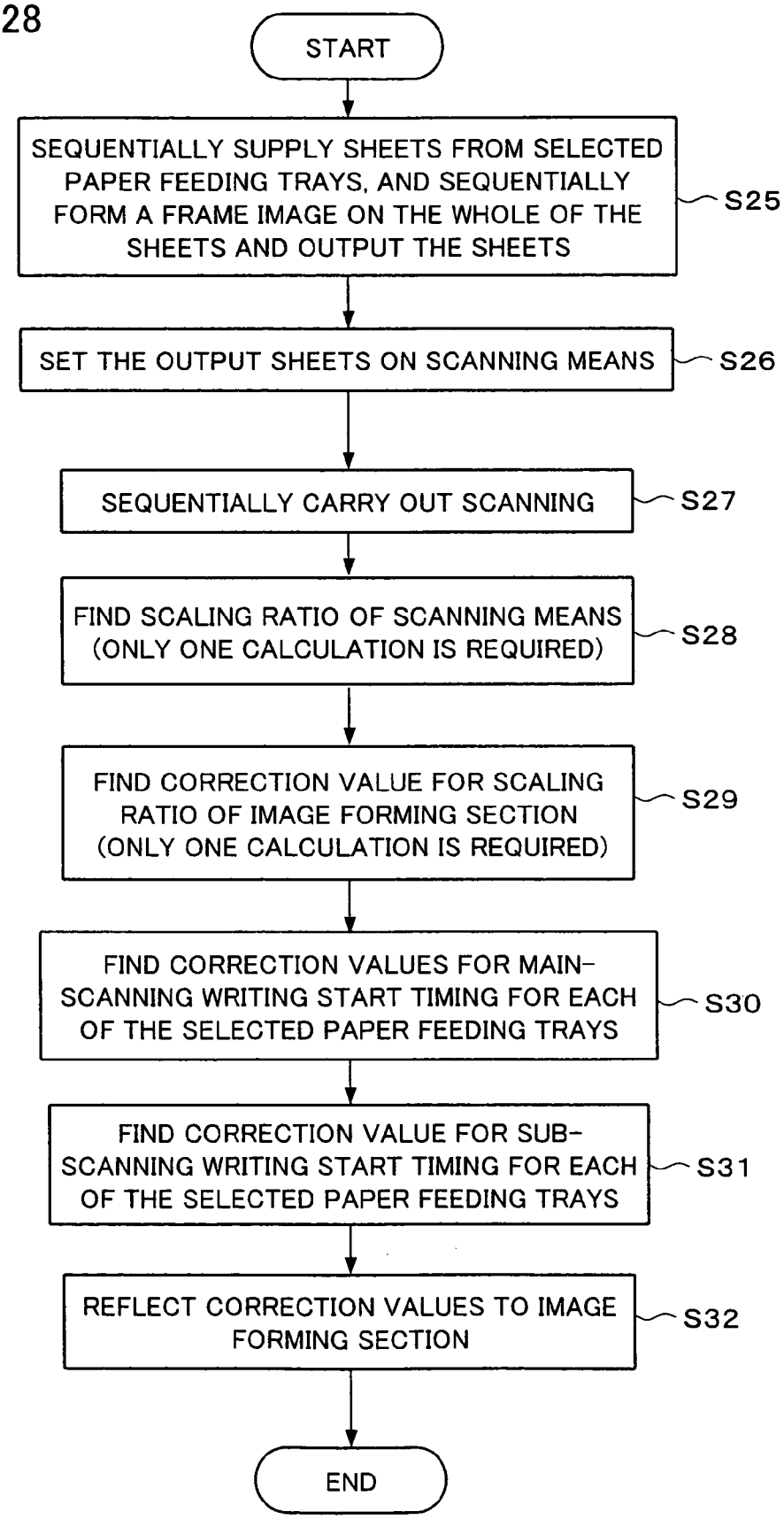
FIG. 28 is a flowchart illustrating an adjustment operation of the image forming system.

Next, with reference to FIG. 28, the following more specifically describes a flow of adjustment operation for image forming condition of the image forming section 100*b*.

In the step S25, the controlling means 500 of the image forming section 100*b* sequentially selects paper feeding trays of the multi-functional device 1*a*. The selected tray supplies a sheet that is subjected to printing of the frame image and the direction mark. Here, FIG. 3 shows a reference image P as a concrete example of the frame image formed on the photoconductive drum 3 and transferred to the sheet N and the transfer belt 7. FIG. 4 shows a sheet Q0 as an example of the sheet with the transferred image, in which the image is formed on the whole circumference.

Then, upon detection of the setting of the sheet on the scanning means 200, that is informed by the user or by a document detecting means (not shown) of the scanning means 200 (S26), the scanning means becomes ready for scanning. Then, in response to a start signal that is generated when the user presses the start key 241, the automatic document carrying device 210 sequentially carries the sheets to the scanning area of the scanning means 200, and the scanning means 200 scans the images (frame image, direction mark) formed on the sheets (S27). As described, the scanning means 200 of the present embodiment includes the automatic document carrying device 210, that enables sequential scanning of the plural sheets from the respective paper feeding trays, with a single pressing of the start key 241.

Here, as described, the scanning means 200 scans the frame image and the direction mark, as with the ones shown in FIG. 4, of the sheet in the step S27. With this operation, the respective sheet sizes are found.

Then, a scanning scaling of the scanning means 200 is found in the step S28. More specifically, the data stored in the data storing section 507 is compared with a predetermined size obtained through scanning of the scanning means 200, and the calculating means 600 finds a scaling correction value of the scanning means 200. This correction value of scanning scaling of the scanning means 200 is identical for the all sheets, and therefore the calculation is performed for only one sheet.

Next, a scaling correction value for the image forming section 100*b* is found in the step S29. More specifically, the accurate size of the image printed on the sheet is found according to the scaling correction value (found in the step S28) of the scanning means 200. Then, the calculating means 600 compares the resulting size with the size of the corresponding pattern stored in the pattern storing section 506, so as to find a scaling correction value for modifying the image forming scaling of the image forming section 100*b*. In the case of performing image forming of the frame image with a single image forming station, the calculation of the scaling correction value is performed for only one sheet.

Next, a correction value for modifying the writing position of the image forming section 100*b* is found in the steps S30 and S31. More specifically, the calculating means 600 finds a correction value for modifying the timing of writing an electrostatic latent image in the writing section 513. Further, the calculating means 600 finds inclination of the image formed on the sheet, and further finds a correction value for modifying the inclination. This process for finding these correction values does not necessarily have to be carried out in order of (1) S30, (2) S31, but may be carried out in order of (1) S31, (2) S30.

In the step S32, the correction value found through the foregoing operation is reflected to the image forming section 10*b*, and the operation flow is completed.

Further, for ease of explanation, the foregoing description of the operation flow does not mention a separate adjustment for each image forming station; however, the adjustment may be carried out for each image forming station, as described in the first embodiment.

Figure 29:
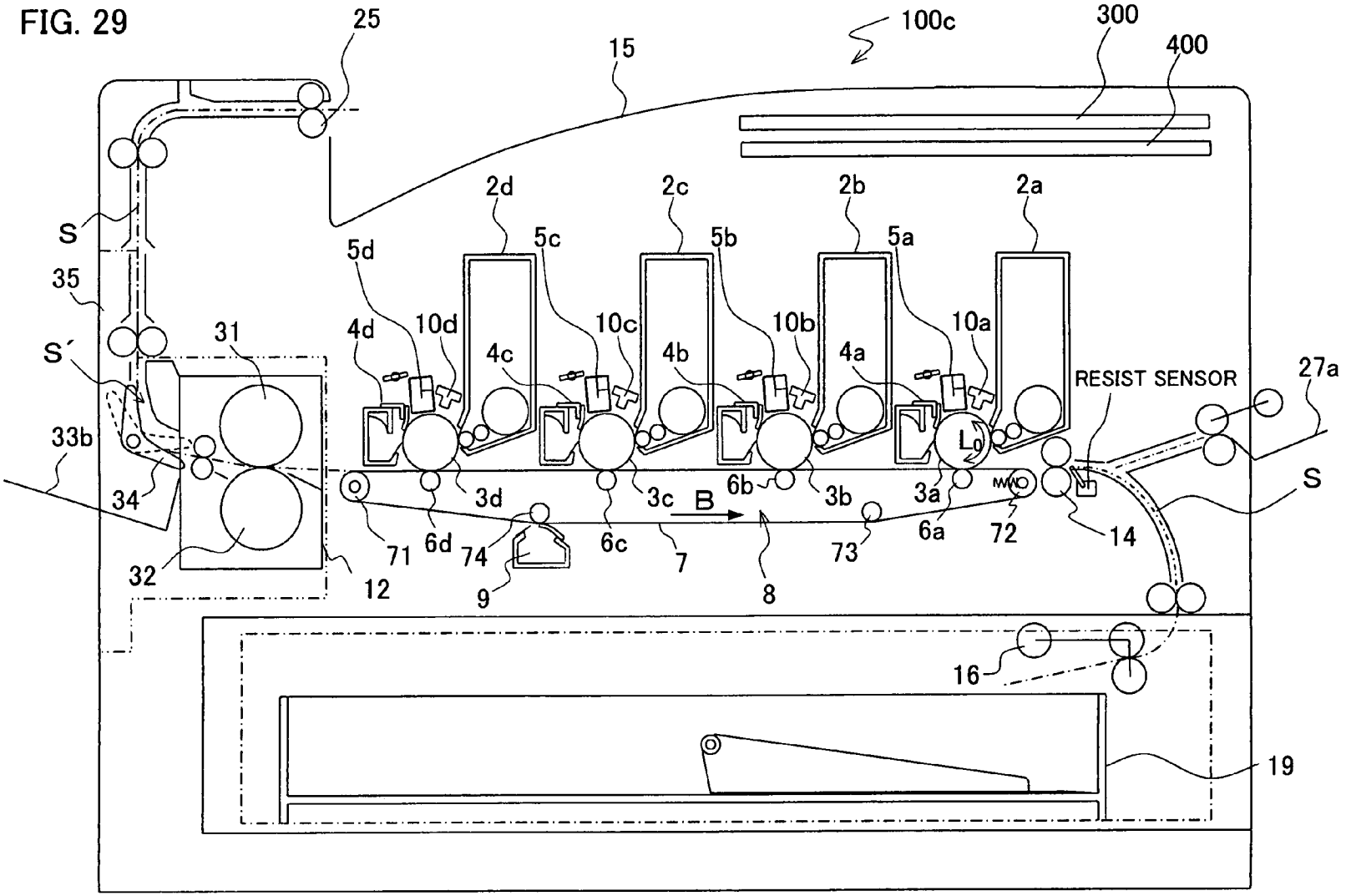
FIG. 29 is a cross sectional view schematically showing a modification example of the image forming device.

Further, the structure including a plurality of paper feeding trays is not limited to the multi-functional device 1*a* of FIG. 20, but may be, for example, the image forming section 100*c* of FIG. 29. In contrast to the image forming section 100 of FIG. 1, the image forming section 100*c* additionally includes a manual paper feeding tray 27*a*. In this case, the scanning means 200 (not shown) is provided on the image forming section 100*c* to create a multi-functional device.

The image forming section 100*c* includes the manual paper feeding tray 27*a* and the paper feeding tray 19. The frame image and the direction mark are formed on the sheet supplied from the two paper feeding trays, as with the image forming section 100*b* of the multi-functional device 1*a*. Then, the scanning means 200 scans the images so as to find a correction value. The correction value is reflected to the image forming section 100*c*, thus modifying the image forming condition.

As described, the multi-functional device 1*a* of the present embodiment carries out image forming on a sheet by sequentially carrying sheets from the plural paper feeding trays, and adding to each sheet a predetermined direction mark (identification mark) corresponding to the paper feeding tray, in the image forming section 100*b* or 100*c*. Thereafter, the image formed on the sheet is scanned by the image scanning means 200, and a correction value for modifying the image forming condition with respect to each sheet of the plural paper feeding trays is found. Then, the image forming section 100*b* or 100*c* of the multi-functional device 1*a* is adjusted according to the correction values.

Here, in an image forming device including a plurality of paper feeding trays, the condition (printing position, printing scaling) of the image forming section in forming image on the sheet generally differs among the respective paper feeding trays.

Such a difference occurs because, for example, the containing positions of the sheets slightly differ among the respective paper feeding trays. Specifically, if there is any difference in containing position among the sheets of the respective paper feeding trays, the scanning position error in the main-scanning direction cannot be adjusted even when the inclination in carrying the sheet or writing timing is corrected by the resist means. As described, in a recent device, the error in the main-scanning direction may be adjusted by moving the image data to the proper writing position. In an analog device, the position of the sheet was adjusted in each paper feeding cassette so as to ensure that the sheet touches the resist roller. Since digital devices are mostly used there days, the difference can be corrected by adjusting the data writing position.

Further, such an error among the respective paper feeding trays may occur also in the path for carrying the sheets from the paper feeding trays to the image forming section. In this view, the image forming condition may differ depending on the path for carrying the sheet from the paper feeding tray to the image forming section. This carriage path may be the inversion path used for two-sided printing.

Strictly, the adjustment of the error needs to be carried out again when A3 sheets in a paper feeding tray of the multi-functional device 1*a* are replaced to A4 sheets, for example. Similarly, when a first tray and a second tray of the plural paper feeding trays both contain A4 sheets, the adjustment is required for each tray. Such adjustments can be easily carried out with the multi-functional device 1*a* of the present embodiment, which carries out adjustment of the different paper feeding trays by sequentially outputting the plural types of sheets having the printed frame images by a series of push-button operation, and scanning the outputted sheets at once.

In this case, each sheet is provided with an identification mark which indicates that the sheet was carried from which paper feeding tray. On this account, it is possible to obtain the error for each paper feeding tray upon scanning. The data of the error for each paper feeding tray is stored in the image forming section.

Further, results of two-sided printing using the two-sided printing tray unit 26 also slightly differ depending on which paper feeding tray sends the paper first. For example, when the sheet is carried from a tray to the image forming section via the two-sided printing carriage path, the condition (such as an error) may differ between the case where the sheet is carried from the first tray, and the case of where the sheet is carried from the second tray. More specifically, the condition, such as an error, differs depending on the paper size of the respective trays, or whether the sheet was carried from which paper feeding tray. In this view, the frame image may be formed on both sides of the sheet when the sheet is carried via the two-sided printing carriage path, so as to carry out adjustment in consideration of the difference among different paper feeding trays.

On the other hand, in consideration of the use of the matching means of the two-sided printing tray unit 26, the adjustment may be carried out by supplying a sheet from one of the paper feeding trays via the two-sided printing tray unit 26, and forming a frame image on the sheet.

Further, the present invention is not limited to the structure of printing a frame image on one sheet for each tray, but may be arranged so that the frame image is printed on a plurality of sheets for each tray. In this case, adjustment is performed by taking the average of the data from the plural frame images, thereby improving accuracy in adjustment.

Further, the present invention is not limited to the structure using the automatic document carrying device 210 together with the scanning means 200 when the frame image printed on the sheet is scanned. However, since the automatic document carrying device 210 enables sequential scanning of a plurality of sheets, it eases the adjustment in the foregoing manner.

With the variety of image forming in recent years, an image forming device is often provided with multiple-stage sheet containing means in view of efficiency in using the plural types of sheets. Such an image forming device carries out adjustment of the image forming position with respect to the sheet for each stage of the sheet containing means. Particularly, the image forming position with respect to the sheet needs to be adjusted for each stage of the multi-stage sheet containing means since the carrying condition of the sheets differ from each other among the respective stages, which makes the sheets to be placed on different positions in the image forming section. When the sheet with the formed image is provided with a mark indicating that the sheet is supplied from which stage of the containing means, it helps to carry out proper adjustment. However, it takes long time and requires much of work to manually adjust the position or the scaling in image forming for each sheet from the respective stages of sheet containing means.

In view of this problem, the present invention provides an adjustment method for an image forming device, in which different reference images are created for each sheet supplied from the respective sheet containing means. With this arrangement, when the adjustment object is scanned by the image scanning means, it is possible to easily recognize that the correction value to be found is used for which sheet containing means Further, when calculation of the correction values are performed sequentially for the plural sheet containing means, it is possible to securely and efficiently find plural correction values at once in a short time by sequentially creating and scanning the respective adjustment objects for image forming by an image forming device and an image scanning device. The present invention also provides an image forming device using this adjustment method.

Note that, the afore-mentioned publication of Japanese Laid-Open Patent Application Tokukaihei 10-4493 does not disclose the method of carrying out adjustment for both sides of the sheet, or the method of simultaneously adjusting a plurality of paper feeding trays. The multi-functional device 1*a* of the present embodiment simultaneously adjusts a plurality of trays; however, the present invention is not limited to this arrangement for adjusting all of the plural trays at once, but may be arranged so that the adjustment is performed individually for each tray, or with respect to some of the trays. However, the number of push-button operations may be reduced in the simultaneous adjustment.

FOURTH EMBODIMENT

Still another embodiment of the present invention is described below with reference to FIG. 30. A multi-functional device of the present embodiment includes a monochrome image forming section and scanning means. That is, each of the aforementioned embodiments gave description by using the color image forming device which can form a color image and the color scanning device which can scan the color image as an example. However, it is needless to say that it is possible to obtain the similar effect also by using a monochrome image forming device which can form only a monochrome (black and white) image and a monochrome image scanning device which can obtain only monochrome scanning data.

Figure 30:
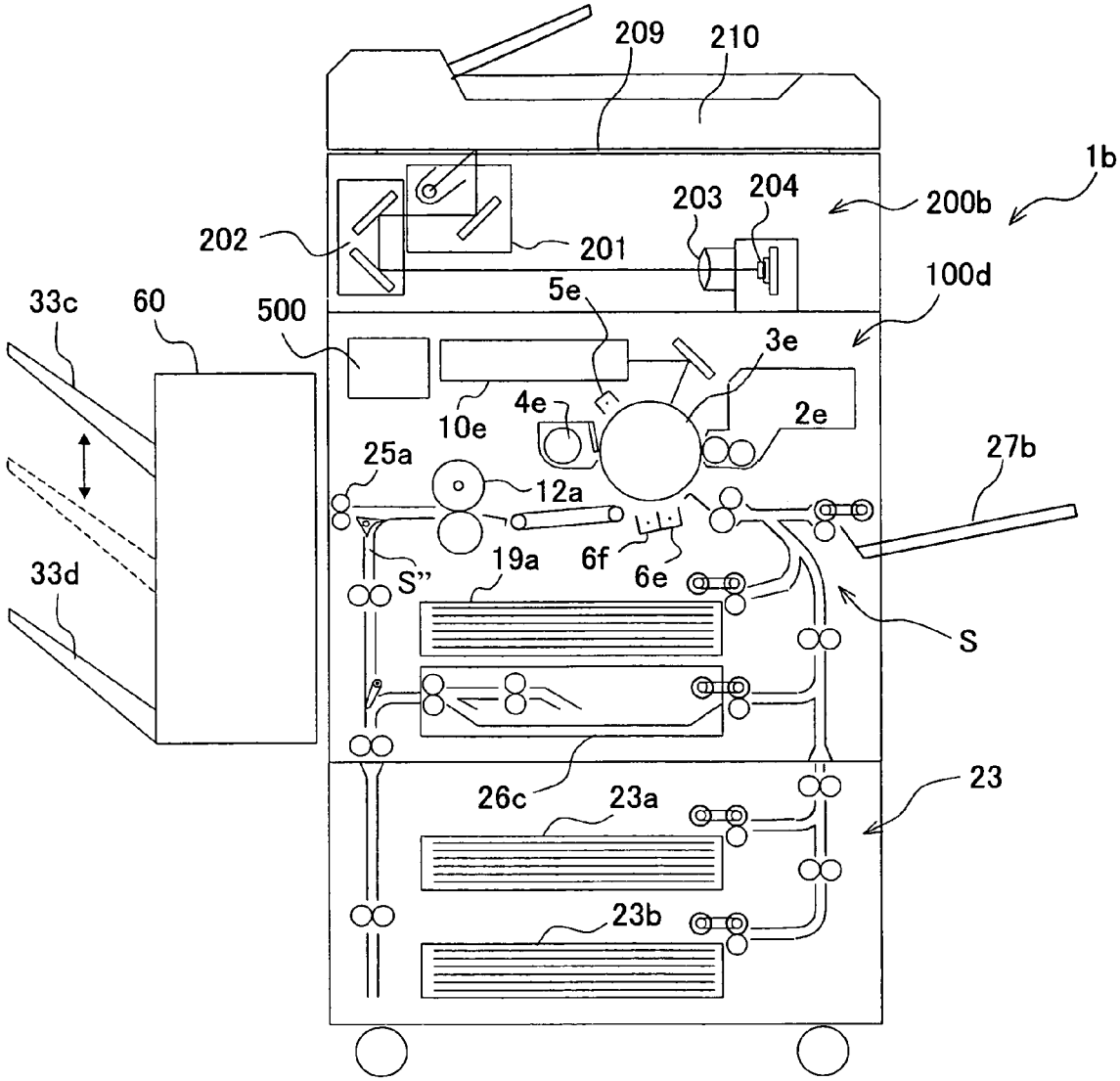
FIG. 30 shows an internal arrangement of an image forming system according to still further another embodiment of the present invention.

A multi-functional device (image forming system) 1*b* of the present embodiment is arranged so that the image forming device and the image scanning device are integrally provided therein as shown in FIG. 30. The multi-functional device 1*b* is an example of a multi-functional device for forming a monochrome (monotone) image. Further, the multi-functional device 1*a* is arranged so that the monochrome image scanning device (image scanning device provided with a 1-line image sensor) is unified with the monochrome image forming section. Note that, it is general that a monochrome image scanning device is unified with a monochrome image forming section. In the following description, devices and members having the equivalent arrangements and functions as those described in the first to third embodiments above will be given the same reference symbols, and explanation thereof will be omitted if not particularly required.

As shown in FIG. 30, the multi-functional device 1*b* schematically includes the automatic document carrying device 210, scanning means (image scanning device) 200*b*, an image forming section (image forming device) 10*d*, a paper feeding desk unit 23, and a post-processing device 60.

The multi-functional device 1*b* includes the automatic document carrying device 210 on an upper portion. The automatic document carrying device 210 is provided on the upper surface of the original platen 209 of a transparent glass. The automatic document carrying device 210 automatically carries a plurality of documents placed on the document setting tray one by one to the original platen 209.

The scanning means 200*b* is monochrome scanning means. The scanning means 200*b* is disposed on a lower portion of the original platen 209. The scanning means 200*b* scans images of the sheet placed on the original platen 209. The scanning means 200*b* includes a first scanning unit 201, a second scanning unit 202, an optical lens 203, and a CCD line sensor 204 as a photoelectric conversion element. The first scanning unit 201 is made up of an exposure lamp unit for exposing the document surface, and a first mirror for reflecting an optical image obtained from the sheet toward a predetermined direction. The second scanning unit 202 includes a second mirror and a third mirror that lead the light having been reflected on the first mirror to the CCD line sensor 204 serving as a photoelectric conversion element. The optical lens 203 forms an image from the reflection light of the document on the CCD line sensor 204.

Further, the scanning means 200*b* operates together with the automatic document carrying device 210 so as to scan, at a predetermined exposure position, the image of the document automatically carried by the automatic document carrying device 210. As described above, the scanning means 200*b* also scans the rear surface of the document carried by the automatic document carrying device 210, with a contact image sensor provided on the side of the automatic document carriage device 210, while scanning the front surface of the document by the CCD line sensor 204 etc. Otherwise, the scanning means 200*b* may be a so-called two-sided automatic document carrying device (RADF: Reversing Automatic Document Feeder). The two-sided automatic document carrying device first scans one side of a document, and then reverses the document and carries it to the scanning section again so as to scan the other side of the document.

The document image scanned by the scanning means 200*b* is transferred to an image data input section (not shown) as image data, and is subjected to a predetermined processing, and then temporarily stored in a memory of the image processing section. Further, the image is read out from the memory in response to the output instruction, and is transferred to an exposure unit (laser writing unit) 10*e* serving as an optical writing device of the image forming section 100*d*.

The exposure unit 10*e* includes: a semiconductor laser light source for emitting a laser beam in accordance with image data scanned from the memory or image data transferred from an external device; a polygon mirror for performing isogonal velocity polarization with respect to the laser beam; an f-θ lens for performing correction so that the laser beam polarized at isogonal velocity is polarized on the photoconductive drum 3*e* at isogonal velocity; and the like. Note that, the laser writing unit is used as the writing device in the present example, but it is possible to use a solid-body scanning type optical writing head unit using a light emission array such as an LED and an EL.

The image forming section 100*d* additionally includes, around the photoconductive drum 3*e*, a charger 5*e* for charging the photoconductive drum 3*e* to a predetermined potential, a developing device 2*e* for supplying toner to the electrostatic latent image formed on the photoconductive drum 3*e* so as to visualize the electrostatic latent image, a transcribing roller (transcriber, transcribing charger, or the like) 6*e* for transcribing the toner image formed on the surface of the photoconductive drum 3*e* onto a recording paper, an electricity remover (electricity removing charger or the like) 6*f*, and a cleaner unit 4*e* for collecting residual toner. The recording paper on which the image has been transcribed by the image forming section 100*d* is transferred to the fixing unit 12*e*, and the image is fixed on the recording paper.

In addition to the fixing unit 12*a*, (i) a switch back path S" for reversing the recording paper back to front so as to form an image on the rear surface of the recording paper and (ii) a post processing device 60, performing a stapling processing and the like with respect to the recording paper having the image, which includes a lifting tray 33*c* and a discharge tray 33*d*, are provided on the discharging side of the image forming section 100*d*. The sheet on which the toner image has been formed by the fixing unit 12*a* passes through the switch back path S" and is led to the post processing device 60 by the discharge roller 25*a*. After being subjected to a predetermined processing, the sheet is discharged.

On a lower portion of the image forming section 100*d*, a paper feeding section is provided. The paper feeding section includes a manual paper feeding tray 27*b*, a both-side tray unit 26*c*, and a paper feeding tray 19*a*, that are provided on the housing. Further, a paper feeding desk unit (multi-stage paper feeding section) 23 is provided below the image forming section 10*d*. A paper fed from any one of these paper feeding trays 19*a*, 23*a*, 23*b*, and 27*b* is carried to a position, where the transcribing roller 6*e* carries out the transcription in the image forming section 100*d*, by the carrying means. The both-side tray unit 26*c* leads to the switch back path S" for reversing the recording paper, and is used in forming images on both sides of the recording paper. Note that, the both-side tray unit 26*c* can be replaced with an ordinary sheet cassette, so that it is possible to use the ordinary sheet cassette instead of the both-side tray unit 26*c*.

As in the multi-functional device 1 described in the first embodiment, the multi-functional device 1*b* arranged in the foregoing manner causes the image forming section 100*d* to form a monochrome image (frame image, direction mark) onto a sheet, and causes the scanning means 200*b* to scan the image so as to obtain a correction value, so that it is possible to correct an image forming condition of the image forming device 100*d* by using the correction value.

Further, as in the multi-functional device 1 described in the second embodiment, the multi-functional device 1*b* arranged in the foregoing manner causes the image forming section 100*d* to form a monochrome image (frame image, direction mark) on a sheet, and causes the scanning means 200*b* to scan the image so as to obtain a correction value, so that it is possible to correct an image forming condition of the image forming section 100*d* and a scanning condition of the scanning means 200*b* by using the correction value.

Further, as in the multi-functional device 1*a* described in the third embodiment, the multi-functional device 1*b* arranged in the foregoing manner causes the image forming section 100*d* to form a monochrome image (frame image, direction mark) on a sheet carried from each paper feeding tray, and causes the automatic document carrying device 210 and the scanning means 200*b* to scan the image so as to obtain a correction value, so that it is possible to correct an image forming condition of the image forming section 100*d*.

As described above, the present invention relates to an adjustment method for an image forming device and an image forming device using the adjustment method, and particularly relates to (i) a method for adjusting a condition under which an image forming device based on an electrophotography system forms an image on a sheet and (ii) an image forming device which performs adjustment using the method. Further, the present invention provides (a) an adjustment method by which it is possible to adjust an image scanning device without using a reference chart, (b) an adjustment method by which it is possible to adjust both the image scanning device and the image forming device substantially at the same time, i.e., it is possible to adjust the image scanning device and the image forming device by scanning one by one sheets having images outputted from the image forming device not having been adjusted, and (c) the image scanning device and the image forming device using the adjustment method. Further, the present invention relates to an image scanning device and an image forming device based on an electrophotography system, and particularly relates to a method for adjusting a scanning position and a position in which an image is formed on a sheet, and to a multi-functional device in which the image scanning device is provided on the image forming device using the method.

In contrast, a conventional adjustment method for an image forming device focuses only on correction of a positional error but not on correction of a scaling error. Further, the conventional adjustment method of an image forming device raises such problem that: the adjustment requires plural operations which causes the user to feel troublesome.

As described above, the object of the present invention is to provide (i) an adjustment method for an image forming device by which it is possible to properly adjust an image forming condition such as a position and a scale factor of an image the image forming device forms on a sheet even when the image scanning device for scanning the formed image is not properly adjusted and (ii) the image forming device for performing the adjustment by using the method.

Further, the object of the present invention is to provide (a) an adjustment method for an image forming system, provided with an image scanning device and the image forming device, by which it is possible to properly adjust an image scanning condition of the image forming device, and (b) the image forming system.

Moreover, the object of the present invention is to provide an adjustment method for an image scanning device in which it is possible to properly adjust an image scanning condition by combining the image scanning device with the aforementioned image forming device.

In addition, the object of the present invention is to provide an adjustment method for an image forming device, an image forming device, and an image forming system, by which it is possible to easily perform adjustment for each sheet containing means even when a plurality of the sheet containing means are provided on the image forming device.

In order to achieve the foregoing object, the adjustment method according to the present invention for adjusting the image forming device includes the steps of: (a) forming an image over at least three corners of a sheet based on a predetermined image data; (b) scanning the image formed on the sheet by scanning means; and (c) finding a correction value for modifying image forming condition with respect to the sheet, based on the image scanned by the scanning means, and adjusting the image forming device with the correction value.

According to the arrangement, an image is formed over at least three corners of a sheet, so that it is possible to easily scan the corners of the sheet when the image formed on the sheet is scanned by the scanning means. Further, a correction value for modifying an image forming condition with respect to the sheet is found in accordance with the image scanned by the scanning means.

For example, an electrostatic latent image over at least three corners of the sheet is formed as a developer image on the image carrying body of the image forming device. Thus, it is possible to form an image over at least three corners of the sheet.

Further, for example, a size of the sheet is found in accordance with the three corners of the sheet that have been printed, and the size is compared with a sheet size that has been stored in advance. Thus, a scaling error of the scanning means is figured out, thereby calculating a correction value of the scaling error. Further, for example, a corner size of the sheet that has been subjected to the correction of the scaling error and a corner size that has been stored in advance are compared with each other, thereby exactly calculating the positional deviation. In this manner, it is possible to find the correction value.

In this manner, even when the scanning means used in the scanning is not exactly adjusted, it is possible to find the correction value for modifying the image forming condition with respect to the sheet as long as the image formed over the corners of the sheet can be scanned by the scanning means. Therefore, it is possible to exactly and easily adjust the image forming device.

Note that, the adjustment method for an image forming device can be described as a method for an image scanning device which includes the steps of: (a) obtaining an image scanning correction value for modifying image scanning condition of the image scanning device with respect to a sheet; (b) modifying the image scanning condition of the image scanning device with respect to the sheet based on the image scanning correction value obtained in the step (a), wherein: the adjustment method further comprises the step of: (c) forming an image over at least three corners of the sheet before the step (a) so that the image extends outside the sheet, based on predetermined data that is prepared according to a size of the sheet, so as to allow calculation of the image scanning correction value using the sheet in the step (a), the image being formed by the image forming device, that is connected to the image scanning device.

In order to achieve the foregoing object, the adjustment method according to the present invention for adjusting the image forming device is arranged on the basis of the foregoing arrangement so that: in the step (a), the image is formed over all circumferences of the sheet.

According to the arrangement, a positional relationship of the image formed on the sheet and portions around the image is found by the scanning means, so that it is possible to exactly find the correction value.

Further, in order to achieve the foregoing object, the adjustment method according to the present invention for adjusting the image forming device is arranged on the basis of the foregoing arrangement so that: the correction value is found in accordance with a size of the sheet.

Generally, a sheet of a stock size whose longer length and shorter length are predetermined is used in the image forming device. When the correction value is found in accordance with a size of a sheet used to adjust the image forming device, it is not necessary to use a special reference document etc. for adjusting the image forming device.

Further, in order to achieve the foregoing object, the adjustment method according to the present invention for adjusting the image forming device is arranged on the basis of the foregoing arrangement so that: in the step (a), a longer length side of the sheet is placed along a sub-scanning direction of the image forming device.

In order to form an image over at least three corners of the sheet, an image over the corners of the sheet is formed in the step (a) for example. However, it is general that the image forming device forms an image with margins remaining around the sheet. Thus, some types of image forming devices are designed so that: a length of a writing area in which the writing means of the image forming device writes an image in a main-scanning direction is substantially the same as a longer length of the sheet. In the case of such an image forming device, when the sheet is placed so that the longer length side of the sheet is parallel to the main-scanning direction of the image forming device, it is impossible to form an image over the corners of the sheet by the writing means. Further, in order to surely form an image over the corners of the sheet, it is necessary to enlarge the writing area. Then, when the sheet is placed so that the longer length side of the sheet is parallel to the sub-scanning direction of the image forming device in the step (a), it is possible to easily form an image over the corners of the sheet without enlarging the writing area.

In order to achieve the foregoing object, the adjustment method according to the present invention for adjusting the image forming device is arranged on the basis of the foregoing arrangement so that: in the step (a), a longer length side of the sheet is placed along a sub-scanning direction of the scanning means.

When a length of a scanning area in which the scanning means scans an image in the main-scanning direction is made longer, a size of the scanning means is longer. Accordingly, it is necessary to prepare more scanning sensors required in scanning the image, so that this condition results in higher cost. Further, the sheet has to be exactly placed on the scanning area in order that the scanning means exactly scans the image. Otherwise, the scanning means cannot exactly scan the image. Then, when the scanning means scans the image after the sheet is placed so that the longer length side of the sheet is parallel to the sub-scanning direction of the scanning means, the size of the scanning means is minimized. As a result, it is possible to prevent the cost of the scanning means from increasing. Moreover, this arrangement enables the sheet to be placed on the scanning area with some margins, so that it is possible to prevent occurrence of the scanning error.

Further, the adjustment method of the present invention for adjusting the image forming device is arranged so that: the sheet is placed on a scanning area of the scanning means by providing a gap between a document reference member of the scanning means and an edge of the sheet.

In placing the sheet on the scanning area of the scanning means, when the sheet is placed so that an end portion of the sheet is brought into contact with a document reference member, provided on the scanning means, which indicates a position and a size of the sheet, it is difficult to discriminate the end portion of the sheet from the document reference member, so that accuracy in scanning an image formed on the corners of the sheet may drop. Then, when the sheet is placed so that there is a gap between the document reference member and the end portion of the sheet, it is possible to scan the image formed on the corners of the sheet with high accuracy.

Further, the adjustment method of the present invention for adjusting the image forming device further includes the step of: (e) finding a width of an image formed on the sheet, on a front portion in a direction orthogonal to a sheet carriage direction.

According to the arrangement, a size of the sheet used to adjust the image forming device is found in advance, so that it is possible to find a correction value (scale factor correction value) for modifying scale factors in the main-scanning direction and the sub-scanning direction of the image forming device in accordance with the size of the sheet, a size of the sheet that has been scanned by the scanning means, and image data obtained by the scanning means.

The adjustment method according to the present invention for adjusting the image forming device further includes the step of: (e) finding a width of a front portion of the image formed on the sheet, in a direction orthogonal to a sheet carriage direction.

According to the arrangement, it is possible to find a timing for writing in the main-scanning direction in accordance with (i) the width of the front portion of the image formed on the sheet in a direction orthogonal to a sheet carriage direction and (ii) the scale factor correction value in the main-scanning direction of the image forming device, so that it is possible to find a correction value with respect to a predetermined timing for writing in the main-scanning direction in accordance with that timing for writing.

Further, the adjustment method according to the present invention for adjusting the image forming device further includes the step of: (e) finding a width of a front portion of the image formed on the sheet, in a direction in parallel with a sheet carriage direction.

According to the arrangement, it is possible to find a timing for writing in the sub-scanning direction in accordance with (i) the width of the front portion of the image formed on the sheet in a direction in parallel with a sheet carriage direction and (ii) the scale factor correction value in the sub-scanning direction of the image forming device, so that it is possible to find a correction value with respect to a predetermined timing for writing in the sub-scanning direction in accordance with that timing for writing.

The foregoing adjustment method for an image forming device of the present invention is arranged so that: the scanning means is color scanning means having photoelectric transfer elements of three primary colors, the color scanning means scanning the image formed on the sheet by using one of the photoelectric transfer elements of the three primary colors.

The color scanning means carries out scanning of color images by dividing the image into three colors using an image sensor having photoelectric transfer elements of three primary colors, R (Red), G (Green) and B (Blue), that are made of color CCDs and provided with predetermined intervals. However, adjustment of the image forming device is more easily performed by one of the photoelectric transfer elements since the adjustment only requires scanning of position of the image formed on the sheet. Further, the amount of scanned data is reduced if the scanning is carried out by a photoelectric transfer element, thereby reducing calculation time of scanned data.

The foregoing adjustment method for an image forming device of the present invention is arranged so that: the scanning means scans the image on the sheet formed by the image forming section, by using one of the photoelectric transfer elements having a complementary color of the color material used for the image formed on the sheet.

This arrangement allows the scanning means to perform scanning with high clearness, thereby obtaining more accurate data through scanning.

Further, the present invention provides an image forming device carrying out adjustment thereof with one of the foregoing methods. The image forming device for an adjustment method comprises: writing means for forming an electrostatic latent image on an image carrying body according to the predetermined image data; carrying means for carrying the sheet; scanning means for scanning the image on the sheet; calculating means for finding the correction value for modifying the image forming condition with respect to the sheet according to data that is obtained by scanning the image formed on the sheet; and controlling means for controlling operation of the writing means so that the writing means forms the image over at least three corners of the sheet based on the predetermined image data, and controlling operation of the writing means and the carrying means according to the correction value.

With this arrangement in which the image forming device includes scanning means, it is not necessary to prepare dedicated scanning means, such as a scanner, for carry out adjustment of the image forming device.

The foregoing image forming device for carrying out one of the foregoing methods may comprises: writing means for forming an electrostatic latent image on an image carrying body according to the predetermined image data; carrying means for carrying the sheet; data inputting means for inputting data that is obtained by scanning the image formed on the sheet by the scanning means; operating means for inputting the correction value obtained by the data so as to modify the image forming condition with respect to the sheet; and controlling means for controlling operation of the writing means so that the writing means forms the image over at least three corners of the sheet based on the predetermined image data, and controlling operation of the writing means and the carrying means according to the correction value.

With this arrangement, the adjustment of image forming device may be performed by calculating a correction value for modifying image forming condition by a computer or the like based on the data scanned by the scanning means, and inputting the correction value to the image forming device via the operating means.

The foregoing image forming device may further include: resist correction data; and a plurality of image forming stations for forming an image with a plurality of color materials, wherein: the step (a) is performed with one of the plurality of color materials.

With this arrangement, a correction value for modifying image forming condition with respect to the sheet is found using only one of the color materials, and the correction values for the remaining colors may be found according to the resist correction data corresponding to those colors. In this manner, the adjustment is performed with one color material, thereby economically carrying out adjustment of image forming condition with respect to the sheet. Note that, the foregoing arrangement may be arranged so that the writing means includes a plurality of image forming stations for forming images.

Further, the foregoing image forming device may be arranged so that the plurality of image forming stations carry out different adjustments.

With this arrangement, one of the image forming stations is adjusted in image forming position and scaling with respect to both the main-scanning direction and the sub-scanning direction, and the remaining image forming stations are adjusted in scaling with respect to the main-scanning direction. The scaling of the sub-scanning direction is adjusted with the resist correction data.

The present invention provides an adjustment method for adjusting an image forming system, that includes an image forming device and an image scanning device, the method comprising the steps of: (a) forming by the image forming device an image over at least three corners of a sheet so that the image extends outside the sheet, based on predetermined data that is prepared according to a size of the sheet, in order to find a image forming correction value and a image scanning correction value respectively for correcting image forming condition and image scanning condition with respect to the sheet; (b) scanning by the image scanning device the sheet having the image formed in the step (a), so as to find the image forming correction value and the image scanning correction value; (c) modifying image scanning condition of the image scanning device with respect to the sheet based on the image scanning correction value found in the step (b); and (d) modifying image forming condition of the image forming means with respect to the sheet based on the image forming correction value found in the step (b).

The present invention provides an adjustment method for adjusting an image forming system, that includes an image forming device and an image scanning device, the method comprising the steps of: (a) forming by the image forming device an image over at least three corners of a sheet so that the image extends outside the sheet, based on predetermined data that is prepared according to a size of the sheet, in order to find a image forming correction value and a image scanning correction value respectively for correcting image forming condition and image scanning condition with respect to the sheet; (b) scanning by the image scanning device the sheet having the image formed in the step (a), so as to find the image forming correction value and the image scanning correction value; (c) modifying image scanning condition of the image scanning means with respect to the sheet based on the image scanning correction value found in the step (b); and (d) modifying image forming condition of the image forming means with respect to the sheet based on the image forming correction value found in the step (b).

With the foregoing image forming adjustment method for image forming device, and the image forming device using the method, it is possible to create an adjustment sheet (printed matter) for correcting scanning error of the image scanning device (in the adjustment sheet creating step). Therefore, a special sheet (reference document) for adjusting an image forming device is not required. Also, it is not necessary to bring the sheet for adjustment.

In the step (b), the scanning means scans the image formed over at least three corners of the sheet. Therefore, by comparing the scanned data with the regulation size of the sheet and the size of the image formed by the image forming device, image forming condition (image forming error) of the image forming device and image scanning condition (image scanning error) of the image scanning device can be found.

Further, since the correction value is found by carrying out at least one scanning of the sheet (correction value obtaining step), that is outputted from the image forming device, with an image scanning device, it is possible to adjust both the image forming device and the image scanning device (image scanning modification step, image forming modification step) after the scanning of the sheet. For example, the correction value obtaining step may be performed with one scanning operation. In this case, both the scanning device and the image forming device can be adjusted through a single printing and a single scanning. As described, the adjustment can be performed with a simpler procedure, and the time taken for adjustment can be reduced. Further, in contrast to the adjustment performed by a service person etc., this adjustment method is automatically performed by scanning the sheet by the image forming device, and therefore there is no variation of adjustment results due to individual difference.

In the foregoing arrangement, the image scanning modification step and the image forming modification step may be carried out in turn (in an arbitrary order), or at the same time.

Further, the foregoing method for an image forming system may be an adjustment method for a multi-functional device, that comprises the steps of: (a) forming an image over at least three corners of a sheet so that the image extends outside the sheet, based on predetermined image data; (b) scanning the image formed on the sheet by scanning means; and (c) finding correction values for modifying image forming condition of the image forming device with respect to the sheet and image scanning condition of the image scanning device, based on the image scanned by the scanning means, and substantially simultaneously adjusting the image forming device and the image scanning device using the respective correction values.

In addition to the foregoing arrangement, the adjustment method for an image forming system of the present invention is arranged so that: in the step (a), the image formed over at least three corners of the sheet is formed as a frame image that is formed over a whole circumference of the sheet.

With this arrangement, the image formed on the sheet has a portion covering the whole circumference of the sheet while extending outside the sheet, and a portion fully included inside the sheet. Therefore, by scanning the portion on the edge and the portion inside the sheet and finding out scaling of the image or the vertical/horizontal position of the image with respect to the sheet, it is possible to obtain an accurate correction value. Particularly, the edge of the sheet is immune to the image forming error of the image forming device, and therefore information the outer frame of the frame image may be used for modification of the image scanning device.

In addition to the foregoing arrangement, the adjustment method for an image forming system of the present invention is arranged so that the scanning correction value is found based on a size of the sheet in the step (c).

With this arrangement, the size of the sheet is referred as the reference size for adjustment, and therefore the reference value is previously determined. Further, this method accepts the use of general recording sheets or commercially available sheets of the regulation sizes. Thus, a particular reference document etc. is not required.

In addition to the foregoing arrangement, the adjustment method for an image forming system of the present invention is arranged so that: in the step (a), the sheet is smaller than a maximum sheet size for the image scanning device.

With this arrangement using a sheet smaller than a maximum sheet size for the image scanning device, the whole surface of the sheet may be securely scanned. On the other hand, when the adjustment is carried out with the maximum sheet for the image scanning device before adjusting the image scanning device, i.e., the scanning area of the image scanning device is not accurate, the scanning of the whole surface of the sheet may not be ensured.

In addition to the foregoing arrangement, the adjustment method for an image forming system of the present invention is arranged so that: when a longer length side of the sheet is identical to a shorter length side of a maximum sheet size for the image scanning device, in the step (a), the image is formed on the sheet, whose longer length side is in parallel with a sheet carrying direction, and in the step (b), scanning is carried out to the sheet placed on an original platen of the image scanning device so that a shorter length side of the sheet is either in parallel with a document reference member, or in contact with the document reference member.

In this manner, the sheet is sent out for image forming by placing the longer length side along the sub-scanning direction; and also, the sheet is placed on the original platen with the same orientation. Therefore, it is not necessary to increase the sizes of the respective devices, thus preventing an increase of cost. Further, there are some extra spaces in the image forming area and the image scanning area, thus preventing occurrence of adjustment error in advance.

For both the image forming device and the image scanning device, the image forming area or the image scanning area needs to be created with a larger area than a general structure if the maximum sheet size for the adjustment sheet is not determined. In this case, the sizes of the respective devices increase, thus raising the cost of scanning sensor, or writing unit etc.

Further, the foregoing adjustment method for an image forming system may be arranged so that: when a longer length side of the sheet is identical to a shorter length side of a maximum sheet size for the image scanning device, the sheet is carried in the longer length direction of the sheet upon image forming, and the sheet is placed on an original platen for image scanning by disposing the shorter length side of the sheet either in parallel with a document setting guide, or in contact with the document setting guide.

In addition to the foregoing arrangement, the adjustment method for an image forming system of the present invention is arranged so that: in the step (b), the image scanning correction value is found by scanning an outer frame of the frame image formed on the sheet, that is placed on an original platen of the image scanning device so that a shorter length side of the sheet is in contact with a reference mark of a document reference member provided on the original platen of the image scanning device, and in the step (c), an image scanning area of the image scanning means is modified based on the image scanning correction value.

With this arrangement, by scanning the outer frame image of a predetermined size, it is possible to adjust the center point and/or scanning start point of the image scanning area of the image scanning device.

Further, the foregoing adjustment method for an image forming system may be arranged so that: the adjustment of the image scanning device is carried out by placing the sheet outputted from the image forming device on the original platen so that the shorter length side of the sheet is in contact with a reference mark of a document setting guide, and scanning the outer frame of the frame image formed on the sheet so as to find a correction value for modifying the image scanning area.

In addition to the foregoing arrangement, the adjustment method for an image forming system of the present invention is arranged so that: the step (b) includes a sub-step (i) for scanning both ends in a main-scanning direction of the outer frame of the frame image, so as to find the image scanning correction value that is used for modifying a center position in the main-scanning direction of the image scanning area of the image scanning device. Further, in addition to the foregoing arrangement, the adjustment method for an image forming system of the present invention is arranged so that: the step (b) includes a sub-step (ii) for scanning a rear end in a sub-scanning direction of the outer frame of the frame image, so as to find the image scanning correction value that is used for modifying a scanning start position in the sub-scanning direction of the image scanning area of the image scanning device.

With this arrangement, the center point of the scanning area of the image scanning device can be adjusted by only scanning the sheet that is outputted from the image forming device and is placed along the reference mark of the document setting guide. Further, the scanning start point can be easily adjusted by placing the sheet outputted from the image forming device along the reference mark of the document setting guide, and scanning the rear edge of the sheet.

Further, the foregoing adjustment method for an image forming system may be arranged so that: the center point of the scanning area of the image scanning device is adjusted with scanning of both ends of the main-scanning direction of the outer frame image, and the scanning start point of the image scanning device is adjusted with scanning of rear edge of the outer frame image.

In addition to the foregoing arrangement, the adjustment method for an image forming system of the present invention is arranged so that: the step (b) includes a sub-step (iii) for scanning the outer frame and an inner frame of the frame image formed on the sheet, so as to find the image scanning correction value that is used for modifying an image writing scaling and an image writing starting timing of the image forming device.

With this arrangement, the image forming scaling of the sub-scanning direction can be found with reference to a predetermined length of the outer interval of the frame image in the sub-scanning direction, and the inner interval of the frame image in the sub-scanning direction that is formed from predetermined data. In this view, by checking the front edge of the image with the scaling ratio, it is possible to easily find a correction value for modifying the writing starting timing of the front edge of the image.

Further, the foregoing adjustment method for an image forming system may be arranged so that: the image forming device is adjusted by placing the sheet outputted from the image forming device on the original platen along the reference mark of the document setting guide, and scanning the outer frame and the inner frame of the frame image formed on the sheet so as to find correction values for modifying the image writing scaling and the image writing starting timing of the image forming device.

In addition to the foregoing arrangement, the adjustment method for an image forming system of the present invention is arranged so that: the step (b) further includes a sub-step (iv) for obtaining the image scanning correction value that is used for modifying an error of scanning position.

With this arrangement, the scanning correction value is found as a scanning position correction value, and the scanning position error is modified with this scanning position correction value. The correction value obtaining step may be carried out either with a single scanning or scanning of a plurality of sheets.

In addition to the foregoing arrangement, the adjustment method for an image forming system of the present invention is arranged so that: in the step (b), the sub-steps (iii) and (iv) are carried out with a single scanning of the sheet by the image scanning device.

With this arrangement, the correction values for modifying the image forming condition and the image scanning position error are obtained with a single scanning of the sheet by the image scanning device. Therefore, it is possible to carry out modifications of the image forming condition of the image forming device and the image scanning position error of the image scanning device with a single scanning of the sheet.

In addition to the foregoing arrangement, the adjustment method for an image forming system of the present invention is arranged so that: the step (b) includes before the sub-step (iv) a sub-step (v) for obtaining the image scanning correction value that is used for modifying a scanning scaling.

When it is likely that the image scanning device have a scaling error, an accurate correction value may be found by obtaining the correction value for modifying the scanning position through the sub-step (iv) after obtaining the correction value for modifying the scanning scaling in the sub-step (v).

In addition to the foregoing arrangement, the adjustment method for an image forming system of the present invention is arranged so that: in the step (b), the sub-steps (iv) and (v) are carried out with a single scanning of the sheet by the image scanning device.

With this arrangement, by performing with the image scanning device a single scanning of a sheet having the frame image formed by the image forming device, it is possible to complete the adjustments of the image forming device and the image scanning device.

The present invention provides an image forming system, comprising: image forming section for forming an image on a sheet; scanning means for scanning the image formed on the sheet by the image forming section; and calculating means for finding a correction value for modifying image forming condition of the image forming section with respect to the sheet, wherein: the image forming section carries out image forming with the correction value found by the calculating means, and the image forming section forms an image over at least three corners of the sheet so that the image extends outside the sheet, based on predetermined data that is prepared according to a size of the sheet, so as to find the correction value.

With this arrangement, the same effect as that of the foregoing adjustment method of an image forming system is provided to a combined image forming system, such as a multi-functional device made up of an image forming device and an image scanning device.

In addition to the foregoing arrangement, the adjustment method for an image forming system of the present invention is arranged so that: the image forming section is capable of forming an image with a plurality of color materials, the image forming section forming the image with at least one of the plurality of color materials, so as to find the correction value.

Here, a general multi-colored image forming device includes resist data that enables modification of all color materials through image forming of one of the color materials. With this function, when image forming of one of the color materials is performed to find a correction value for modifying the image forming position with respect to the sheet, the correction values for the remaining color materials can be found easily in consideration of the color resist correction data. On this account, the modifications of all color materials may be completed through image forming of one of the color materials, thereby economically performing the adjustment. Note that, in this case of using a multi-colored image forming device, the correction values of the respective colors may be individually found by forming plural images of all color materials.

In addition to the foregoing arrangement, the adjustment method for an image forming system of the present invention is arranged so that: the scanning means is color scanning means having photoelectric transfer elements of three primary colors for scanning color images, the color scanning means scanning the image formed on the sheet by the image forming section, by using at least one of the three primary colors of the photoelectric transfer elements.

A general color scanning means scans a color image by dividing the colors of the image with an RGB image sensors of color CCDs provided with predetermined intervals. However, such a color division is not necessary in the adjustment operation that carries out image scanning to obtain the position of the outputted image.

In this view, the scanning may be performed with one of the image sensors as described above. This arrangement offers easier control, less data amount, and less calculation time. For example, if an image is formed with a black color material, the image is scanned by the image sensor of green.

In addition to the foregoing arrangement, the adjustment method for an image forming system of the present invention is arranged so that: the scanning means scans the image on the sheet formed by the image forming section, by using one of the photoelectric transfer elements having a complementary color of the color material used for the image formed on the sheet.

With this arrangement, the scanning is performed with a complementary color of the color material used for the image forming. This arrangement allows the scanning means to perform scanning with high clearness, thereby obtaining more accurate data. For example, if the image forming is performed with a color material of Y, the image is scanned with B. Similarly, if the image forming is performed with a color material of M, the image is scanned with G. The image formed with C is scanned with R.

The foregoing image forming system may be expressed as an image forming system arranged so that: scanning is carried out using a photoelectric transfer element of a complementary color of the color material used for the image formed on the sheet.

In addition to the foregoing arrangement, the adjustment method for an image forming system of the present invention further comprises: operating means for detecting an instruction inputted by a user, the operating means detecting an outer dimension of the sheet used in the image forming section, or an input instruction regarding a correction value of the outer dimension.

This arrangement allows input of such as outer dimension of the sheet. On this account, the adjustment can be carried out with the use of a sheet of an arbitrary size, as well as a commercially-available regulation sheet.

Further, it may occur that the sheet used for image forming has a slight size difference. Also, strictly, the size of the sheet may be slightly changed through the fixing process with heat and pressure by the fixing section. In view of this problem, the sheet size, preferably after the image forming, is measured, and the difference between the measured dimension and the sheet size measured by the operating means or the reference sheet size is inputted as a dimension correction value. In this way, the adjustment can be carried out with high accuracy.

Further, the foregoing structure may also be arranged so that the display section displays a screen for demanding user's input of outer dimension of the sheet used in the image forming section, or the dimension correction value.

The foregoing image forming system may be expressed as a multi-functional device that includes an operation section for allowing input of outer dimension of the sheet or a dimension correction value, so as to modify the reference value of the adjustment sheet.

The present invention provides an adjustment method for an image scanning device, comprising the steps of: (a) obtaining an image scanning correction value for modifying image scanning condition of the image scanning device with respect to a sheet; (b) modifying the image scanning condition of the image scanning device with respect to the sheet based on the image scanning correction value obtained in the step (a), wherein: the adjustment method further comprises the step of: (c) forming an image over at least three corners of the sheet before the step (a) so that the image extends outside the sheet, based on predetermined data that is prepared according to a size of the sheet, so as to allow calculation of the image scanning correction value using the sheet in the step (a), the image being formed by the image forming device, that is connected to the image scanning device.

With this arrangement, the scanning means scans a sheet printed through an image forming device connected to the image scanning device, so as to find a correction value for modifying scanning condition of the scanning device.

In addition to the foregoing arrangement, the adjustment method for an image forming device of the present invention is arranged so that: in the step (c), the image forming section forms an image over at least three corners of the sheet supplied from the sheet containing means so that the image extends outside the sheet, based on predetermined data that is prepared according to a size of the sheet, the image forming section forming the image with a predetermined identification mark corresponding to the sheet containing means, and the image formed on the sheet are scanned as image data by scanning means, and the correction value corresponding to the sheet containing means is found based on the image data so that the image forming section adjusts the image forming condition with respect to the sheet based on the correction value corresponding to the sheet containing means.

The image forming device includes sheet containing means for storing sheets, and the image forming (printing) is performed by supplying a sheet from the sheet containing means to the image forming section of the image forming device. When the image forming device includes a plurality of sheet containing means, the sheets are carried to the image forming section via separate carriage paths corresponding to the respective sheet containing means. Therefore, strictly, the respective sheet containing means need to be individually adjusted to carry out proper adjustment of image forming condition with respect to the sheet.

In this view, the sheets are sequentially sent out for image forming for adjustment from the plural sheet containing means in response to selection and enforcement of the adjustment mode. By thus sequentially forming adjustment images on the sheets of the respective sheet containing means, the adjustment sheets can be created with one operation. On this account, the image forming can be efficiently performed, thereby carrying out efficient adjustment by scanning of the resulting objects with adjustment images Further, each sheet from the sheet containing means is provided with a predetermined identification mark corresponding to the sheet containing means. With this function, it can be clearly seen that the sheet with the formed image is supplied from which sheet containing means. Namely, the objects (sheets) with the formed image will not be mixed up with each other even when they are created through one operation.

The foregoing image forming method may be arranged as an adjustment method for an image forming device, comprising the steps of: (a) scanning by scanning means an object having an image formed through image forming means based on reference image data; and (b) finding a correction value for modifying image forming condition with respect to the sheet, based on the image scanned by the scanning means, wherein: in the step (a), adjustment images are formed on the sheets sequentially supplied from the respective sheet containing means so as to create objects having adjustment images, and predetermined identification marks corresponding to the sheet containing means are added to the respective objects, and in the step (b), the objects are scanned by the scanning means so as to find the correction values corresponding to the sheet containing means, that enable individual adjustment for each sheet containing means.

In addition to the foregoing arrangement, the adjustment method for an image forming device of the present invention is arranged so that: the plurality of sheets, each of which having the image formed in the step, together with the identification mark corresponding to the sheet containing means, are sequentially scanned by the scanning means, so as to find the correction values corresponding to the sheet containing means, that enable individual adjustment for each sheet containing means.

With this arrangement, an adjustment image such as a frame image is formed on each sheet, together with a predetermined identification mark corresponding to the sheet containing means. Then, the respective sheets are sequentially scanned by the scanning means with one operation using the automatic document carrying device, or with a series of sheet exchange operations by the user according to guidance display. In this way, the correction value for modifying image forming condition with respect to the sheet is properly found for each sheet containing means through one operation. On this account, the adjustment can be efficiently carried out with less working time.

Further, each sheet is provided with the identification (recognition) mark which indicates that the sheet is supplied from which sheet containing means, and therefore, it can be clearly seen that the sheet with the formed image is supplied from which sheet containing means. Accordingly, it is possible to prevent various mistakes upon scanning even when the scanning is carried out by different scanning means in a different order, or even when the scanning is carried out after a elapse of a long time after the image forming, thereby securely carrying out adjustment operation.

The foregoing image forming method may be arranged so that: plurality of adjustment objects, each of which having the image formed by the image forming means, together with the identification mark corresponding to the sheet containing means, are sequentially scanned by the scanning means, so as to find the correction values for the respective objects, that enable individual adjustment of image forming condition for each sheet containing means of the image forming means.

In addition to the foregoing arrangement, the adjustment method for an image forming device of the present invention is arranged so that: the scanning means scans a plurality of sheets sequentially carried to a scanning section of the scanning means by a document carrying device.

Here, it is a lot of work to obtain the correction values by sequentially scanning the plurality of sheets in which the adjustment images are formed.

In this view, the scanning of the plurality of sheets can be more easily carried out by using, for example, a document carrying device that sequentially supplies documents automatically in response to detection of setting of the sheets, or in response to detection of user's instruction. On this account, it is possible to reduce both the scanning time and the adjustment time. Further, since the scanning position of the document (sheet) is adjusted by this document carrying device, the user is immune to any concern for the setting position of the sheet.

The foregoing image forming method for an image forming device may be expressed as an arrangement in which: the image scanning means includes a document carrying means for automatically supplying a document to a scanning section, the document carrying means sequentially supplying a plurality of objects with the adjustment images to the scanning section so as to find correction values individually for the respective objects.

In addition to the foregoing arrangement, the adjustment method for an image forming device of the present invention is arranged so that: the identification mark indicates a carriage direction of the image forming section of the image forming device.

With this arrangement, the provision of the identification mark allows recognition of the sheet carriage direction in the image forming section, as well as distinction (recognition) of the sheet containing means. Accordingly, even when the sheet is placed in an inappropriate direction on the scanning means, i.e., when the sheet is turned by 90° or by 180° upon setting on the original platen, it is possible to correct the direction with reference to the identification mark, thereby properly finding the correction value. On this account, the user is immune to any concern for the setting direction of the sheet upon scanning by the scanning means.

The foregoing image forming method for an image forming device may be expressed as an arrangement in which: provision of the identification mark enables recognition of the carriage direction in the image forming section.

In addition to the foregoing arrangement, the adjustment method for an image forming device of the present invention is arranged so that: when a plurality of sheets having been supplied from different sheet containing means and subjected to image forming are scanned for calculation of correction values, a correction value for modifying image forming scaling is found by scanning one sheet from the sheet containing means, and a correction value for modifying image forming position is found by individually scanning all sheets from the sheet containing means.

Here, among the image forming conditions with respect to the sheet, the scaling of image does not change depending on whether the sheet is supplied from which sheet containing means. Thus, the scanning of the formed image will result in the same value for all sheets from the sheet containing means. Accordingly, the correction value is found by scanning a sheet from one of the sheet containing means. Meanwhile, the correction value for modifying image forming position differs depending on whether the sheet is supplied from which sheet containing means, and therefore it is found by individually scanning all sheets from the respective sheet containing means. On this account, it is possible to find accurate correction values in a less scanning time.

The foregoing adjustment method may be arranged so that: when the correction value is found using all scanning results of the plurality of sheets, the respective correction values for the plural sheets may be processed by an appropriate averaging operation, so as to find a correction value for each sheet containing means.

The foregoing adjustment method for an image forming device may be expressed as an arrangement in which: a correction value for modifying image forming scaling is found for an object with a formed image, and a correction value for modifying image forming position is found for each of all objects with formed images.

In addition to the foregoing arrangement, the adjustment method for an image forming device of the present invention is arranged so that: when the scanning means scans a plurality of sheets from an identical sheet containing means, the correction value is found by calculating an average value of a plurality of correction values obtained by the plurality of sheets from the identical sheet containing means.

As with this arrangement, the adjustment image may be formed on a plurality of sheets supplied from the same sheet containing means. In this case, the plural correction values obtained from the respective sheets of the same sheet containing means are, for example, averaged so as to figure out a correction value for the concerned sheet containing means. On this account, the adjustment can be carried out with high accuracy. However, the present invention is not limited to this arrangement, but may be arranged so that the adjustment image is formed on each sheet supplied from the respective containing means, and the adjustment is carried out through scanning of these sheets.

The foregoing adjustment method for an image forming device may be expressed as an arrangement in which: when the scanning means scans a plurality of objects each of which has a formed image, and if the device detects these objects with formed images are supplied from an identical sheet containing means, the correction value is found by calculating an average value of a plurality of correction values obtained by the plurality of objects from the identical sheet containing means.

The present invention provides an image forming device, comprising: an image forming section for forming an image on a sheet that is supplied from sheet containing means; and calculating means for finding a correction value for modifying image forming condition of the image forming section with respect to the sheet, the image forming section carrying out image forming according to the correction value found by the calculating means, wherein: in order to enable calculation of the correction value, the image forming section forms an image over at least three corners of the sheet supplied from the sheet containing means so that the image extends outside the sheet, based on predetermined data that is prepared according to a size of the sheet, the image forming section forming the image with a predetermined identification mark corresponding to the sheet containing means, and the image formed on the sheet are scanned as image data by scanning means that is connectable to the image forming section, and the calculating means finds the correction value corresponding to the sheet containing means based on the image data transmitted from the scanning means so that the image forming section adjusts the image forming condition with respect to the sheet based on the correction value corresponding to the sheet containing means.

An image forming device having such an arrangement performs the foregoing adjustment method for an image forming device, thereby providing the same effects as above.

The foregoing image forming device may have an arrangement in which the scanning means scans an object having an image formed through image forming means based on reference image data, so as to find a correction value for modifying image forming condition with respect to the sheet, based on the image scanned by the scanning means, wherein adjustment images are formed on the sheets sequentially supplied from the respective sheet containing means so as to create objects having adjustment images, and predetermined identification marks corresponding to the sheet containing means are added to the respective objects, and the objects are scanned by the scanning means so as to find the correction values corresponding to the sheet containing means, that enable individual adjustment for each sheet containing means.

In addition to the foregoing arrangement, the image forming device of the present invention further comprises: operating means for detecting a selection instruction by a user, wherein: when the image forming section forms the image on the sheet for adjusting image forming condition, the operating means enables selection between a (i) mode for supplying a plurality of sheets from one of the sheet containing means and outputting the sheets with the images, and a (ii) mode for supplying a plurality of sheets from a plurality of sheet containing means and outputting the sheets with the images.

For example, when the mode for supplying a plurality of sheets from one of the sheet containing means and outputting the sheets with the images is selected, these outputted sheets are, for example, scanned to find the correction values, and the found values are then averaged. In this manner, the adjustment can be carried out with high accuracy.

Further, for example, when the mode for supplying a plurality of sheets from a plurality of sheet containing means and outputting the sheets with the images is selected, the correction values for the plural sheet containing means can be found through one operation.

On this account, the foregoing image forming device is capable of easily carrying out adjustment for the plural sheet containing means, and also is capable of carrying out adjustment with high accuracy.

Further, the foregoing image forming device may allow selection of only one of the two different modes, or may allow simultaneous selection of the two modes.

The foregoing image forming device may be expressed as an arrangement in which: when the image forming section forms the image on the sheet for adjusting image forming condition, the image forming is carried out by selecting a (i) mode for supplying a plurality of sheets from one of the sheet containing means and outputting objects with the images, or a (ii) mode for supplying a plurality of sheets from a plurality of sheet containing means and outputting objects with the images.

The present invention provides an image forming system made up of one of the foregoing image forming devices; and scanning means for sequentially scanning a plurality of sheets having images formed by the image forming section of the image forming device, and transmitting image data of the images to the image forming device, wherein: the image forming device adjusts the image forming condition with respect to the sheet with the correction value, that is calculated for each of the sheet containing means by the calculating means based on the image data transmitted from the scanning means.

With this image forming system having such an arrangement, the scanning is performed by the scanning means, thus securely carrying out adjustment of the image forming device.

The foregoing scanning means of an image forming system may be expressed as scanning means for sequentially scanning plural objects, each of which has an adjustment image that is formed by the image forming means together with an identification mark indicating the sheet containing means, so as to find correction values for modifying image forming condition with respect to the sheet for each of the plural object, and to adjust image forming condition individually for each sheet containing means.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. An adjustment method for an image forming device, for adjusting image forming condition with respect to a sheet, the image forming device comprising:

image forming means for forming an image on an image carrying body and transferring the image from the image carrying body to a sheet, the adjustment method comprising the steps of:

(a) creating an adjustment sheet with the image forming means, by forming a first image, that is used for detecting scanning error of an image scanning device, on the image carrying body and transferring the first image from the image carrying body to the sheet, the first image being formed over at least three corners of the sheet while extending outside the sheet;

(b) scanning the adjustment sheet created in the step (a) by the image scanning device and calculating a scanning error amount of the image scanning device based on image data of the first image, so as to find a correction value of image forming condition of the image forming means in consideration of the scanning error amount; and (c) modifying image forming condition of the image forming means based on the correction value found in the step (b).

2. The adjustment method for an image forming device as set forth in claim 1, wherein:

in the step (a), a second image is created simultaneously with the first image so as to detect an error amount of the image forming means, and in the step (b), the correction value of image forming condition of the image forming means is found based on image data of the second image.

3. The adjustment method for an image forming device as set forth in claim 2, wherein:

in the step (a), plural images are formed instead of the first image and the second image, the plural images being formed on at least three corners of the sheet, respectively, while extending outside the sheet.

4. The adjustment method for an image forming device as set forth in claim 2, wherein:

in the step (a), a frame image is formed instead of the first image and the second image, the frame image being formed over a whole circumference of the sheet.

5. The adjustment method for an image forming device as set forth in claim 1, wherein:

in the step (b), the correction value is found based on a size of the sheet.

6. An image forming device, comprising:

image forming means for forming an image on an image carrying body and transferring the image from the image carrying body to a sheet;

adjustment sheet creating means for creating an adjustment sheet with the image forming means, by forming a first image, that is used for detecting scanning error of an image scanning device, on the image carrying body and transferring the first image from the image carrying body to the sheet, the first image being formed over at least three corners of the sheet while extending outside the sheet;

correction value obtaining means for calculating a scanning error amount of the image scanning device based on image data of the first image that is obtained by the image scanning means by scanning the adjustment sheet created by the adjustment sheet creating means, so as to find a correction value of image forming condition of the image forming means in consideration of the scanning error amount; and image forming condition correcting means for modifying image forming condition of the image forming means based on the correction value found by the correction value obtaining means.

7. The image forming device as set forth in claim 6, wherein:

the adjustment sheet creating means simultaneously creates a second image with the first image so as to detect an error amount of the image forming means, and the correction value obtaining means finds the correction value of image forming condition of the image forming means based on image data of the second image.

8. The image forming device as set forth in claim 7, wherein:

the adjustment sheet creating means creates plural images instead of the first image and the second image, the plural images being formed on at least three corners of the sheet, respectively, while extending outside the sheet.

9. The image forming device as set forth in claim 7, wherein:

the adjustment sheet creating means creates a frame image instead of the first image and the second image, the frame image being formed over a whole circumference of the sheet.

10. The image forming device as set forth in claim 6, wherein:

the correction value obtaining means finds the correction value based on a size of the sheet.

11. An adjustment method for an image scanning device, for adjusting image scanning condition, the image scanning device comprising:

image scanning means for scanning an image formed on a sheet, the adjustment method comprising the steps of:

(a) creating an adjustment sheet with an image forming device, by forming a first image, that is used for detecting scanning error, on the image carrying body and transferring the first image from the image carrying body to the sheet, the first image being formed over at least three corners of the sheet while extending outside the sheet;

(b) scanning the adjustment sheet created in the step (a) by the image scanning means and calculating a scanning error amount based on image data of the first image, so as to find a correction value of image scanning condition of the image scanning means; and (c) modifying image scanning condition of the image scanning means based on the correction value found in the step (b).

12. The adjustment method for an image scanning device, as set forth in claim 11, wherein:

in the step (b), the correction value is found based on a size of the sheet.

13. An image scanning device, comprising:

image scanning means for scanning an image formed on a sheet;

correction value obtaining means for forming a first image on an image carrying body for detecting scanning error, and transferring the first image to the sheet to create an adjustment sheet in which the first image is formed over at least three corners of the sheet while extending outside the sheet, and scanning the adjustment sheet by the image scanning means to calculate a scanning error amount of the image scanning means based on image data of the first image, so as to find a correction value of image scanning condition of the image scanning means; and image scanning condition correcting means for modifying image scanning condition of the image scanning means based on the correction value found by the correction value obtaining means.

14. The image forming device as set forth in claim 13, wherein:

the correction value obtaining means finds the correction value based on a size of the sheet.

15. An adjustment method for an image forming system, for adjusting image forming condition with respect to a sheet, the image forming system comprising:

an image forming device including image forming means for forming an image on an image carrying body and transferring the image from the image carrying body to a sheet; and an image scanning device including image scanning means for scanning the image on the sheet, the adjustment method comprising the steps of:

(a) creating an adjustment sheet with the image forming means, by forming a first image, that is used for detecting scanning error of image scanning means, on the image carrying body and transferring the first image from the image carrying body to the sheet, the first image being formed over at least three corners of the sheet while extending outside the sheet;

(b) scanning the adjustment sheet created in the step (a) by the image scanning means and calculating a scanning error amount of the image scanning means based on image data of the first image, so as to find a correction value of image scanning condition of the image scanning means;

(c) scanning the adjustment sheet created in the step (a) by the image scanning means and calculating a scanning error amount of the image scanning means based on image data of the first image, so as to find a correction value of image forming condition of the image forming means in consideration of the scanning error amount;

(d) modifying image scanning condition of the image scanning means based on the correction value found in the step (b); and (e) modifying image forming condition of the image forming means based on the correction value found in the step (c).

16. The adjustment method for an image forming system as set forth in claim 15, wherein:

in the step (a), a second image is created simultaneously with the first image so as to detect an error amount of the image forming means, and in the step (b), the correction value of image forming condition of the image forming means is found based on image data of the second image.

17. The adjustment method for an image forming system as set forth in claim 16, wherein:

in the step (a), plural images are formed instead of the first image and the second image, the plural images being formed on at least three corners of the sheet, respectively, while extending outside the sheet.

18. The adjustment method for an image forming system as set forth in claim 16, wherein:

in the step (a), a frame image is formed instead of the first image and the second image, the frame image being formed over a whole circumference of the sheet.

19. The adjustment method for an image forming system as set forth in claim 15, wherein:

in the steps (b) and/or (c), the correction value is found based on a size of the sheet.

20. An image forming system, comprising:

an image forming device including image forming means for forming an image on an image carrying body and transferring the image from the image carrying body to a sheet; and an image scanning device including image scanning means for scanning the image on the sheet, wherein:

the image forming system further comprises:

adjustment sheet creating means for creating an adjustment sheet with the image forming means, by forming a first image, that is used for detecting scanning error of image scanning means, on the image carrying body and transferring the first image from the image carrying body to the sheet, the first image being formed over at least three corners of the sheet while extending outside the sheet;

first correction value obtaining means for scanning with the image scanning means the adjustment sheet created by the adjustment sheet creating means and calculating a scanning error amount of the image scanning means based on image data of the first image, so as to find a correction value of image scanning condition of the image scanning means;

second correction value obtaining means for scanning with the image scanning means the adjustment sheet created by the adjustment sheet creating means and calculating a scanning error amount of the image scanning means based on image data of the first image, so as to find a correction value of image forming condition of the image forming means in consideration of the scanning error amount;

image scanning condition correcting means for modifying image scanning condition of the image scanning means based on the correction value found by the first correction value obtaining means; and image forming condition correcting means for modifying image forming condition of the image forming means based on the correction value found by the second correction value obtaining means.

21. The image forming system as set forth in claim 20, wherein:

the adjustment sheet creating means simultaneously creates a second image with the first image so as to detect an error amount of the image forming means, and the second correction value obtaining means finds the correction value of image forming condition of the image forming means based on image data of the second image.

22. The image forming system as set forth in claim 21, wherein:

the adjustment sheet creating means creates plural images instead of the first image and the second image, the plural images being formed on at least three corners of the sheet, respectively, while extending outside the sheet.

23. The image forming system as set forth in claim 21, wherein:

the adjustment sheet creating means creates a frame image instead of the first image and the second image, the frame image being formed over a whole circumference of the sheet.

24. The image forming system as set forth in claim 20, wherein:

the first and/or second correction value obtaining means find the correction value based on a size of the sheet.

25. An adjustment method for an image forming device, comprising the steps of:

(a) forming an image over at least three corners of a sheet based on predetermined image data;

(b) scanning the image formed on the sheet by scanning means; and (c) finding a correction value for modifying image forming condition with respect to the sheet, based on the image scanned by the scanning means, and adjusting the image forming device with the correction value.

26. The adjustment method for an image forming device as set forth in claim 25, wherein:

in the step (a), the image is formed over a whole circumference of the sheet.

27. The adjustment method for an image forming device as set forth in claim 25, wherein:

the correction value is found based on a size of the sheet.

28. The adjustment method for an image forming device as set forth in claim 25, wherein:

in the step (a), a longer length side of the sheet is placed along a sub-scanning direction of the image forming device.

29. The adjustment method for an image forming device as set forth in claim 25, wherein:

the scanning means scans the sheet whose longer length side is placed along a sub-scanning direction of the image scanning means.

30. The adjustment method for an image forming device as set forth in claim 25, wherein:

the sheet is placed on a scanning area of the scanning means by providing a gap between a document reference member of the scanning means and an edge of the sheet.

31. The adjustment method for an image forming device as set forth in claim 25, further comprising the step of:

(d) scanning a size of the sheet by the scanning means.

32. The adjustment method for an image forming device as set forth in claim 31, further comprising the step of:

(e) finding a width of a front portion of the image formed on the sheet, in a direction orthogonal to a sheet carriage direction.

33. The adjustment method for an image forming device as set forth in claim 31, further comprising the step of:

(e) finding a width of a front portion of the image formed on the sheet, in a direction in parallel with a sheet carriage direction.

34. The adjustment method for an image forming device as set forth in claim 25, wherein:

the scanning means is color scanning means having photoelectric transfer elements of three primary colors, the color scanning means scanning the image formed on the sheet by using one of the photoelectric transfer elements of the three primary colors.

35. The adjustment method for an image forming device as set forth in claim 34, wherein:

the scanning means scans the image on the sheet with one of the photoelectric transfer elements having a complementary color of a color material used for the image formed on the sheet.

36. The adjustment method for an image forming device as set forth in claim 25, wherein:

in the step (a), an image is formed over at least three corners of a sheet supplied from sheet containing means of the image forming device, the image containing a predetermined identification mark corresponding to the sheet containing means, and in the step (c), the correction value is found corresponding to the sheet containing means according to the identification mark.

37. The adjustment method for an image forming device as set forth in claim 36, wherein:

the scanning means sequentially scans a plurality of sheets each of which has an identification mark corresponding to the sheet containing means provided in the step (a) so as to find the correction value of image forming condition for each of the plurality of sheets of the sheet containing means.

38. The adjustment method for an image forming device as set forth in claim 36, wherein:

the scanning means scans a plurality of sheets sequentially carried to a scanning section of the scanning means by a document carrying device.

39. The adjustment method for an image forming device as set forth in claim 36, wherein:

the identification mark indicates a carriage direction of the image forming section of the image forming device in the step (a).

40. The adjustment method for an image forming device as set forth in claim 36, wherein:

in the step (c), a correction value for modifying image forming scaling is found by scanning one sheet from the sheet containing means, and a correction value for modifying image forming position is found by individually scanning all sheets from the sheet containing means.

41. The adjustment method for an image forming device as set forth in claim 36, wherein:

when the scanning means scans a plurality of sheets from an identical sheet containing means in the step (b), the correction value is found in the step (c) by calculating an average value of a plurality of correction values obtained by the plurality of sheets from the identical sheet containing means.

42. An image forming device for an adjustment method that comprises the steps of:

(a) forming an image over at least three corners of a sheet based on predetermined image data;

(b) scanning the image formed on the sheet by scanning means; and (c) finding a correction value for modifying image forming condition with respect to the sheet, based on the image scanned by the scanning means, and adjusting the image forming device with the correction value, the image forming device comprising:

writing means for forming an electrostatic latent image on an image carrying body according to the predetermined image data;

carrying means for carrying the sheet;

scanning means for scanning the image on the sheet;

calculating means for finding the correction value for modifying the image forming condition with respect to the sheet according to data that is obtained by scanning the image formed on the sheet; and controlling means for controlling operation of the writing means so that the writing means forms the image over at least three corners of the sheet based on the predetermined image data, and controlling operation of the writing means and the carrying means according to the correction value.

43. The image forming device as set forth in claim 42, further comprising:

resist correction data; and a plurality of image forming stations for forming an image with a plurality of color materials, wherein:

the step (a) is performed with one of the plurality of color materials.

44. The image forming device as set forth in claim 43, wherein:

the plurality of image forming stations carry out different adjustments.

45. An image forming device for an adjustment method that comprises the steps of:

(a) forming an image over at least three corners of a sheet based on predetermined image data;

(b) scanning the image formed on the sheet by scanning means; and (c) finding a correction value for modifying image forming condition with respect to the sheet, based on the image scanned by the scanning means, and adjusting the image forming device with the correction value, the image forming device comprising:

writing means for forming an electrostatic latent image on an image carrying body according to the predetermined image data;

carrying means for carrying the sheet;

data inputting means for inputting scanned data that is obtained by scanning the image formed on the sheet by the scanning means;

operating means for inputting the correction value obtained by the scanned data so as to modify the image forming condition with respect to the sheet; and controlling means for controlling operation of the writing means so that the writing means forms the image over at least three corners of the sheet based on the predetermined image data, and controlling operation of the writing means and the carrying means according to the correction value.

46. The image forming device as set forth in claim 45, further comprising:

resist correction data; and a plurality of image forming stations for forming an image with a plurality of color materials, wherein:

the step (a) is performed with one of the plurality of color materials.

47. The image forming device as set forth in claim 46, wherein:

the plurality of image forming stations carry out different adjustments.

48. An adjustment method for adjusting an image forming system including an image forming device and an image scanning device, comprising the steps of:

(a) forming by the image forming device an image over at least three corners of a sheet so that the image extends outside the sheet, based on predetermined data that is prepared according to a size of the sheet, in order to find a image forming correction value and a image scanning correction value respectively for correcting image forming condition and image scanning condition with respect to the sheet;

(b) scanning by the image scanning device the sheet having the image formed in the step (a), so as to find the image forming correction value and the image scanning correction value;

(c) modifying image scanning condition of the image scanning device with respect to the sheet based on the image scanning correction value found in the step (b); and (d) modifying image forming condition of the image forming means with respect to the sheet based on the image forming correction value found in the step (b).

49. The adjustment method for adjusting an image forming system as set forth in claim 48, wherein:

in the step (a), a frame image is formed over a whole circumference of the sheet as the image formed over at least three corners of the sheet.

50. The adjustment method for adjusting an image forming system as set forth in claim 48, wherein:

in the step (b), the image scanning correction value is found based on the size of the sheet.

51. The adjustment method for adjusting an image forming system as set forth in claim 48, wherein:

in the step (a), the sheet is smaller than a maximum sheet size for the image scanning device.

52. The adjustment method for adjusting an image forming system as set forth in claim 48, wherein:

when a longer length side of the sheet is identical to a shorter length side of a maximum sheet size for the image scanning device, in the step (a), the image is formed on the sheet, whose longer length side is in parallel with a sheet carrying direction, and in the step (b), scanning is carried out to the sheet placed on an original platen of the image scanning device so that a shorter length side of the sheet is either in parallel with a document reference member, or in contact with the document reference member.

53. The adjustment method for adjusting an image forming system as set forth in claim 49, wherein:

in the step (b), the image scanning correction value is found by scanning an outer frame of the frame image formed on the sheet, that is placed on an original platen of the image scanning device along a reference mark of a document reference member provided on the original platen of the image scanning device, and in the step (c), an image scanning area of the image scanning means is modified based on the image scanning correction value.

54. The adjustment method for adjusting an image forming system as set forth in claim 53, wherein:

the step (b) includes a sub-step (i) for scanning both ends in a main-scanning direction of the outer frame of the frame image, so as to find the image scanning correction value that is used for modifying a center position in the main-scanning direction of the image scanning device.

55. The adjustment method for adjusting an image forming system as set forth in claim 53, wherein:

the step (b) includes a sub-step (ii) for scanning a rear end in a sub-scanning direction of the outer frame of the frame image, so as to find the image scanning correction value that is used for modifying a scanning start position in the sub-scanning direction of the image scanning area of the image scanning device.

56. The adjustment method for adjusting an image forming system as set forth in claim 53, wherein:

the step (b) includes a sub-step (iii) for scanning the outer frame and an inner frame of the frame image formed on the sheet, so as to find the image scanning correction value that is used for modifying an image writing scaling and an image writing starting timing of the image forming device.

57. The adjustment method for adjusting an image forming system as set forth in claim 56, wherein:

the step (b) further includes a sub-step (iv) for obtaining the image scanning correction value that is used for modifying an error of scanning position.

58. The adjustment method for adjusting an image forming system as set forth in claim 57, wherein:

in the step (b), the sub-steps (iii) and (iv) are carried out with a single scanning of the sheet by the image scanning device.

59. The adjustment method for adjusting an image forming system as set forth in claim 57, wherein:

the step (b) includes before the sub-step (iv) a sub-step (v) for obtaining the image scanning correction value that is used for modifying a scanning scaling.

60. The adjustment method for adjusting an image forming system as set forth in claim 59, wherein:

in the step (b), the sub-steps (iv) and (v) are carried out with a single scanning of the sheet by the image scanning device.

61. An image forming system, comprising:

image forming section for forming an image on a sheet;

scanning means for scanning the image formed on the sheet by the image forming section; and calculating means for finding a correction value for modifying image forming condition of the image forming section with respect to the sheet, wherein:

the image forming section carries out image forming with the correction value found by the calculating means, and the image forming section forms an image over at least three corners of the sheet so that the image extends outside the sheet, based on predetermined data that is prepared according to a size of the sheet, so as to find the correction value.

62. The image forming system as set forth in claim 61, wherein:

the image forming section is capable of forming an image with a plurality of color materials, the image forming section forming the image with at least one of the plurality of color materials, so as to find the correction value.

63. The image forming system as set forth in claim 62, wherein:

the scanning means is color scanning means having photoelectric transfer elements of three primary colors for scanning color images, the color scanning means scanning the image formed on the sheet by the image forming section, by using at least one of the three primary colors of the photoelectric transfer elements.

64. The image forming system as set forth in claim 63, wherein:

the scanning means scans the image on the sheet formed by the image forming section, by using one of the photoelectric transfer elements having a complementary color of the color material used for the image formed on the sheet.

65. The image forming system as set forth in claim 61, further comprising:

operating means for detecting an instruction inputted by a user, the operating means detecting an outer dimension of the sheet used in the image forming section, or an input instruction regarding a correction value of the outer dimension.

66. An adjustment method for an image scanning device, comprising the steps of:

(a) obtaining an image scanning correction value for modifying image scanning condition of the image scanning device with respect to a sheet;

(b) modifying the image scanning condition of the image scanning device with respect to the sheet based on the image scanning correction value obtained in the step (a), wherein:

the adjustment method further comprises the step of:

(c) forming an image over at least three corners of the sheet before the step (a) so that the image extends outside the sheet, based on predetermined data that is prepared according to a size of the sheet, so as to allow calculation of the image scanning correction value using the sheet in the step (a), the image being formed by the image forming device, that is connected to the image scanning device.

67. An image forming device, comprising:

an image forming section for forming an image on a sheet that is supplied from sheet containing means; and calculating means for finding a correction value for modifying image forming condition of the image forming section with respect to the sheet, the image forming section carrying out image forming according to the correction value found by the calculating means, wherein:

in order to enable calculation of the correction value, the image forming section forms an image over at least three corners of the sheet supplied from the sheet containing means so that the image extends outside the sheet, based on predetermined data that is prepared according to a size of the sheet, the image forming section forming the image with a predetermined identification mark corresponding to the sheet containing means, and the image formed on the sheet are scanned as image data by scanning means that is connectable to the image forming section, and the calculating means finds the correction value corresponding to the sheet containing means based on the image data transmitted from the scanning means so that the image forming section adjusts the image forming condition with respect to the sheet based on the correction value corresponding to the sheet containing means.

68. The image forming system as set forth in claim 67, further comprising:

operating means for detecting a selection instruction by a user, wherein:

when the image forming section forms the image on the sheet for adjusting image forming condition, the operating means enables selection between a (i) mode for supplying a plurality of sheets from one of the sheet containing means and outputting the sheets with the images, and a (ii) mode for supplying a plurality of sheets from a plurality of sheet containing means and outputting the sheets with the images.

69. An image forming system, comprising:

an image forming device including an image forming section for forming an image on a sheet that is supplied from sheet containing means, and calculating means for finding a correction value for modifying image forming condition of the image forming section with respect to the sheet, the image forming section carrying out image forming according to the correction value found by the calculating means, the image forming section forming an image for finding the correction value over at least three corners of the sheet supplied from the sheet containing means so that the image extends outside the sheet, based on predetermined data that is prepared according to a size of the sheet, the image forming section forming the image with a predetermined identification mark corresponding to the sheet containing means, the image formed on the sheet being scanned as image data by scanning means that is connectable to the image forming section so that the calculating means finds the correction value corresponding to the sheet containing means based on the image data transmitted from the scanning means, the image forming section adjusting the image forming condition with respect to the sheet based on the correction value corresponding to the sheet containing means; and scanning means for sequentially scanning a plurality of sheets having images formed by the image forming section of the image forming device, and transmitting image data of the images to the image forming device, wherein:

the image forming device adjusts the image forming condition with respect to the sheet with the correction value, that is calculated for each of the sheet containing means by the calculating means based on the image data transmitted from the scanning means.

* * * * *